US006536868B1

(12) United States Patent
Kawamura et al.

(10) Patent No.: US 6,536,868 B1
(45) Date of Patent: Mar. 25, 2003

(54) LIQUID EJECTION TYPE PRINT HEAD, PRINTING APPARATUS PROVIDED WITH SAME AND A METHOD FOR PRODUCING A LIQUID EJECTION TYPE PRINT HEAD

(75) Inventors: Shogo Kawamura, Shizuoka (JP); Toshiaki Hirosawa, Kanagawa (JP); Riichi Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 09/643,826

(22) Filed: Aug. 22, 2000

(30) Foreign Application Priority Data

Aug. 24, 1999 (JP) ..... 11-236783
Aug. 24, 1999 (JP) ..... 11-236994

(51) Int. Cl.[7] ..... B41J 2/15
(52) U.S. Cl. ..... 347/40; 347/43
(58) Field of Search ..... 347/40, 12, 15, 347/43, 89, 49

(56) References Cited

U.S. PATENT DOCUMENTS 5,745,129 A 4/1998 Moriyama et al. ..... 347/12
6,062,675 A 5/2000 Hirosawa et al. ..... 347/50

FOREIGN PATENT DOCUMENTS

| | | |
|---|---|---|
| EP | 0759362 | 2/1997 |
| EP | 0773108 | 5/1997 |
| EP | 0860285 | 8/1998 |
| WO | WO99/62714 | 12/1999 |

*Primary Examiner*—Lamson Nguyen
(74) *Attorney, Agent, or Firm*—Fitzpatrick, Cella, Harper & Scinto

(57) ABSTRACT

A print element unit comprising a print element substrate, and a plate-like member having a surface to be adhered on which the print element substrate is positioned and fixedly adhered via heat-hardening adhesive and a first reference surface used as a positioning reference to the print element substrate to be fixedly adhered, wherein a holder member for holding tanks for storing liquid supplied to the print element substrate, having the second reference surface to be detachably engaged with the first reference surface of the plate-like member and with a reference surface of a mounting portion of a carriage member movable together with the print element substrate and the plate-like member, and the second reference surfaces are engaged with the first surface, and then the print element unit and the holder member are fixedly adhered with each other via a hardening adhesive at a low (normal) temperature.

21 Claims, 45 Drawing Sheets

LIQUID EJECTION TYPE PRINT HEAD, PRINTING APPARATUS PROVIDED WITH SAME AND A METHOD FOR PRODUCING A LIQUID EJECTION TYPE PRINT HEAD

This application is based on Japanese Patent Application Nos. 11-236783 (1999) filed Aug. 24, 1999 and 11-236994 filed Aug. 24, 1999, the contents of which are incorporated hereinto by reference.

BACKGROUND OF THE INVENTION

1. Field of the Invention

The present invention relates to a liquid ejection print head, a printing apparatus provided with the same and a method for producing a liquid ejection print head. The present invention is applicable not only to generally used printers but also to copiers, facsimile recorders with a communication system, word processors with a printing unit, or the like. Further, it relates to industrial printing apparatuses combined with various processing devices in a composite manner.

2. Description of the Related Art

An ink jet type printing apparatus has been put into practice, wherein the printing operation is carried out on a printing surface of printing medium. In general, the ink jet type printing apparatus is provided with an ink cartridge having a print head for ejecting ink to the printing surface of the printing medium, for example, as shown in FIGS. 22 and 23.

As shown in FIGS. 22 and 23, the ink cartridge consists of ink tanks 4Y, 4M and 4C for storing predetermined color ink, for example, yellow ink, magenta ink and cyan ink, respectively, a tank holder 2 for accommodating the ink tanks 4Y, 4M and 4C, a print element substrate 10 disposed on the bottom of the tank holder 2, for ejecting ink from the respective ink tanks 4Y to 4C through a plurality of ejecting openings, and a flexible wiring board 8 electrically connected to the print element substrate 10, for supplying a group of control signals to the print element substrate 10.

The print element substrate 10 consists of substrates 10C, 10M and 10Y for ejecting respective colored inks. Since the substrates 10C, 10M and 10Y are of the same structure to each other, the explanation will be made solely on the substrate 10M, while eliminating that of the other substrates.

For example, as shown in FIG. 21 in an enlarged manner, the substrate 10M is formed of silicon as a thin plate and has a group of ink ejection openings 10*a* arranged in one direction in a zigzag manner. In each of ink flow passages communicating with the respective ink ejection opening is provided a heater used as an electrothermal transducer. Also, a group of electrodes 10*e* are formed along opposite short edges thereof, for transmitting the supplied control signals to the respective heater via a conductor layer not shown. On the back surface of the substrate 10M is formed an elongate recess 10*b* in correspondence to the group of ink ejection openings 10*a*.

On a bulged portion in the bottom of the tank holder 2 made of resinous material, a frame member 12 is disposed having an opening at a center thereof. In the opening of the frame member 12, a support member 14 is arranged. The support member 14 serves for dissipating heat generated when the print element substrate 10 is driven and serves for making the substrate to be mutually parallel to a surface on which the substrates 10Y to 10C are arranged. Since the frame member 12 is fixedly adhered to the support member 14, it functions as a heat dissipation member similar to the support member 14. The support member 14 and the frame member 12 are made, for example, of silicon or alumina which can be machined to have a flatness at a relatively high degree equal to that of material for the print element substrate 10 and are excellent in heat dissipation. The support member 14 has three ink supply openings 14*a* arranged in a central area at a predetermined interval, for allowing ink from the respective ink tanks to pass therethrough, and is fixedly adhered to the tank holder 2. As an adhesive, silicon-modified epoxy type adhesive is favorably used, which is ink-resistant to be usable as a sealant and has elasticity capable of compensating for the difference in linear thermal expansion coefficient between different kinds of material; for example, between alumina and resinous material.

At each the opposite ends of the bulged portion on the bottom of the tank holder 2 used as a holder member, a recess 2A is formed. The respective recess 2A is defined by four flat faces encircling the same. One of these four faces is a reference surface 2RS formed in the moving direction of the tank holder 2 accompanied with the ink tanks 4Y to 4C, that is, in the direction of arrow S shown in FIG. 21. The reference surface 2RS of the recess 2A engages with an engagement section 16K of a carriage member 16 described later, respectively.

Further, as shown in FIG. 22, on the frame member 12, the flexible wiring board 8 electrically connected to the group of electrodes 10*e* of the substrates 10C to 10Y in the print element substrate 10 is disposed. The flexible wiring board 8 has an opening at a position corresponding to the print element substrate 10.

The tank holder 2 as shown in a phantom line in FIG. 23, accommodating the ink tanks 4Y to 4C therein, is inserted into the carriage member 16 in the direction of the arrow so that it is mounted to a mounting portion within the carriage member 16 provided in the printing apparatus as shown in a solid line.

The carriage member 16 is movably held by a guide shaft GS which slidably engages into a through-hole 16*b* of a proximal end of the carriage member 16. Also, on the bottom of the carriage member 16, an opening 16*a* is formed to communicate with the mounting portion. Further, at the peripheral position of the opening 16*a*, an engagement portion 16K is provided opposite thereto, having a surface to be engaged with the reference surface 2RS of the above-mentioned recess 2A of the tank holder 2. The engagement portion 16K extends in the direction of the arrow S of FIG. 23, that is, in the moving direction of the carriage member 16, toward the interior of the opening 16*a*.

It is necessary that the above-mentioned group of ink ejection openings 10*a* of the print element substrate 10 are arranged at a predetermined angle relative to the direction of the arrow S shown in FIGS. 21 and 23, for example, generally vertical thereto for the purpose of forming pixels at predetermined positions on the print surface of the printing medium as moving in the direction of the arrow S, Accordingly, when the print element substrate 10 is located and fixed at a predetermined position on the tank holder 2, the print element substrate 10 is first positioned on the support member 14 within the opening of the frame member 12 so that the direction of the group of ink ejection openings 10*a* in the respective substrates 10Y to 10C are generally vertical to the reference surface 2RS, and then fixed with an adhesive. The adhesive may be, for example, an ink-resistant epoxy type heat-hardening adhesive also usable as a sealant. Thus, the print element substrate 10 is fixed on the tank holder 2 so that the group of ink ejection openings 10*a* thereof extend generally vertical to the reference surface 2RS.

Then, when the group of ink ejection openings 10*a* of the print element substrate 10 on the tank holder 2 are located at predetermined positions of the mounting portion of the carriage member, as shown in FIG. 23, the tank holder 2 is inserted into the interior of the mounting portion so that the reference surface 2RS in the recess 2A abuts to the engagement surface of the engagement portion 16K, whereby the group of ink ejection openings 10*a* of the attached print element substrate 10 are automatically positioned in the direction generally vertical to the direction of the arrow S.

However, as described above, the positioning of the print element substrate 10 in relation to the support member 14 in the tank holder 2 and the indirect positioning of the print element substrate 10 in relation to the carriage member 16 via the tank holder 2 are carried out based on the reference surfaces different from each other, resulting in the accumulation of positioning errors of the print element substrate 10 in relation to the carriage member 16. Accordingly, there is a risk in that the positioning accuracy of the print element substrate 10 may be degraded.

SUMMARY OF THE INVENTION

A main object of the present invention is to provide a liquid ejection type print head, a printing apparatus provided with the same, and a method for producing a liquid ejection type print head, capable of improving the positioning accuracy of the print element substrate in relation to a carriage member with simple mechanics.

To achieve the above-mentioned object, the liquid ejection type print head according to the present invention comprising, a plurality of print element substrates, each having print elements for ejecting liquid, a support member for supporting the print element substrates and a holder secured to the support member and having a section for positioning the holder in relation to a carriage movable together with the print element substrates and the support member; the liquid ejection type print head supplying the liquid to the print element substrates via the holder and the support member, wherein the section for positioning the holder in relation to the carriage is also used as a section for positioning the support member onto the holder.

Also, the printing apparatus according to the present invention comprising, a liquid ejection type print head for carrying out the printing operation by ejecting liquid and a carriage member for transporting the liquid ejection type print head while carrying the same thereon, wherein the liquid ejection type print head is provided with a plurality of print element substrates, each having print elements for ejecting liquid, a support member for supporting the print element substrates and a holder secured to the support member and having a section for positioning the holder onto a carriage movable together with the print element substrates and the support member, and the section for positioning the holder in relation to the carriage is also used as a section for positioning the support member onto the holder.

Further, the method for producing a liquid ejection type print head comprising the steps of, positioning a first print element substrate to a surface to be adhered therewith on the support member having a protrusion defining a positioning section, the first printing element substrate having print elements for ejecting liquid and a plurality of alignment marks for a positioning operation, while using a predetermined relative position of the respective alignment mark as a reference in relation to the protrusion, and positioning a second print element substrate to a surface to be adhered therewith, the second print element substrate being disposed adjacent to the first print element substrate and having a plurality of alignment marks for a positioning operation, while using a predetermined relative position of the respective alignment mark as a reference in relation to the alignment mark of the first print element substrate.

Since the present invention is provided with a basic configuration so that the section for positioning the holder in relation to the carriage is also used as a section for positioning the support member onto the holder, it is possible to improve the positioning accuracy of the print element substrate in relation to the carriage member by simple structure.

The above and other objects, effects, features, and advantages of the present invention will become more apparent from the following description of embodiments thereof taken in conjunction with the accompanying drawings.

DESCRIPTION OF THE PREFERRED EMBODIMENTS

Embodiments of the printing apparatus according to the present invention will be described by referring to the accompanying drawings.

In the following description we take up as an example a printing apparatus using an ink jet printing system.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

1. Apparatus Body

Figure 1:
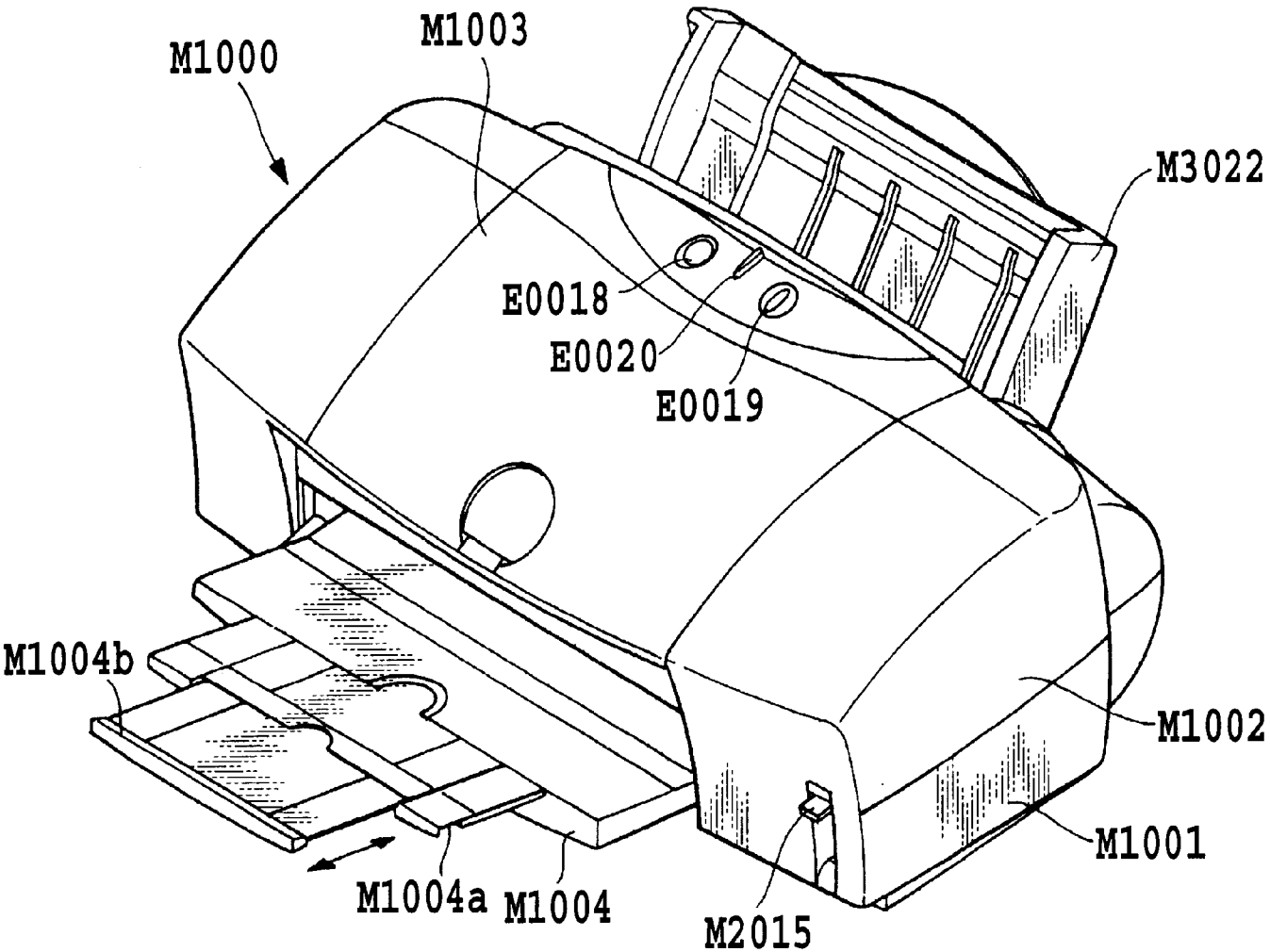
FIG. 1 is a perspective view showing an external construction of an ink jet printer according to one embodiment of the present invention.
Figure 2:
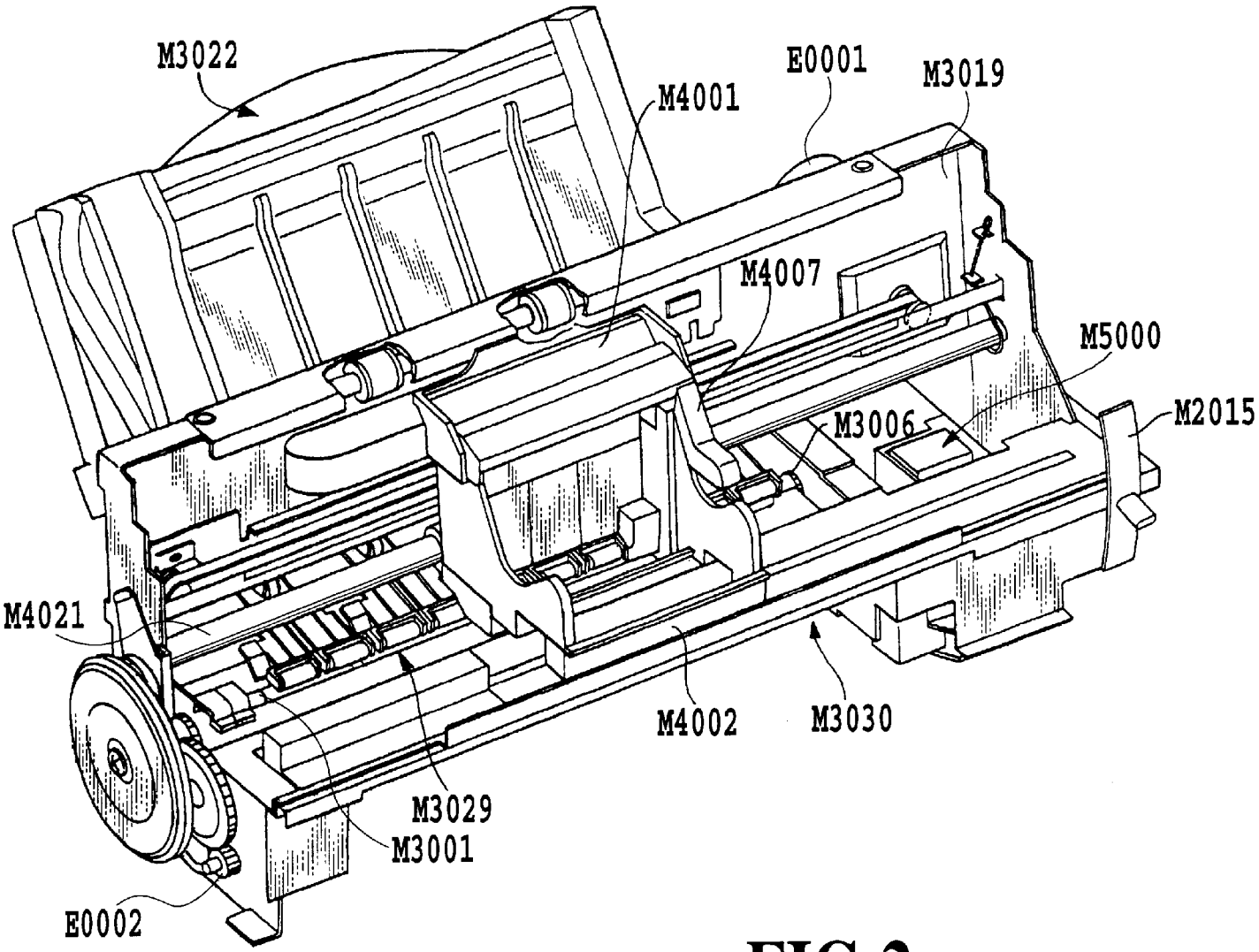
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1 Print Head Cartridge

First, the print head cartridge used in the print unit will be described with reference to FIGS. 3 to 5.

Figure 3:
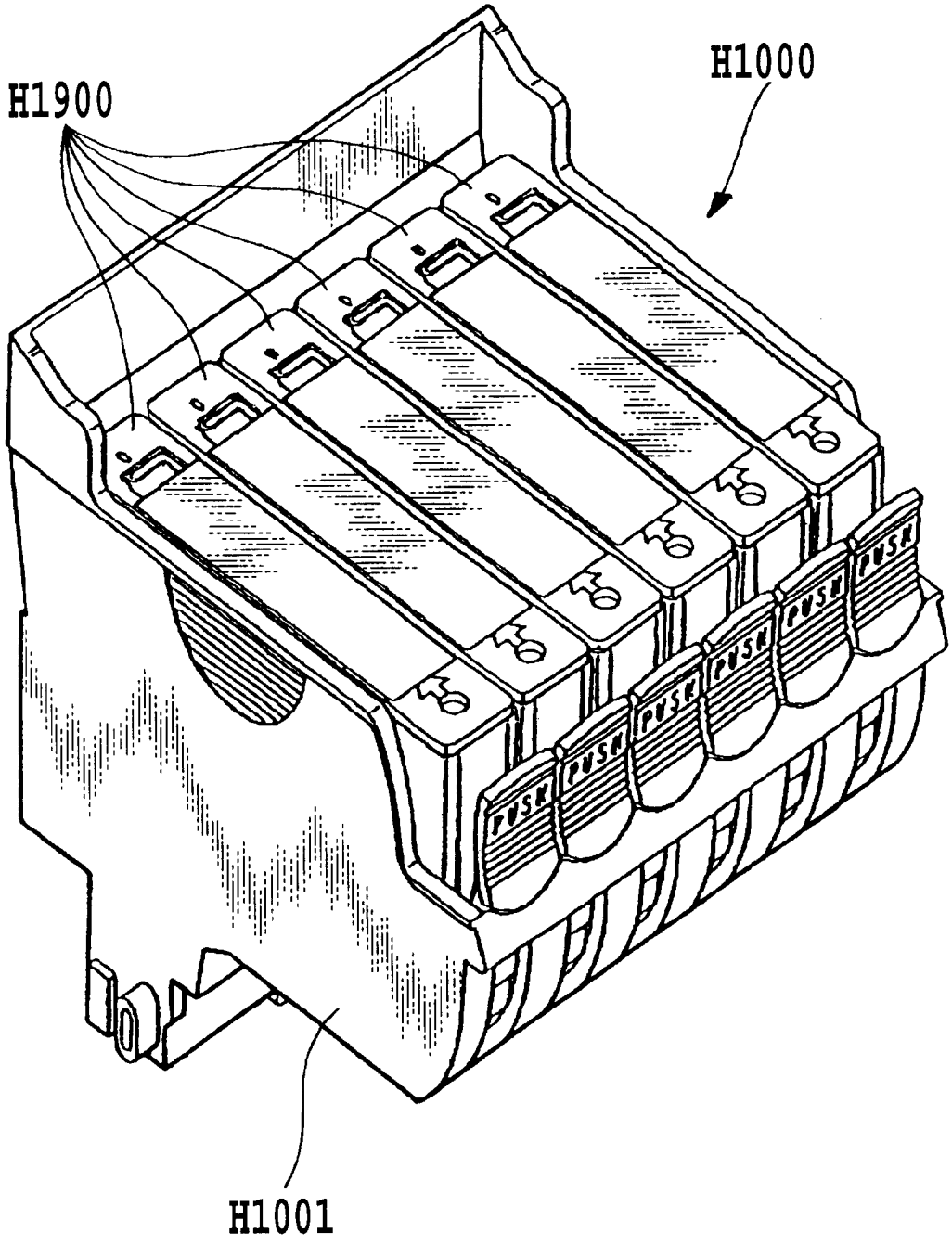
FIG. 3 is a perspective view showing an assembled print head cartridge used in the printer according to one embodiment of the present invention.
Figure 4:
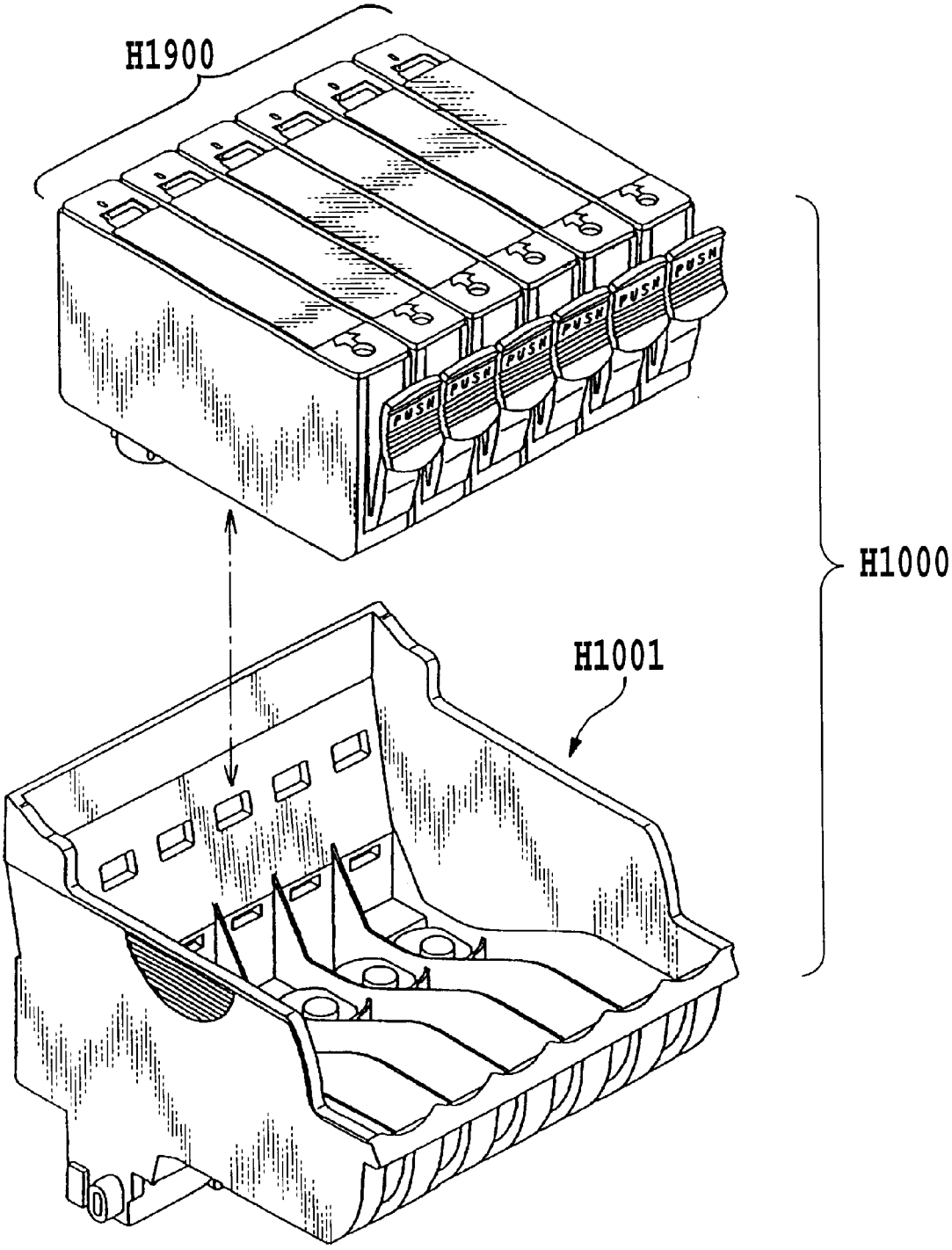
FIG. 4 is an exploded perspective view showing the print head cartridge shown in FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
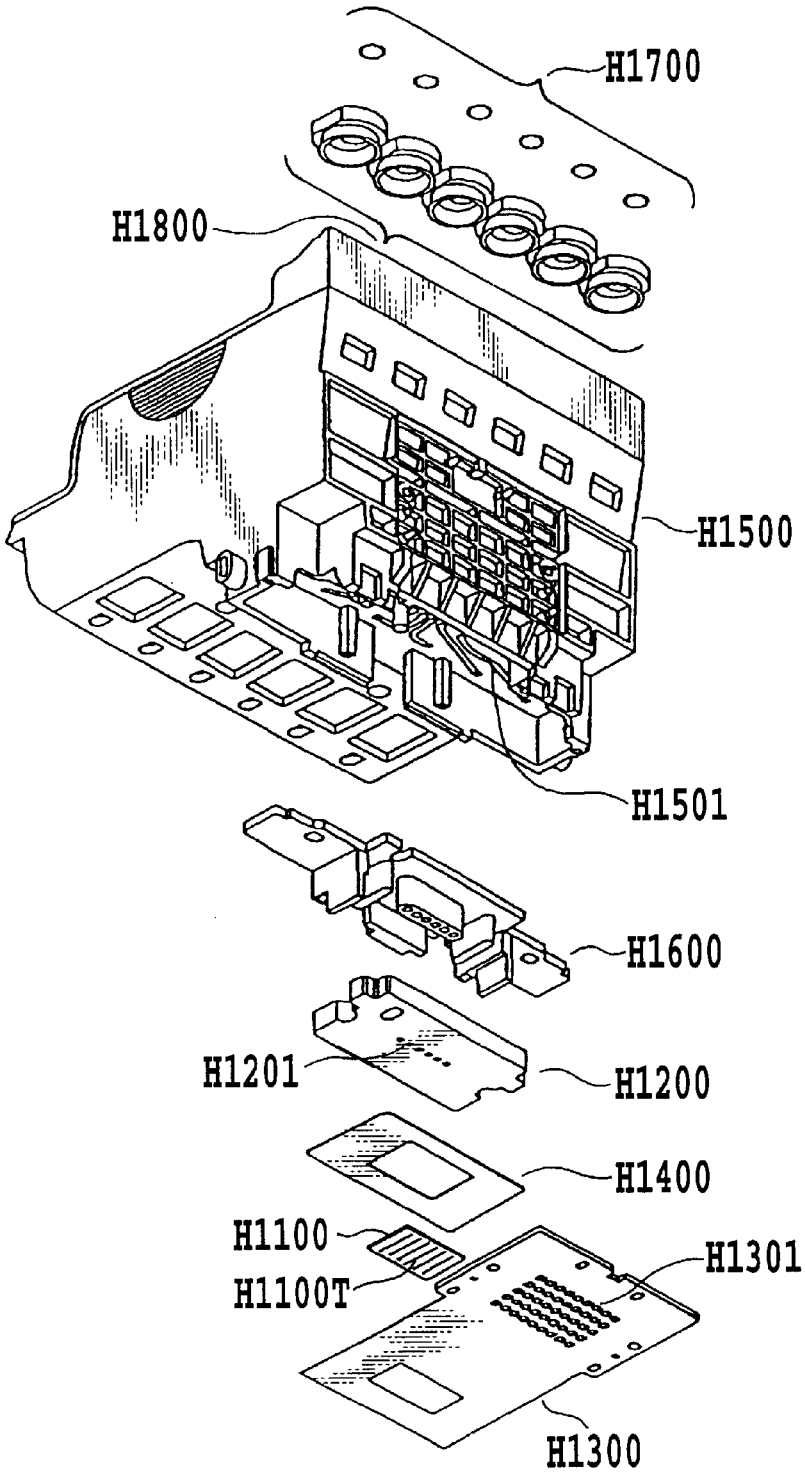
FIG. 5 is an exploded perspective view of the print head shown in FIG. 4 as seen diagonally from below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2 Carriage

Next, by referring to FIG. 2, the carriage M4001 carrying the print head cartridge H1000 will be explained.

As shown in FIG. 2, the carriage M4001 molded with resinous material, has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figure 6B:
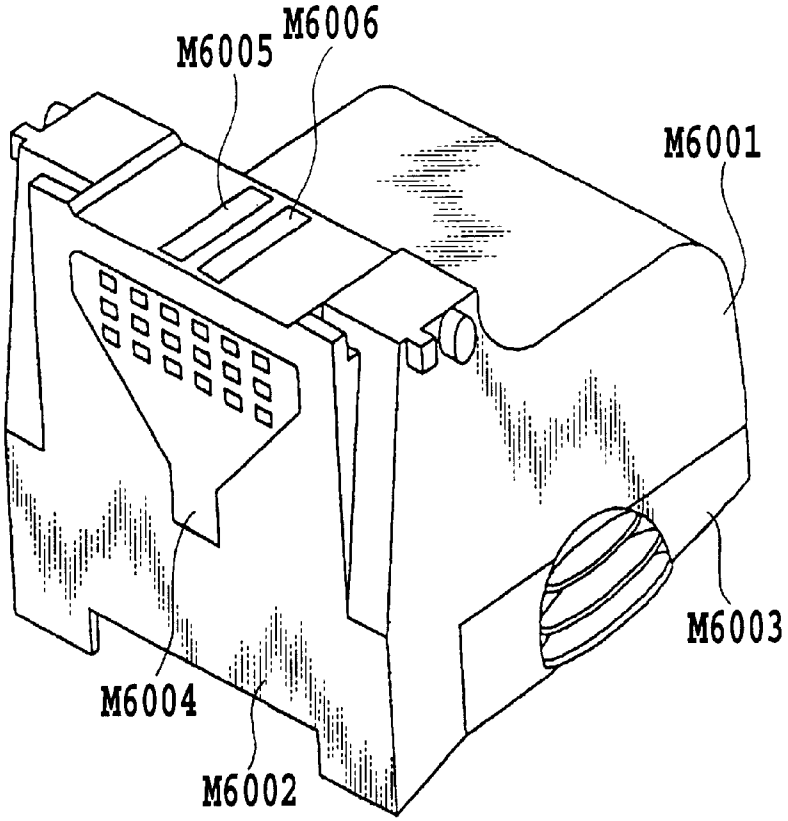
FIGS. 6A and 6B are perspective views showing a construction of a scanner cartridge upside down which can be mounted in the printer of one embodiment according to the present invention instead of the print head cartridge of FIG. 3.
Figure 6A:
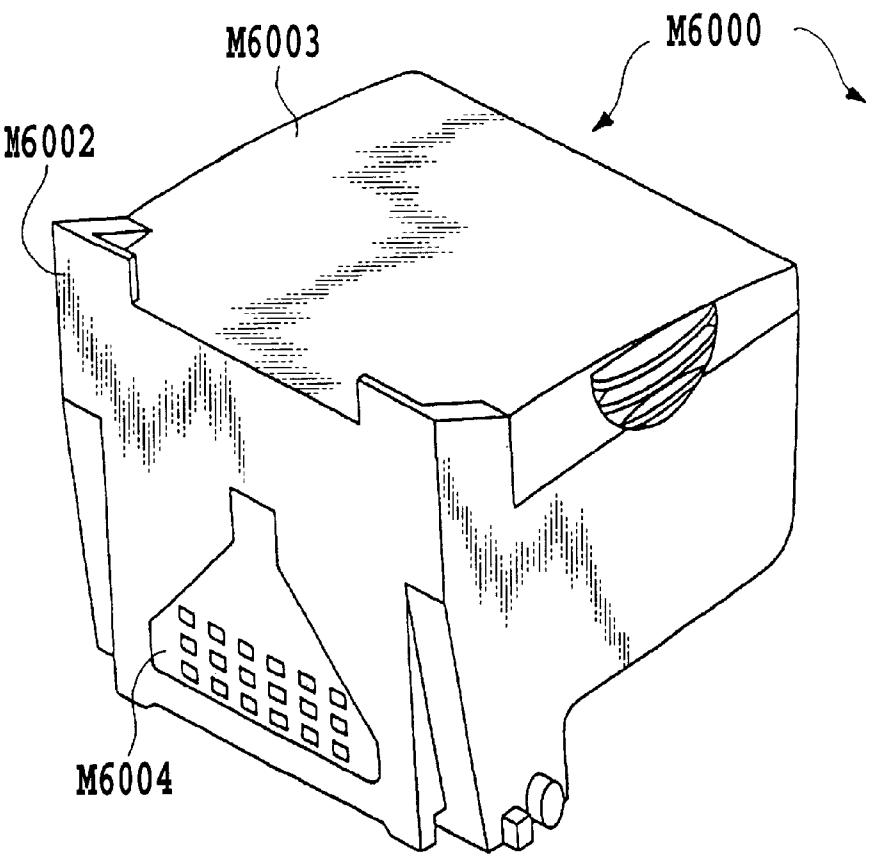

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
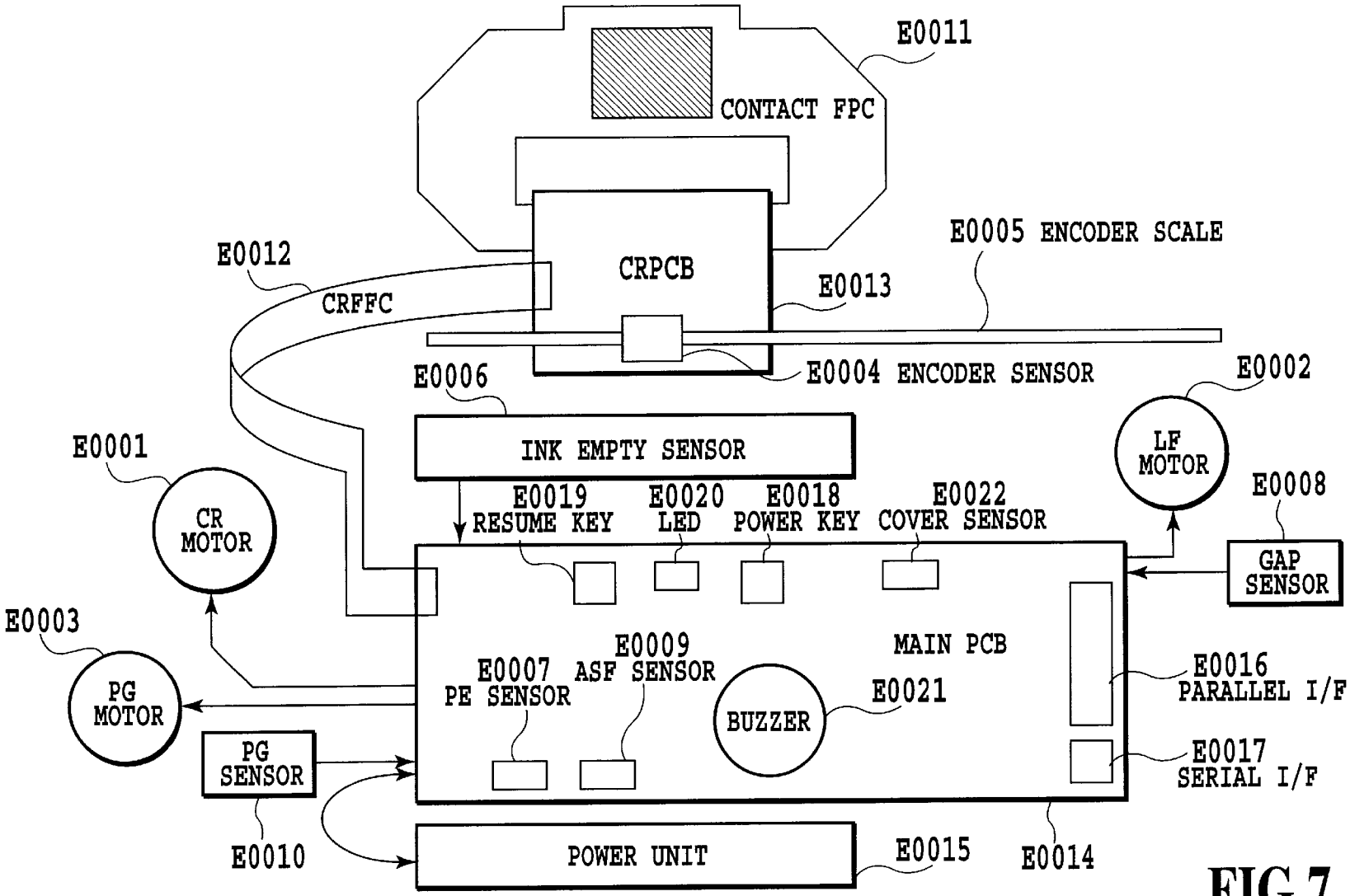
FIG. 7 is a block diagram schematically showing the overall configuration of an electric circuitry of the present invention according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
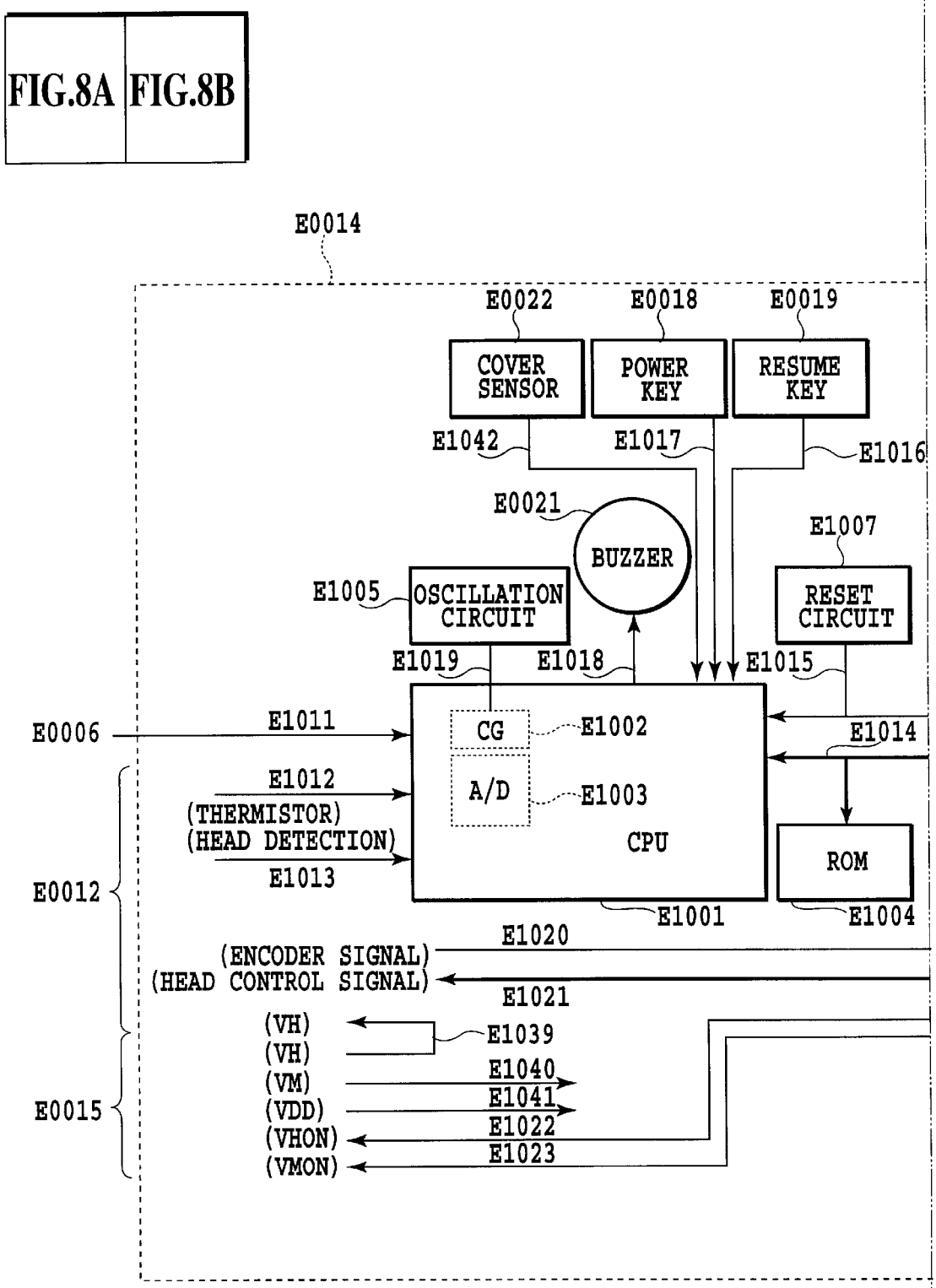
FIG. 8 is a diagram showing the relationship between FIGS. 8A and 8B.
FIGS. 8A and 8B are block diagrams representing an example of inner configuration of a main printed circuit board (PCB) in the electric circuitry shown in FIG. 7.
Figure 8B:
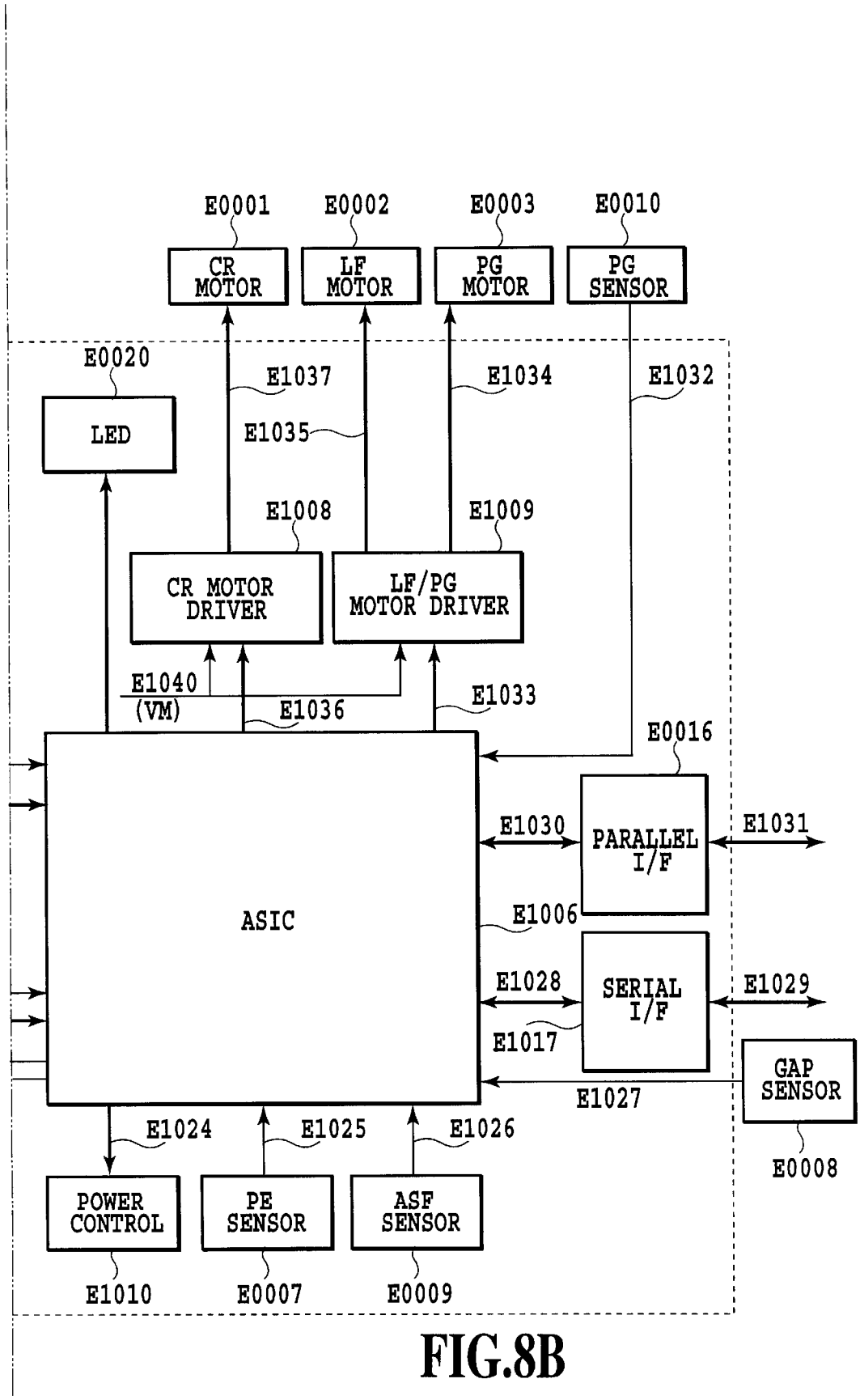

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E0010, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
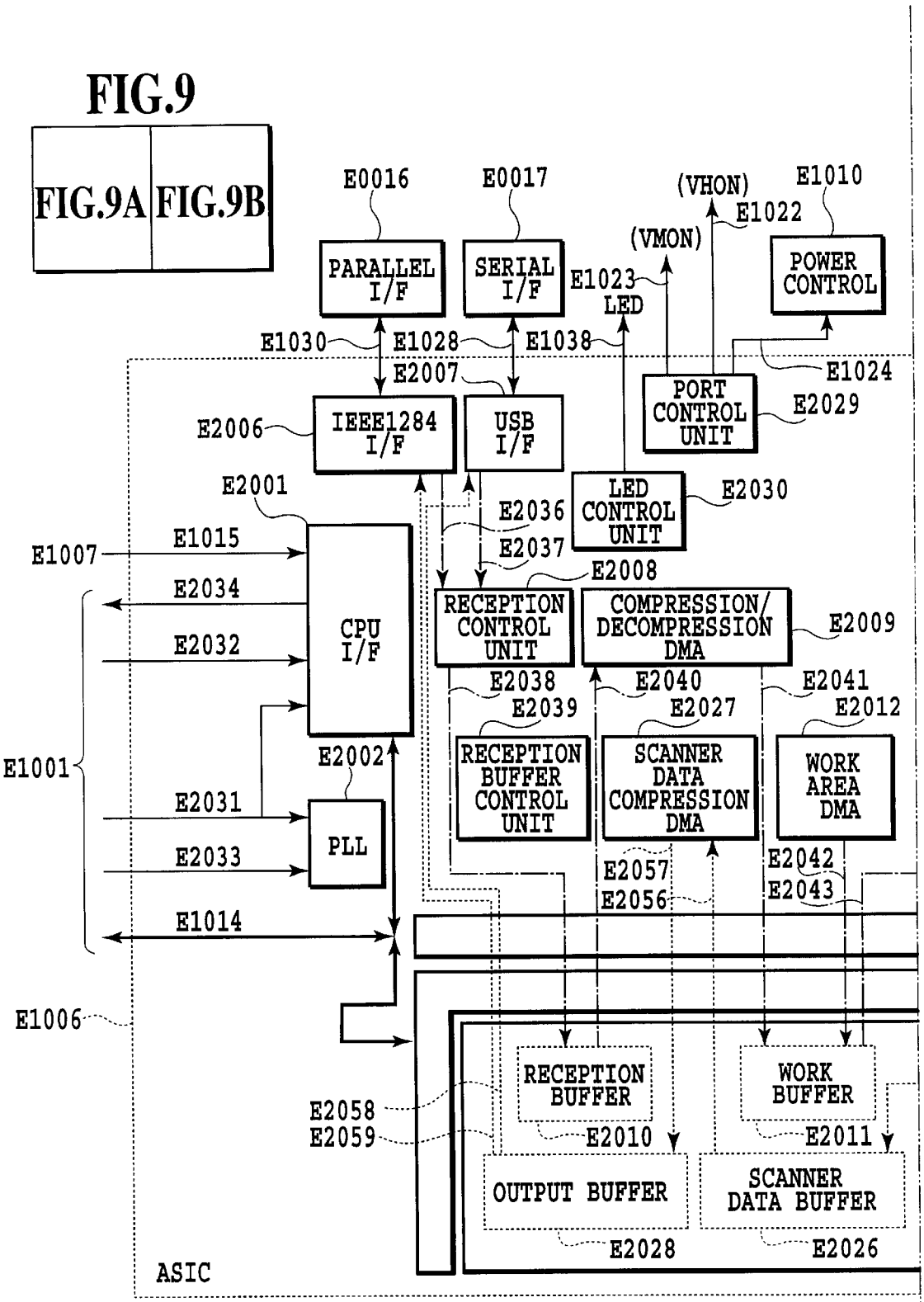
FIG. 9 is a diagram showing the relationship between FIGS. 9A and 9B.
FIGS. 9A and 9B are block diagrams representing an example of inner configuration of an application specific integrated circuit (ASIC) in the main PCB shown in FIG. 8.
Figure 9B:
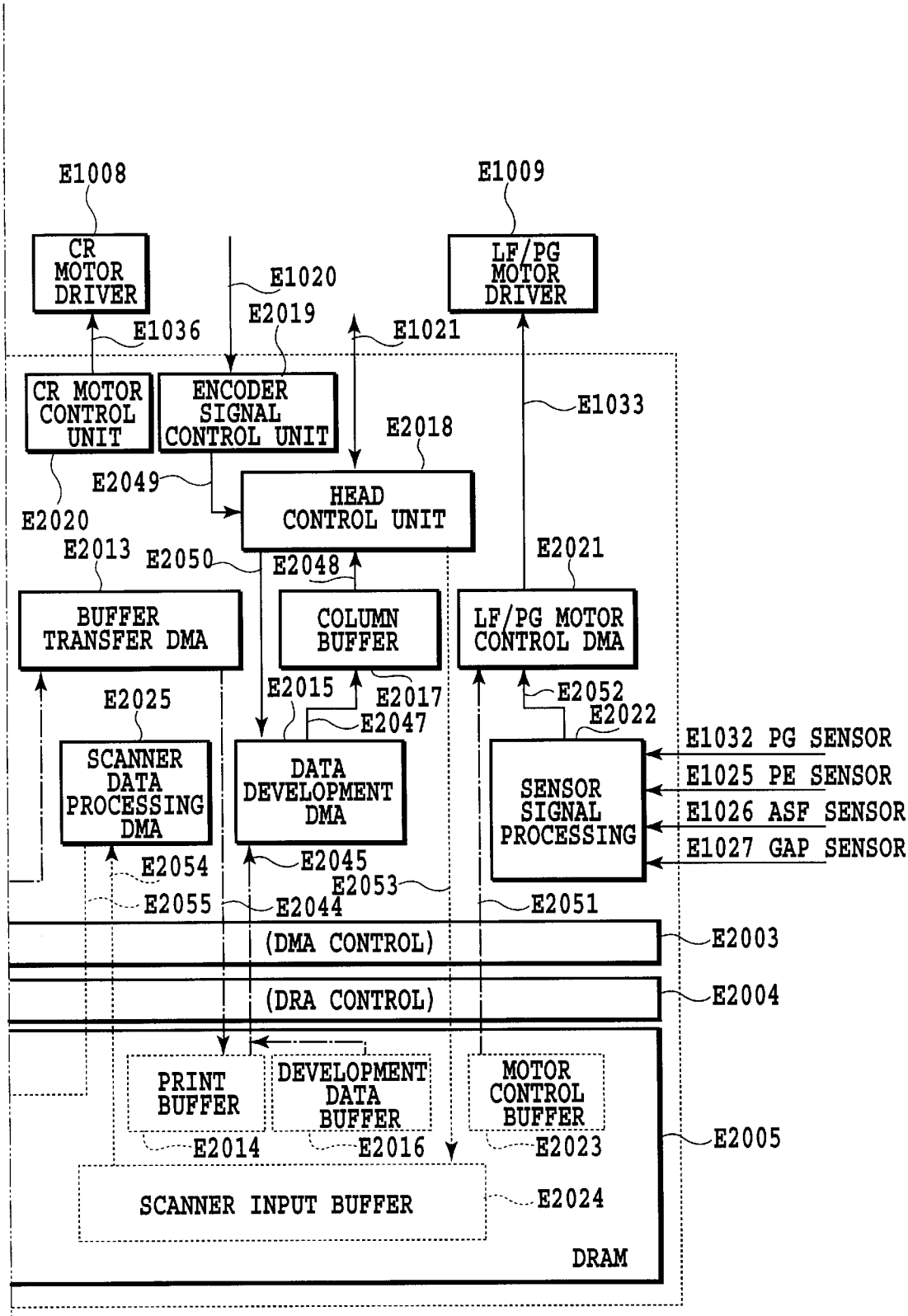

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
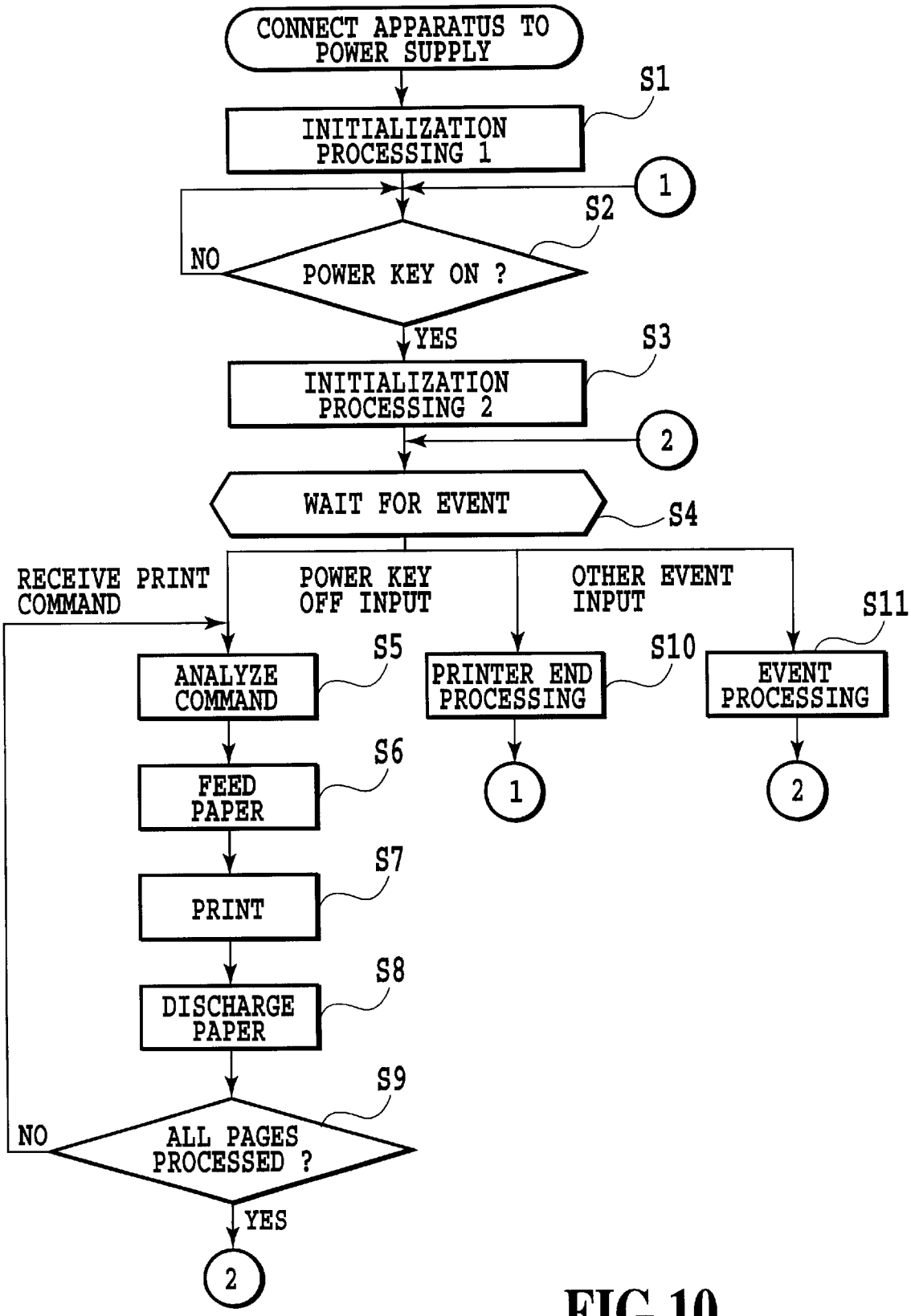
FIG. 10 is a flow chart showing an example of the operation of the printer according to one embodiment of the present invention.

Next, the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

The print head H1001 will be described in more detail below.

The print head H1001 is a so-called side shooter type jet print head of a bubble jet system carrying out the printing operation while using an electrothermal transducer for generating heat energy for film-boiling ink in accordance with electric signals.

Figure 24:
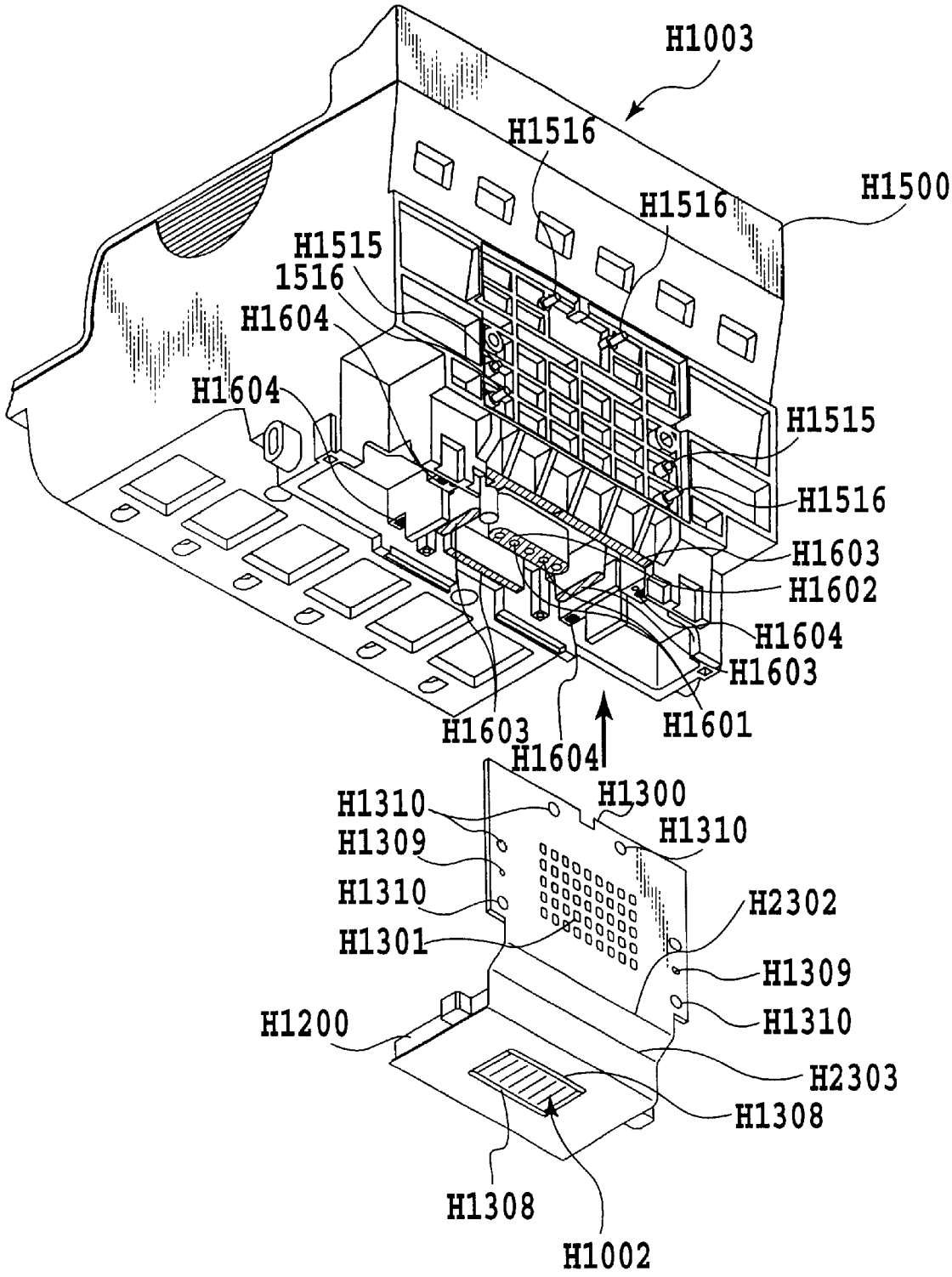
FIG. 24 is an exploded perspective view showing a print element unit in the assembled state together with a tank holder used in one embodiment according to the present invention.

As shown in an exploded perspective view of FIG. 24, the print head H1001 consists of a print element unit H1002 and a tank holder unit H1003. Further, as shown in an exploded perspective view of FIG. 25, the print element unit H1002 consists of a print element substrate H1100, a first plate H1200, an electric wiring board H1300 and a second plate H1400. On the other hand, the tank holder unit H1003 consists of a tank holder H1500, a flow passage forming member H1600, six filters H1700 and six seal rubbers H1800.

(Print Element Unit)

Figure 26:
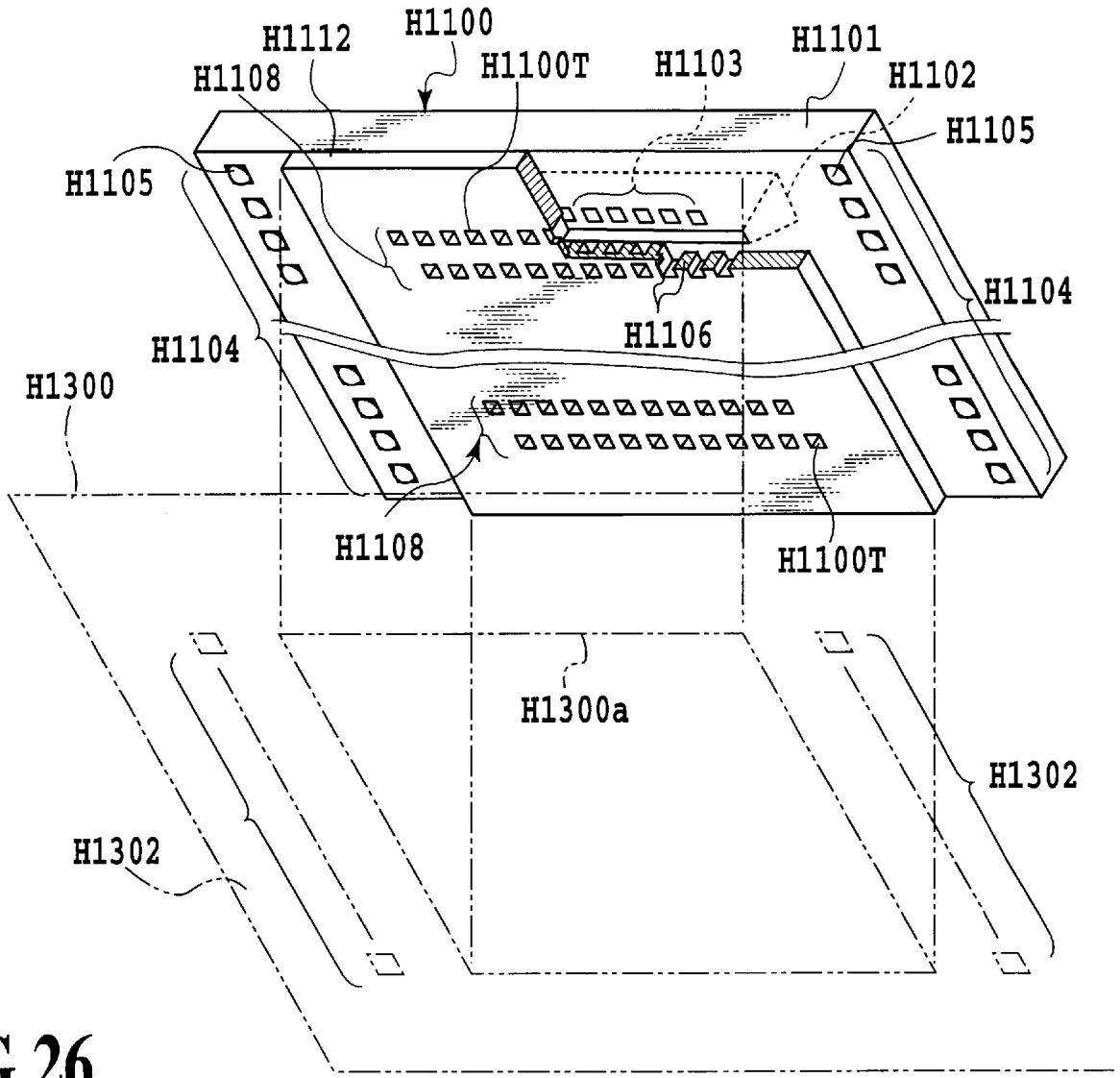
FIG. 26 is a perspective view showing a print element substrate constituting part of the respective embodiments of the liquid ejection type print head according to the present invention.

FIG. 26 is a partially exploded perspective view for explaining the constitution of the print element substrate H1100.

As described above, in the print element substrate H1100, a plurality of print elements, a plurality of ink flow passages and a plurality of ejection openings H1100T corresponding to these print elements are formed by a photo-lithographic technology, and ink supply ports open on the back surface of the substrate. The print element substrate H1100 is, for example, of a side shooter type and constituted by a single substrate. In this substrate, the plurality of ejection openings H1100T arranged in two rows in a zigzag manner are formed at approximately 1200 dpi for the individual color, and ejecting different colored ink respectively.

The print element substrate H1100 consists, for example, of an Si substrate H1101 with a thin film formed on the surface thereof and an orifice plate H1112 formed on the substrate H1101, as shown in FIG. 26.

For example, the substrate 1101 has a thickness in a range from 0.5 to 1 (mm), and six rows of ink supply ports 1102 in a form of an elongate groove-like through-hole are integrally formed in parallel to each other as flow passages for six color inks. A mutual distance between the ink supply ports H1102 adjacent to each other is, for example, about 2.5 (mm). Since the mutual distance is relatively small, it is possible to design the print head small in size. On each of opposite sides of the respective ink supply port H1102, a row of electrothermal transducer elements H1103 used as print elements for the individual colored ink are arranged in a zigzag manner relative to those in another side row, for example, at approximately 1200 dpi.

Electric wiring (not shown in FIG. 26) of aluminum or others for supplying electric power to the plurality of electrothermal transducer element H1103 provided in the substrate H1101 and to the respective electrothermal transducer elements H1103 may be formed by a film deposition technology. Also, an electrode section H1104 for supplying electric power to the electric wiring is formed along each of opposite edges defined in the direction vertical to the arrangement direction of the electrothermal transducer elements H1103. In the electrode section H1104, a plurality of bumps H1105 of gold or the like are arranged in correspondence to electrode terminals H1302 in the above-mentioned electric wiring board H1300.

The ink supply port H1102 is formed, for example, by an anisotropic etching method while using crystal face orientation of the Si substrate H1101. If the crystal face orientation is <100> along the wafer surface and <111> in the thickness direction, the etching proceeds at an angle of approximately 54.7 degrees (a rising interior angle of face being etched) by the anisotropic etching method using alkaline series (such as KOH, TMAH or hydrazine).

The ink supply port H1102 is formed by etching the substrate at a desired depth according to this method.

As shown in FIG. 26, in the orifice plate H1112 formed on the substrate H1101, an ink flow passage wall H1106 for forming the ink flow passages and the ejection openings H1100T in correspondence to the respective electrothermal transducer elements H1103 is formed by a photo-lithographic technology. Accordingly, the ejection openings 1100T adjacent to each other are partitioned by the ink flow passage wall H1106.

The six rows of ejection openings H1100T corresponding to the individual six color inks supplied from the respective ink supply ports H1102 are integrally formed in a single orifice plate H1105. The plurality of ejection openings H1100T in the respective row are arranged, for example, at approximately 1200 dpi for every individual colored ink in a zigzag manner similar to the arrangement of the electrothermal transducer elements H1103.namely, ejection openings H1100T is provided as opposed to the electrothermal transducer elements H1103.

Accordingly since the rows of electrothermal transducer elements H1103 and ejection openings H1100T are formed on the same print element substrate H1100 so that the six kinds of ink can be ejected, it is possible to design the print element substrate H1100 to be smaller in size than in the prior art wherein a row of ejection openings for the respective ink is separately provided.

Figure 31:
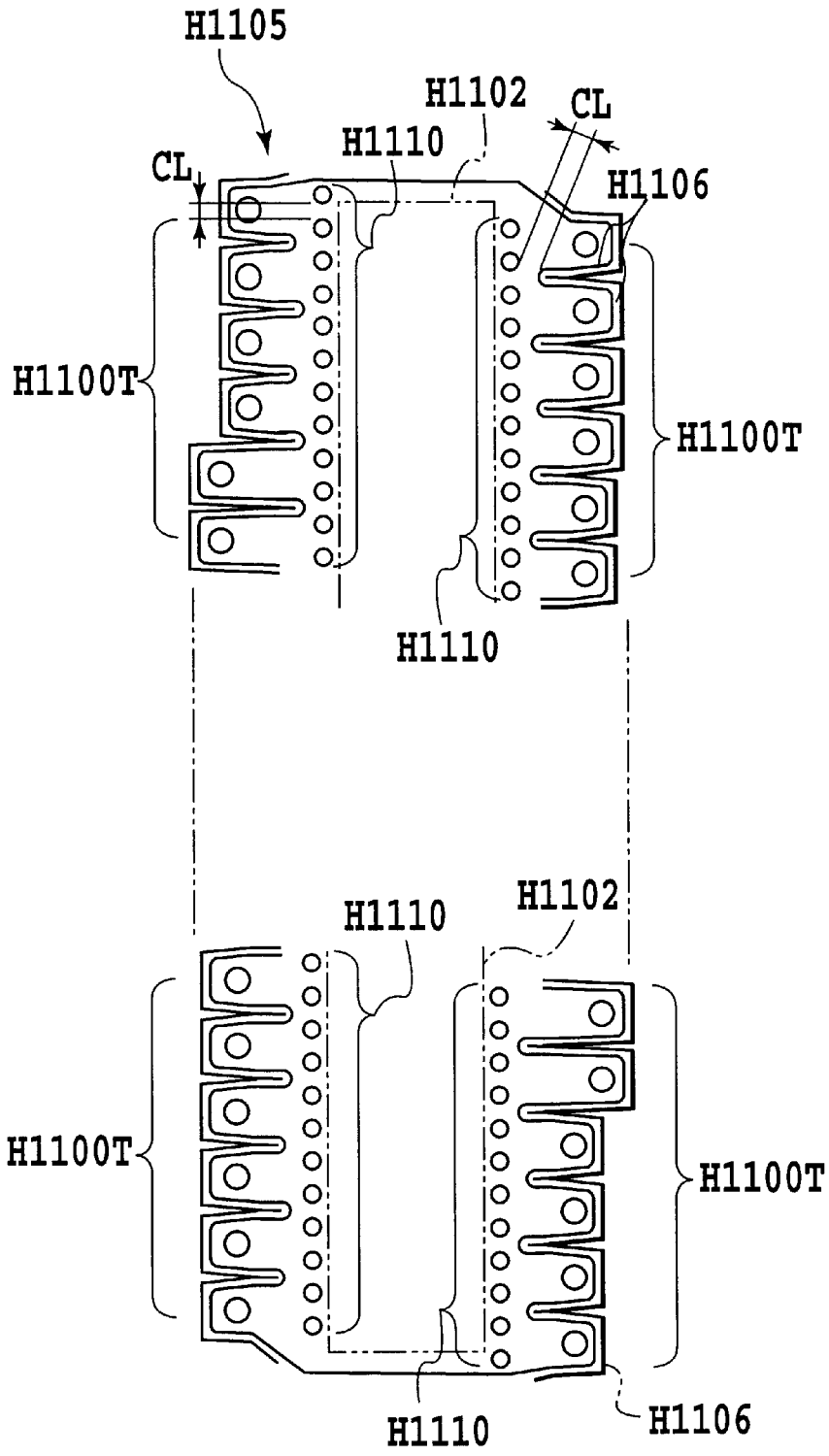
FIG. 31 is a partial sectional view showing the interior of an opening plate in the embodiment shown in FIG. 26.

As shown in FIG. 31, in the orifice plate H1105, a plurality of block pins H1110 are provided for obstructing the ingress of undesirable impurities into the row of ejection openings H1100T to collect them, such as dust or the like contained in ink supplied from the ink supply port H1102 of the substrate H1101. The block pins H1110 are arranged in the vicinity of the ink flow passage wall H1106 in the direction generally vertical to the flowing direction of ink supplied from the ink supply port H1102. Also, the block pins H1110 are arranged at a predetermined interval in parallel to the respective rows of ejection openings H1100T. For example, a distance CL between the ink flow passage wall H1106 and the block pin H1110 or a mutual distance CL between the block pins H1110 adjacent to each other is approximately 10 ($\mu$m).

Thus, since dust or the like contained in ink is caught by the block pins H1110, the dust or the like which might previously enter the print head during the assembly of the print head is prevented from blocking the row of the ejection openings H1107, otherwise the inferior printing (non-ejection or deflection) may be resulted.

Thus, according to this embodiment, since the filters H1700 excellent in preventing external dust from entering are disposed in the tank holder H1500 and a filter structure for preventing the ejection openings from being blocked is provided in the orifice plate H1105, it is possible to provide a print head with a high degree of reliability at a low-cost.

Figure 32B:
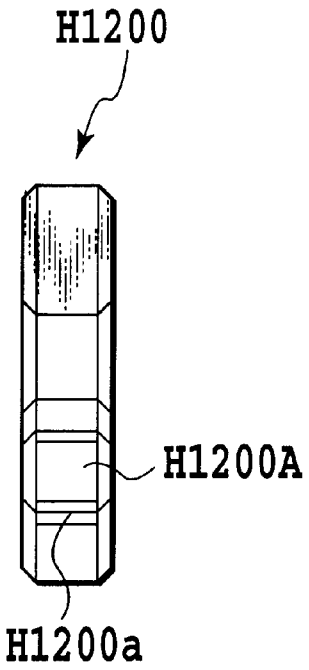
FIG. 32B is a side view of a first plate in the embodiment shown in FIG. 11.
Figure 32A:
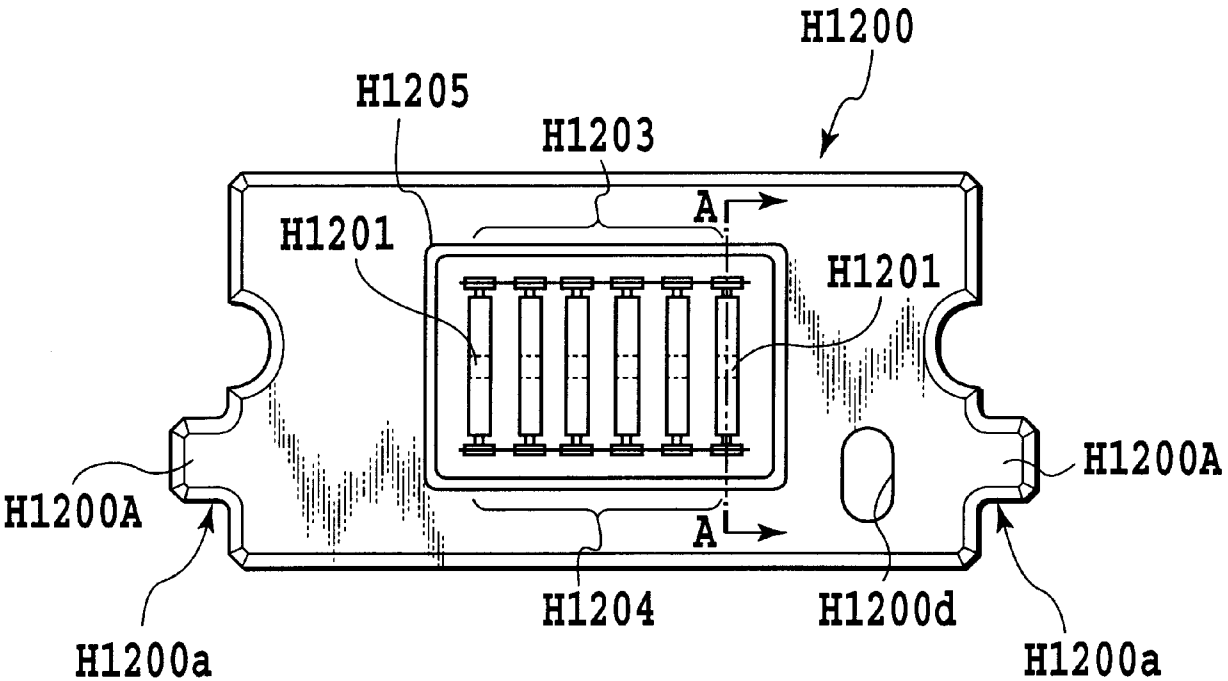
FIG. 32A is a plan view of a first plate in the embodiment shown in FIG. 11.

The first plate H1200 shown in FIGS. 32A and 32B is made, for example, of alumina ($Al_2O_3$) to have a thickness in a range from 0.5 to 10 (mm). It should be noted that material for the first plate is not limited to alumina but may be any of materials, such as a ceramic preferably, provided it has a linear thermal expansion coefficient equal to that of material for the print element substrate H1100 as well as a thermal conductivity equal to that of material for the print element substrate H1100 or more. Material for the first plate H1200 may be any one of silicon (Si), aluminum nitride (AlN), zirconia, silicon nitride ($Si_3N_4$), silicon carbide (SiC), molybdenum (Mo) and tungsten (W). The first plate H1200 is provided with six ink supply ports H1201 for supplying six colored inks to the print element substrate H1100. Six ink supply ports H1102 of the print element substrate H1100 are positioned in correspondence to the six ink supply ports H1201 of the first plate H1200, respectively, and the print element substrate H1100 is fixedly adhered to the first plate H1200 at a high positional accuracy. A first adhesive H1204 used for the adhesion is coated on the first plate H1200 generally in a shape of the print element substrate while taking care not to generate air path between the ink supply ports adjacent to each other. The first adhesive H1204 preferably has a relatively low viscosity capable of forming a thin adhesive layer on a contact surface, a relatively high hardness after being cured, and a high resistance to ink. The first adhesive H1204 is, for example, a heat-hardening adhesive mainly composed of epoxy resin, and a thickness of the adhesive layer is preferably 50 ($\mu$m) or less.

As shown in FIGS. 32A and 32B, the first plate H1200 has protrusion H1200A at opposite ends thereof, respectively. The protrusion H1200A has an engagement surface H1200*a* (hereinafter referred to as reference surface H1200*a*) as a reference surface for engaging with the above-mentioned reference end surfaces H1502*a* and 1502*b*, respectively. The protrusion H1200A extends from the lateral side of the plate generally in the vertical direction, i.e., in the moving direction of the tank holder H1500. Also, an aperture H1200*d* engageable with a tip end of a positioning pin IP of the tank holder H1500 is formed at a position corresponding to the positioning pin IP.

Figure 33A:
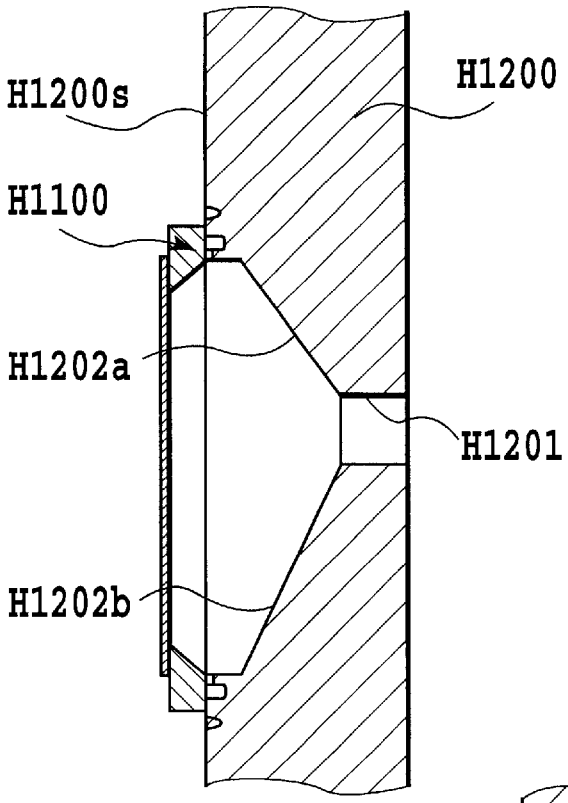
FIGS. 33A and 33B are partial sectional views, respectively, of the first plate shown in FIG. 32A.
Figure 33B:
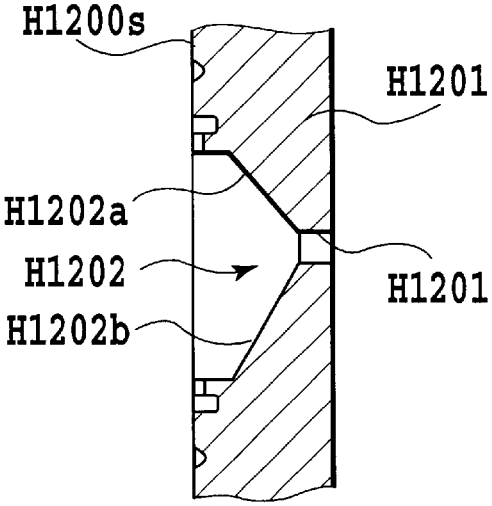

The respective ink supply port H1201 communicates with an enlarged portion H1202 defining an ink flow passage opened to an end surface H1200*s* to which is adhered the print element substrate H1100, as shown in FIG. 33B. The enlarged portion H1202 forming an elongate groove is defined by oppositely formed slants H1202*a* and H1202*b* so that the cross-sectional area enlarges as going to the end surface to which is adhered the print element substrate H1100.

Figure 33C:
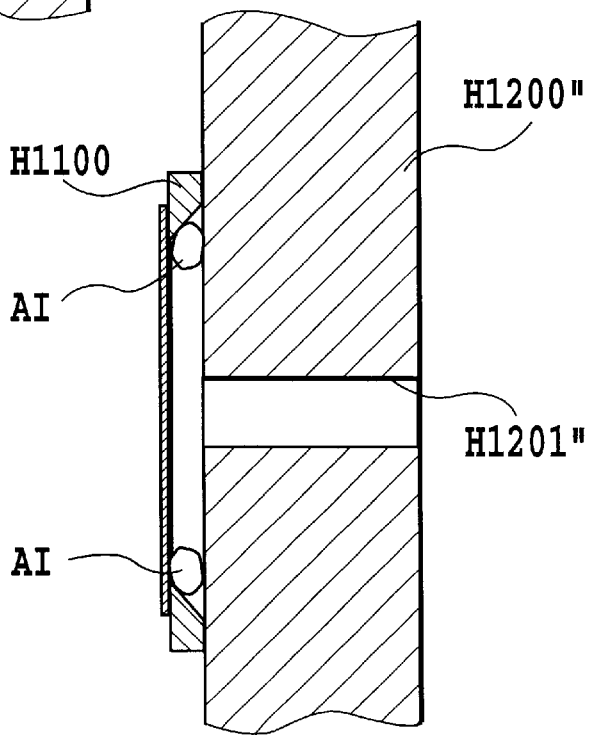
FIG. 33C is a partial sectional view for providing the explanation of the plate as a comparative example.

A reason why the enlarged portion H1202 has such a shape is as follows. For example, if an ink supply passage H1201" of a first plate H1200" is of a cylindrical tubular shape as shown in FIG. 33C, a stagnation of ink is liable to dwell at the opposite ends of the print element substrate H1100 to gather bubbles AI when ink is sucked from the print element substrate H1100 side by a recovery means not shown during the replacement of ink tank or the recovery treatment for remedying the inferior printing. Accordingly, there is a risk in that the recovery becomes insufficient to result in the inferior printing.

To solve such a drawback, the ink flow passage of the first plate 1200 is shaped in a tapered form widening toward the ink supply port provided in the print element substrate H1100 so that ink smoothly flows at the opposite ends of the print element substrate H1100 to eliminate the dwell of bubbles.

Thus it is possible to readily provide print head having a high degree of reliability without the enlargement in size and the rise in cost of the print head.

Figure 25:
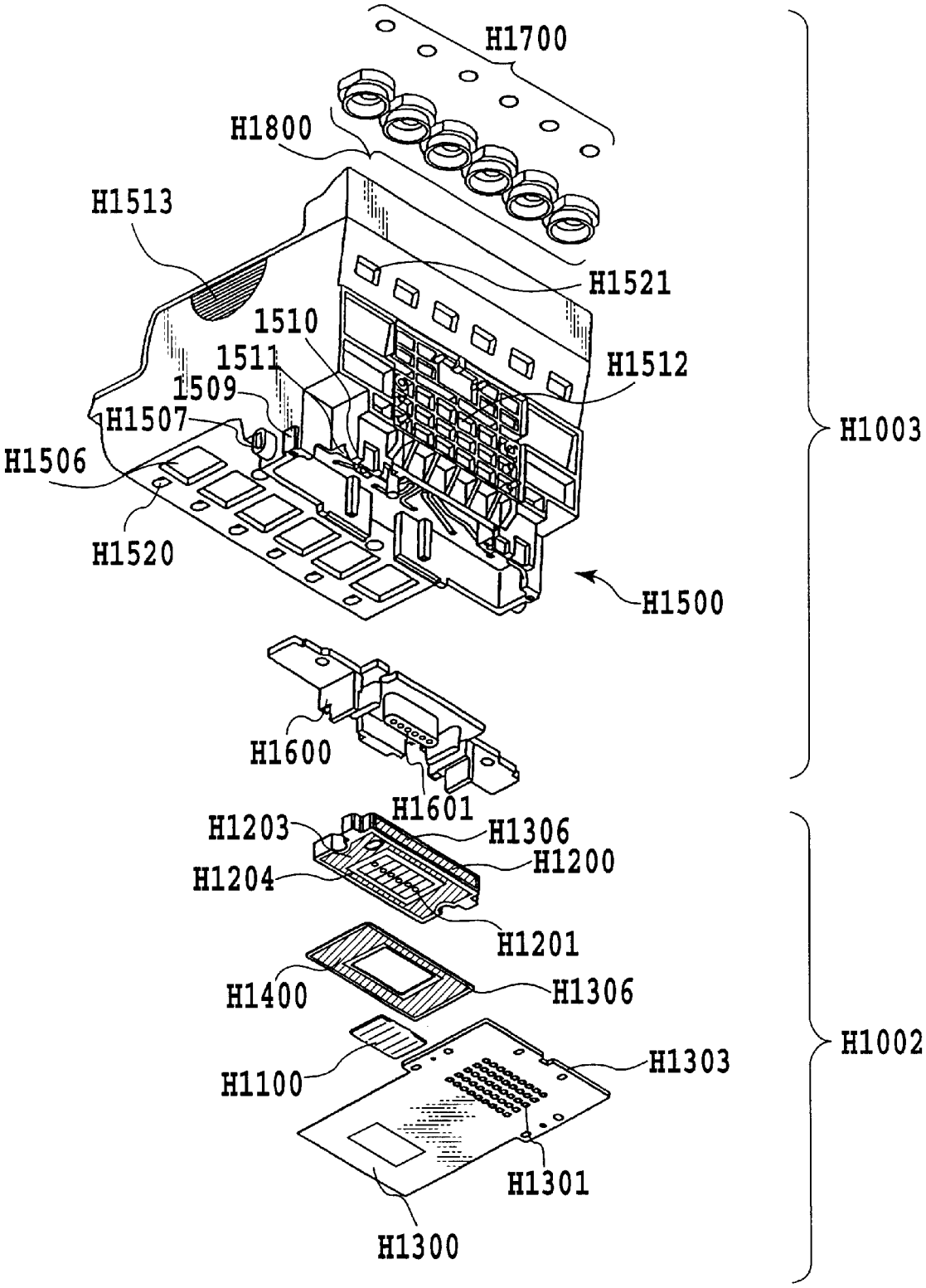
FIG. 25 is an exploded perspective view showing a print element unit and a tank holder unit used in one embodiment of the present invention.

As shown in FIGS. 25 and 26, the electric wiring board H1300 for applying electric signals to the print element substrate H1100 has an opening H1300*a* for incorporating the print element substrate H1100 thereto, electrode terminals H1302 corresponding to the electrode section H1104 of the print element substrate H1100, and external signal inputting terminals H1301 disposed in the wiring end section for receiving electric signals from a main body.

The opening H1300*a* of the electric wiring board H1300 corresponds to the print element substrate H1100 disposed on the first plate H1200 and an opening H1400*a* of the second plate H1400.

The electric wiring board H1300 and the print element substrate H1100 are electrically connected to each other. One method for the connection is, for example, in that after applied heat-hardening adhesive resin H1304 (not shown) between the electrode section H1104 of the print element substrate H1100 and the electrode terminals H1302 of the electric wiring board H1300, the electrode section H1104 of the print element substrate H1100 and the electrode terminals H1302 of the electric wiring board H1300 are heated and pressed at once by a heating tool so that the heat-hardening resin H1304 is cured to electrically connect the electrode section H1104 and the electrode terminals H1302 at once with each other. An anisotropic electroconductive adhesive containing conductive particles may be similarly used as such a heat-hardening resin H1304. In this embodiment, an anisotropic electroconductive adhesive film formed of an adhesive mainly composed of epoxy resin mixed with conductive particles of nickel having a particle size in a range from 2 to 6($\mu$m) was applied between the electrode section H1104 of the print element substrate H1100 and the gold-plated electrode terminals H1302 of the electric wiring board H1300, which were then heated under pressure at a temperature in a range from 170 to 250° C. to result in suitable electric connection.

Material of the electric wiring board H1300 may be, for example, a double-layer type flexible wiring board wherein electric circuits are formed in two layers, a surface layer of which is covered with a resist film. A reinforcement plate H1303 is adhered to the back side surface of the external signal inputting terminals H1301 to facilitate the flatness of the external signal inputting terminal section H1301. An example of material for the reinforcement plate H1303 is a heat-resistant material such as glass/epoxy resin or aluminum having a thickness in a range from 0.5 to 2 mm.

The second plate H1400 is formed, for example, of alumina ($Al_2O_3$) having a thickness in a range from 0.5 to 1 (mm). In this regard, material for the second plate should not be limited to alumina but includes those having a linear thermal expansion coefficient equivalent to that of the print element substrate H1100 and the first plate H1200 and a heat conductivity equivalent to that thereof or more. As shown in FIG. 25, the second plate H1400 has an opening having a size larger than an outer size of the print element substrate H1100 fixedly adhered to the first plate H1200. Also, the second plate H1400 is adhered to the first plate H1200 via a second adhesive H1203 so that the print element substrate H1100 and the electric wiring board H1300 are electrically connectable to each other in a flat manner. On the other hand, the back side surface of the electric wiring board H1300 is also fixedly adhered to the second plate H1400 with a third adhesive H1306. The electric wiring board H1300 is not only adhered to the second plate H1400 as described above but also bent along one side of the first plate H1200 and the second plate H1400 to be adhered to the side of the first plate H1200 with the third adhesive H1306. The second adhesive H1203 preferably has a relatively low viscosity capable of forming a thin adhesive layer on a contact surface and a resistance to ink. While, the third adhesive H1306 is, for example, a heat-hardening adhesive mainly composed of epoxy resin forming a layer of a thickness in a range from 10 to 100 ($\mu$m).

The electrically connected portion between the print element substrate H1100 and the electric wiring board H1300 of the print element unit H1002 constituted as described above is sealed with a first sealant (not shown) and a second sealant H1308 to protect the electrically connected portion from corrosion due to ink and/or external shock. The first sealant mainly seals the outer periphery of the print element substrate H1100 and the second sealant seals the edge of the opening of the electric wiring board H1300. The bending electric wiring board H1300 is further formed in conformity with a back side configuration of the tank holder H1500.

(Tank Holder Unit)

Figure 30:
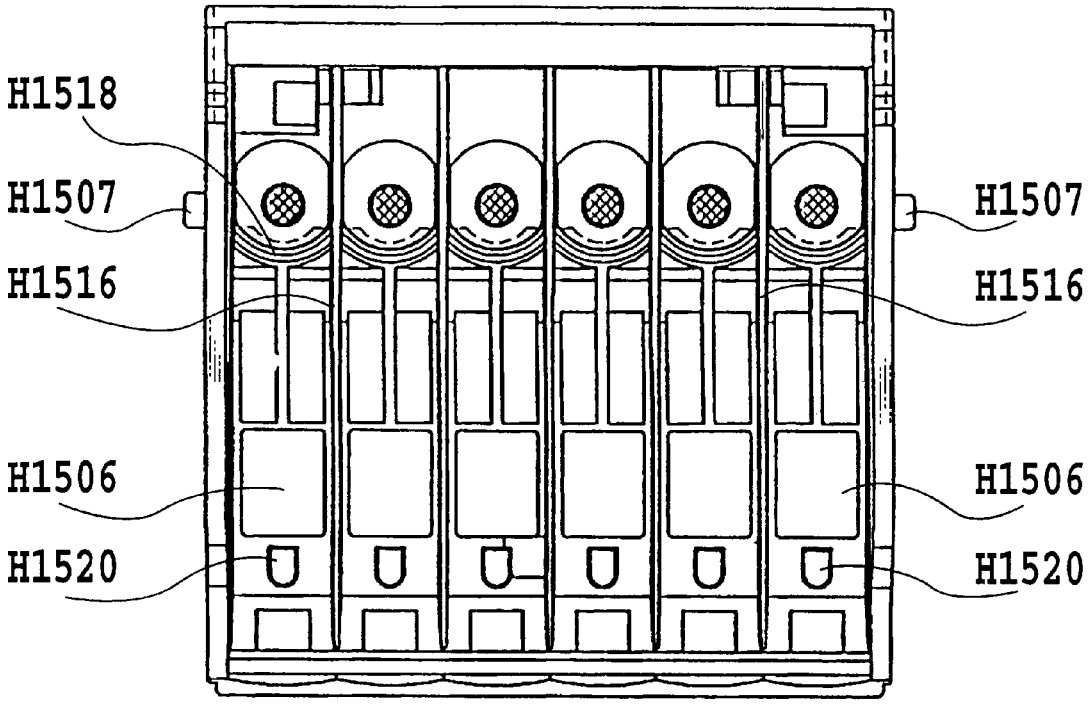
FIG. 30 is a plan view of the ink tank holder shown in FIG. 29.

The tank holder H1500 is formed, for example, by a resin molding. The resinous material therefor is preferably mixed with glass fiber filler in a range from 5 to 40% for the purpose of improving the shape rigidity. The tank holder H1500 is to hold removable ink tanks H1900 and, as shown in FIG. 25, has tank-positioning holes H1520, first holes (not shown), second holes (not shown) and third holes H1521 which are engaged with tank-positioning pins H1911, first hooks H1909, second hooks H1910 and third hooks H1911, respectively, of the ink tanks H1900 shown in FIG. 27 and openings H1506 for prisms H1913 used for detecting an amount of remaining ink. The tank holder H1500 is also provided with a mounting guide H1507 for guiding the print head cartridge H1000 to a mounting position in the carriage M4001 of a main body of the ink jet printing apparatus, an engagement section H1508 (FIG. 27) for mounting the print head cartridge into the carriage by a head set lever, and an X-abutment H1509, a Y-abutment H1510 and a Z-abutment H1511 for positioning the tank holder at a predetermined mounting position. The tank holder H1500 has a terminal fixing section H1512 for fixedly positioning the external signal inputting terminals H1301 of the print element unit H1002. Since a plurality of ribs are provided in the terminal fixing section H1512 and the periphery thereof, the rigidity of the surface having the terminal fixing section H1512 is enhanced. Between adjacent cells in which the respective ink tanks H1900 are mounted, a rib H1516 (FIG. 30) is provided for preventing the colors from mixing with each other. On each of opposite sides of the tank holder H1500 is provided with a handhold H1513 (FIG. 25) for enhancing the handling of the print head H1001.

Figure 28:
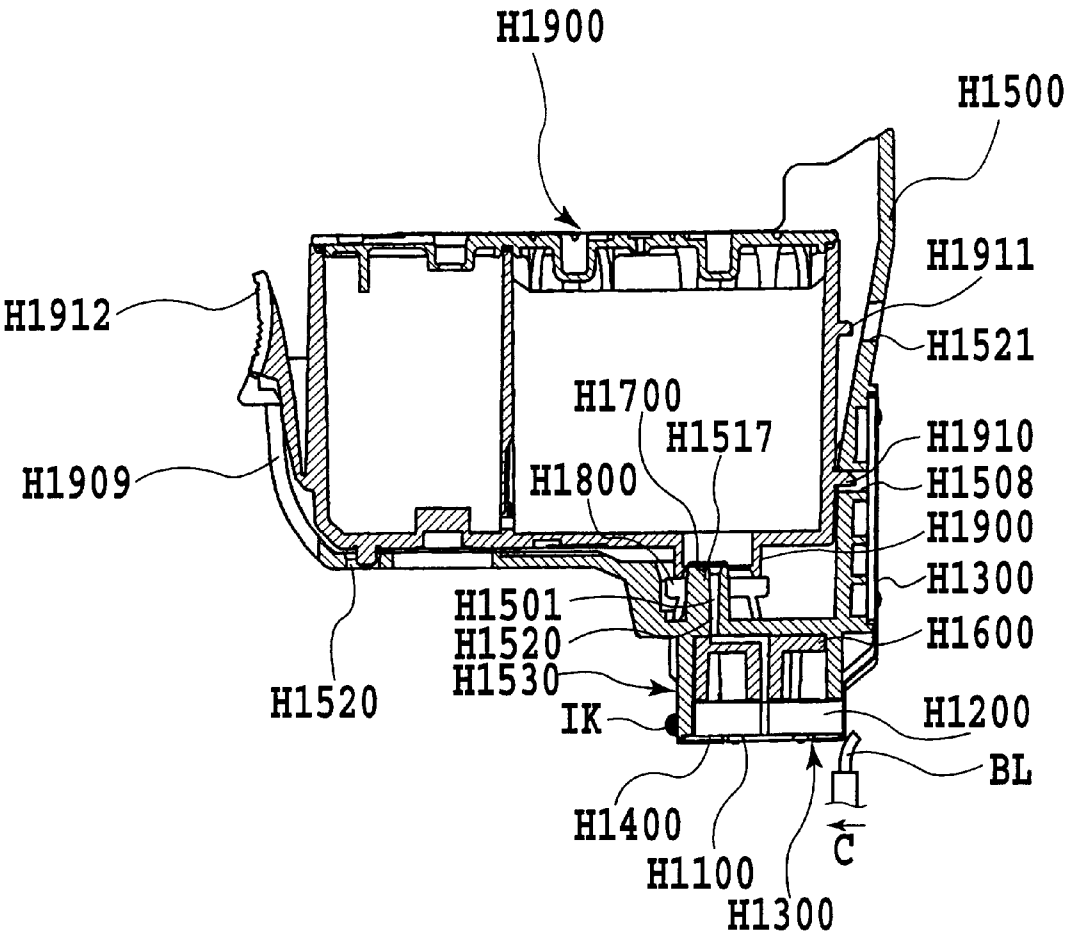
FIG. 28 is a sectional view showing a state wherein the ink tank shown in FIG. 27 is mounted into the tank holder.

As shown in FIG. 28, the tank holder H1500 is one of components for constituting a tank holder unit H1003 forming the ink flow passage H1501 for guiding ink from the ink tank H1900 to the print element unit H1002. The ink flow passage H1501 is formed by attaching the flow passage forming member H1600 to the tank holder H1500 by an ultrasonic welding. The filter H1700 for preventing external dust from entering is attached to a joint H1517 engaged with the ink tank H1900 by a heat bonding. Further, to prevent ink from evaporating through the joint H1517, a seal rubber H1800 is attached. The filter H1700 is made, for example, of sintered stainless fibers to have a pore size of 10 ($\mu$m) or less and fixed to the joint section H1517 by a heat bonding after being formed to have a dome shape. Preferably, the dome has such a radius of curvature that a height of convex is approximately in a range from 0.1 to 0.5 (mm). By providing such a filter H1700, the ingress of external dust is effectively prevented, and the connection between the respective joint sections H1517 and the ink tank H1900 gets also better.

Figure 29:
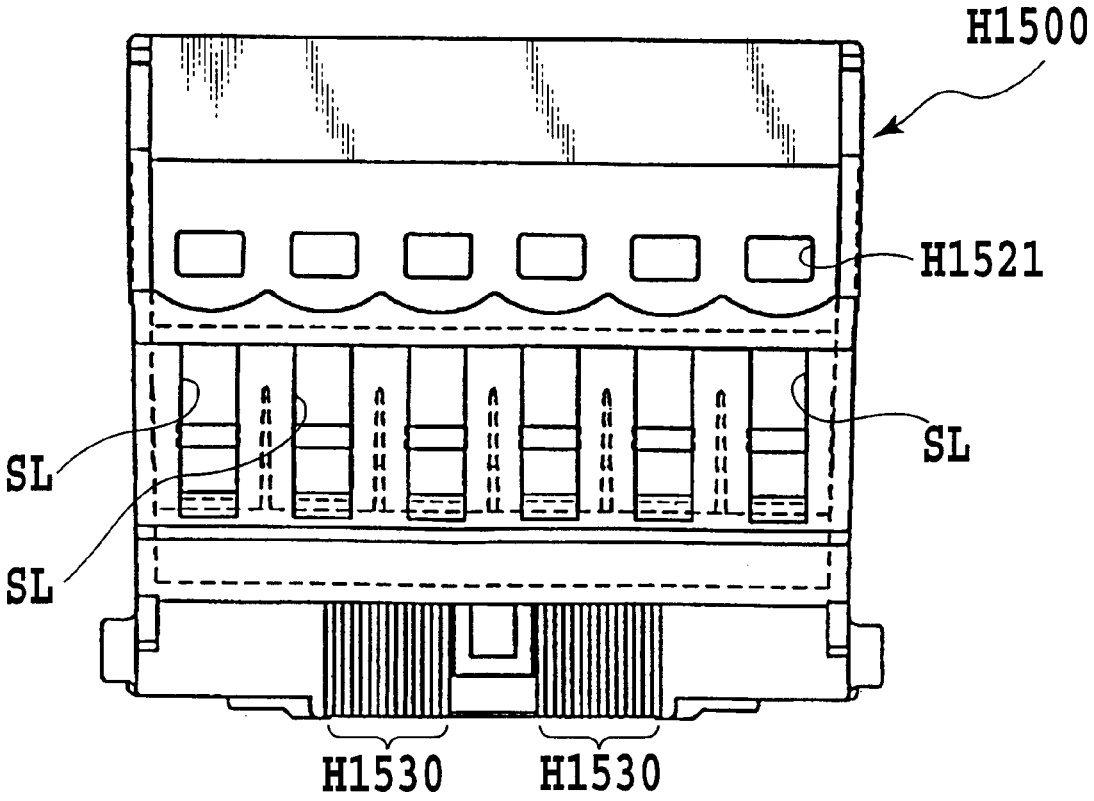
FIG. 29 is a front view of an ink tank holder constituting part of the respective embodiments of the liquid ejection type print head according to the present invention.

As shown in FIG. 29, a plurality of slits SL are formed in a front area of the tank holder H1500 in correspondence to ink accommodating sections. In a generally middle region of a lower end of the tank holder H1500 beneath them, two or more groups of vertical grooves H1530 forming a corrugated surface are provided.

The vertical groove H1530 in the corrugated surface each has a width of 1 (mm), a depth of 0.2 (mm), and 14 grooves are arranged at a pitch of 2 (mm). It should be noted that the width, depth, number and shape of groove may be optionally selected provided the grooves generate a capillary attraction sufficient for retaining ink IK collected on the lower end surface thereof as shown in FIG. 28 during the wiping operation.

Accordingly for example, as shown in FIG. 28, when the wiping operation is repeatedly carried out by advancing a cleaning blade BL for cleaning the ink ejection opening forming surface from a bending side (a back side) of the electric wiring board H1300 to the front area, ink IK may be collected to the lower end surface thereof by the blade BL. In such a case, there may be a risk in that the ink IK drops to contaminate a print paper positioned beneath the same.

However, since the vertical grooves H1530 are provided on the end surface, the collected ink Ik is held by the capillary attraction thereof to prevent from dropping onto the printing paper to contaminate the printing paper and deteriorate the print quality.

Figure 11:
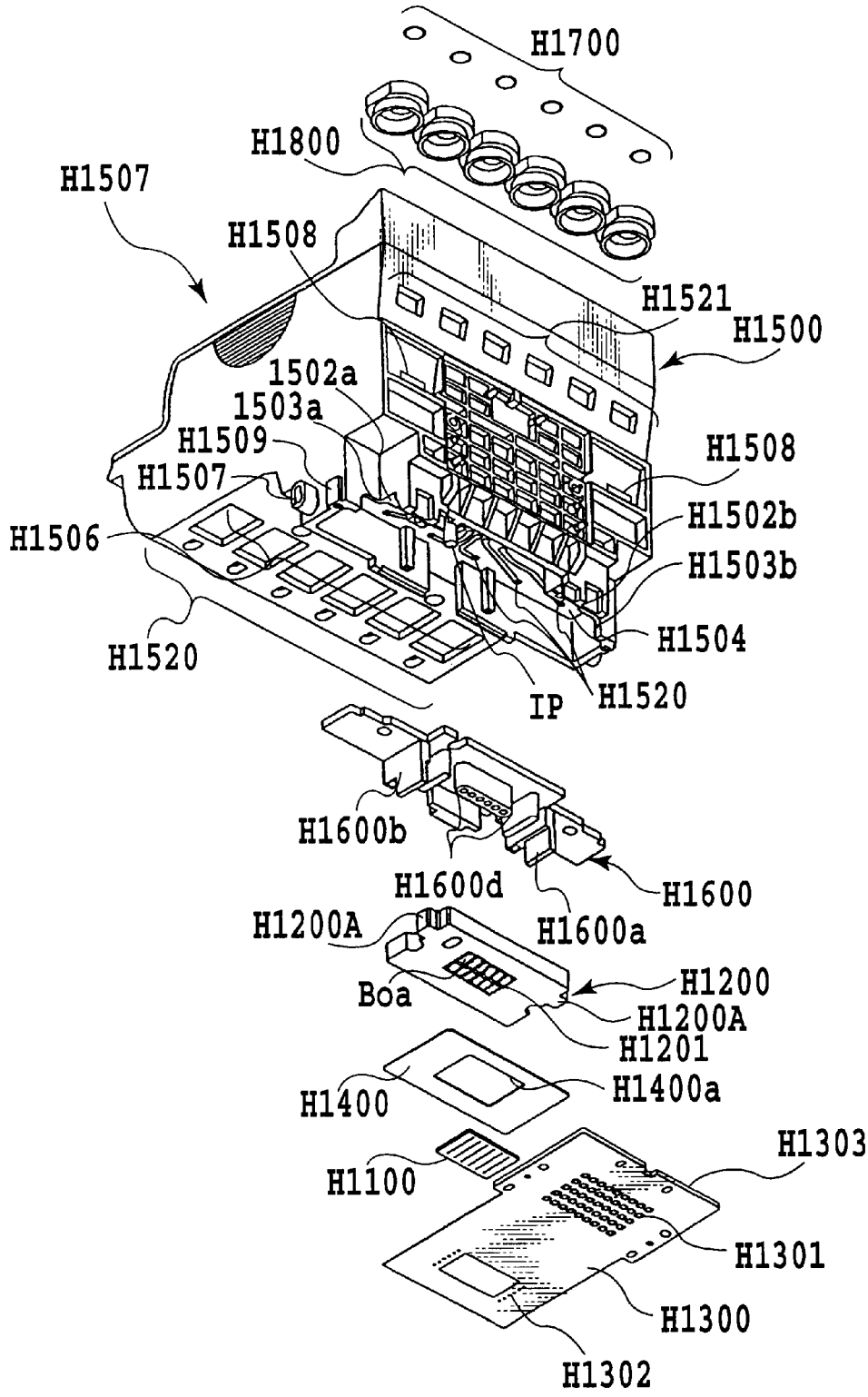
FIG. 11 is an exploded perspective view of the print head shown in FIG. 4 as seen obliquely from below.

In the tank holder H1500, groove-like ink flow passages H1521, one ends of which communicate with the above-mentioned ink supply port H1520 and the other ends of which are formed in correspondence to open ends of the flow passage forming member H1600, are provided in a portion into which the flow passage forming member H1600 is inserted and fixed, in correspondence to the respective ink tanks H1900 as shown in FIG. 11. Thus, a mutual distance between the other ends of the ink flow passages H1521 adjacent to each other becomes smaller than that of the one ends so that the other ends of the ink flow passage H1521 are converged to correspond to the open ends of the ink flow passages of the flow passage forming member H1600. By bonding the contact surface of the flow passage forming member H1600 with the fixing portion on the tank holder H1500, the ink flow passages for supplying ink from the respective ink tank H1900 to the respective ink flow passages of the flow passage forming member H1600 are formed.

In the portion into which is inserted and fixed the flow passage forming member H1600, the upright positioning pin IP engageable with the flow passage forming member H1600 and the first plate H1200 is provided.

(Coupling of Print Head Unit with Tank Holder Unit)

As shown in FIG. 24, the print head H1001 is completed by coupling the print element unit H1002 with the tank holder unit H1003. The coupling is carried out as follows:

A fourth adhesive H1602 is applied to fixedly adhere the first plate H1200 and the flow passage forming member H1600 with each other while communicating the ink supply port of the print element unit H1002 (ink supply port H1201 of the first plate H1200) with the ink supply port of the tank holder unit H1003 (ink supply port H1601 of the flow passage forming member H1600). Besides the ink supply port portion, several portions of the print element unit H1002 in contact with the tank holder unit H1003 are fixedly adhered via a fifth adhesive H1603. The fourth adhesive H1602 and the fifth adhesive H1603 are preferably ink-resistant, curable at a normal temperature and has a flexibility durable against the difference in linear thermal expansion between different kinds of material. For example, a moisture curable silicone adhesive is favorably used in this embodiment. Also, the fourth adhesive resin H1602 and the fifth adhesive resin may be identical to each other. When the print element unit H1002 is adhered to the tank holder unit H1003 with the fourth adhesive H1602 and the fifth adhesive H1603, the print element unit H1002 is fixedly positioned by a sixth adhesive H1604 coated on the flow passage forming member H1600. The sixth adhesive H1604 is preferably an instantly curable adhesive. Although an ultraviolet curing adhesive is used in this embodiment, other types of adhesives may be used.

The external signal inputting terminal section H1301 of the print element unit H1002 is positioned on one side of the tank holder H1500 by terminal positioning pins H1515 (two positions) and terminal positioning holes H1309 (two positions) and fixed thereon. Fixing is carried out, for example, by fitting terminal coupling pins H1516 (six positions) provided in the tank holder H1500 into terminal coupling holes H1310 (six positions) provided in the periphery of the external signal inputting terminals H1301, and hot-welding the terminal coupling pins H1515. Other fixing means may be adopted.

(Explanation of Print Head Cartridge)

Figure 27:
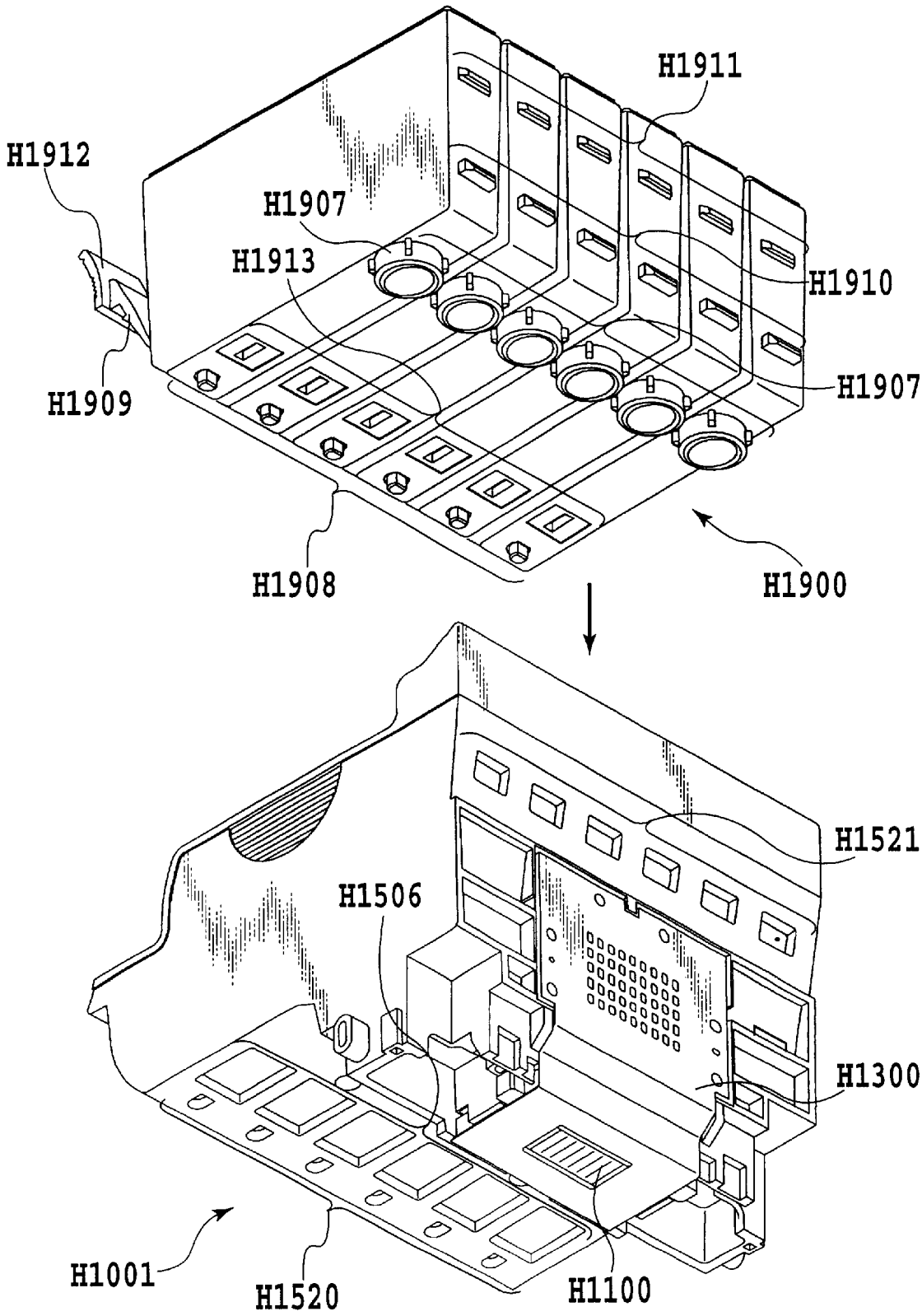
FIG. 27 is a perspective view showing an ink tank together with a print head used in one embodiment of the present invention.

FIG. 27 described before is a view for explaining how the ink tanks H1900 and the print head H1001 constituting the print head cartridge H1000 are mounted to each other, wherein inks of different colors or different color densities are respectively stored in the ink tanks H1900 in correspondence to the ink supply ports H1201 of the print head H1001. An ink supply port H1907 is formed in the respective ink tank, for supplying ink contained in the ink tank to the print head H1001. In a state wherein the ink tanks H1900 is mounted to the print head H1001, black ink, for example, in the ink tank H1900 is supplied to the print head H1001 through the ink supply port 1907.

The ink tanks H1900 inserted into the tank holder H1500 of the print head H1001 in the direction of the arrow shown in FIG. 27 and mounted thereto are independently attachable and detachable. The ink tanks H1900 contain black, light cyan, light magenta, cyan, magenta and yellow inks, respectively.

The respective ink tank H1900 is provided on one end surface with a movable lever H1912 operative during the attachment/detachment and a hook portion H1909 formed in integral with the movable lever H1912 and selectively engageable with the tank holder H1500. On the other end surface opposite to the one end surface, hook portions H1911 and H1910 engageable with the holes H1521 and H1508 of the tank holder H1500 when mounted are formed respectively.

On the bottom of the respective ink tank H1900, the ink supply port H1907 to be connected to each joint portion H1517 of the tank holder H1500 is provided. Thus, the respective ink is supplied to each communication passage H1600*d* of the flow passage forming member H1600 via the joint portion H1517.

Also, on the same bottom, a prism H1913 to which a light beam is irradiated from a detector for detecting an amount of ink remaining in the ink tank H1900 is provided. Further, a positioning pin H1908 is formed adjacent to the prism H1913.

FIG. 28 described before is a sectional view of the print head cartridge H1000. As shown in FIG. 28, the print element substrate H1100 is provided in one end region of the bottom surface of the box-like print head H1001. In the print head H1001 is provided the joint portion H1517 as described before, in the interior of the joint portion H1517 which is formed the ink flow passage H1501 extending toward the print element substrate H1100. The flow of ink in the print head cartridge will be explained with reference to the ink tank H1900 for black ink. Ink in the ink tank H1900 is supplied to the print head H1001 through the ink supply port H1907 of the ink tank H1900 and the joint portion H1517. The ink supplied to the interior of the print head H1001 is fed to the first plate H1200 via the ink flow passage H1501, and further to the ink supply port H1102 (FIG. 26) of the print element substrate H1100 from the first plate H1200. Then, the ink is supplied to a expanding chamber having the electrothermal transducer element H1103 and the ejection opening H1100T. The ink supplied to the expanding chamber is ejected to the printing paper as printing medium through the respective ejection opening H1100T by a heat energy imparted to the electrothermal transducer element H1103.

Figure 16:
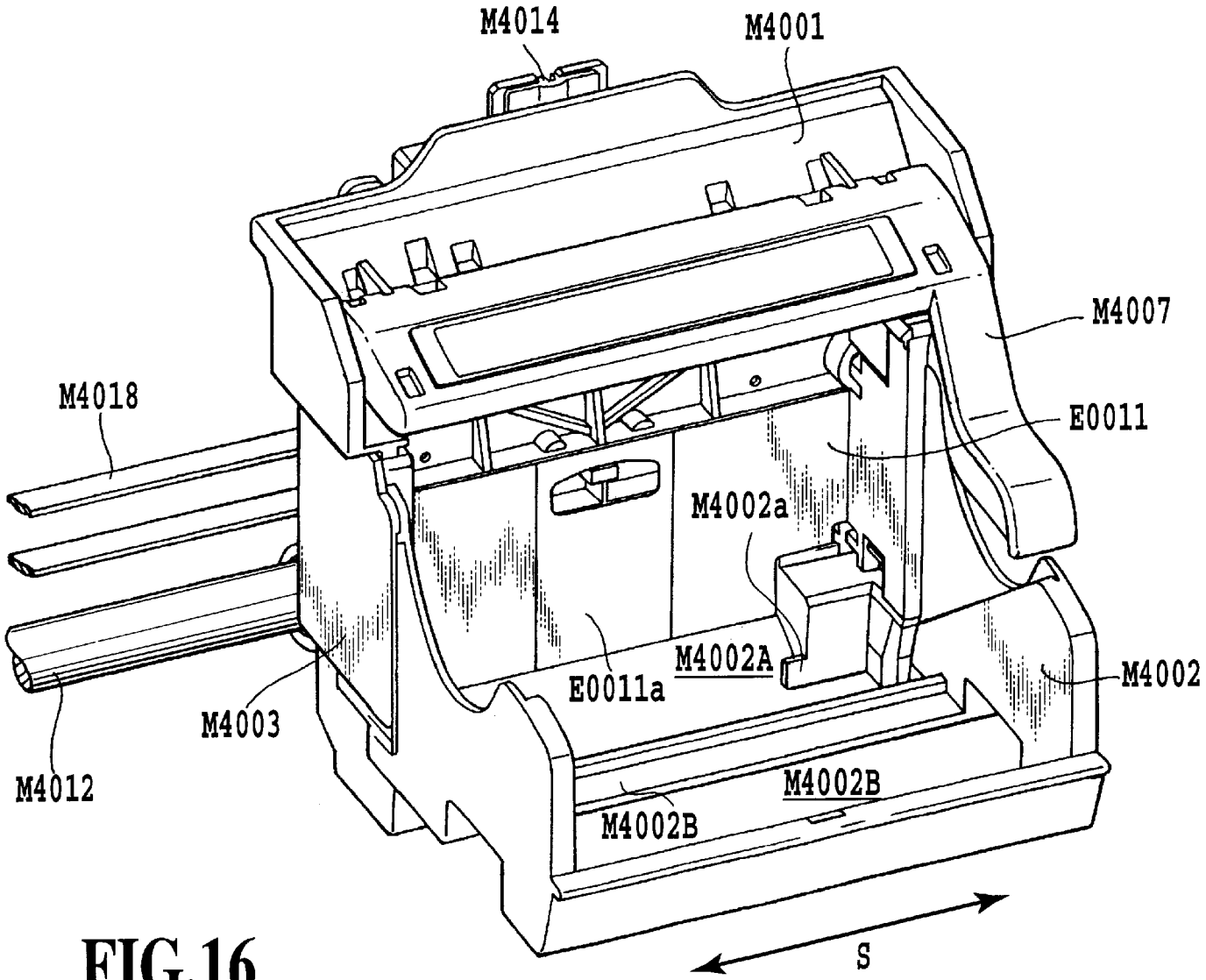
FIG. 16 is a perspective view showing a carriage for the ink jet printer as one example of a printing apparatus provided with a liquid ejection type print head according to the present invention.

FIG. 16 is a perspective view showing, in an enlarged manner, a carriage M4001 and the periphery thereof in one embodiment of a printing apparatus having a liquid ejection type print head according to the present invention.

The carriage M4001 is adapted to reciprocate in the direction of the arrow S while being guided by a carriage shaft M4012 extending between opposite sides of a chassis M3019 and a carriage rail (not shown), and in a bearing section of the carriage shaft M4012 in the carriage M4001, a pair of carriage bearings made of sintered metal impregnated with lubricant such as oil are integrally formed by an insert molding or the like. Further, in a contacting portion of the carriage M4001 with the carriage rail, a carriage slider (CR slider) M4014 which is an abutment member made of resin or the like excellent in slidability and resistance to wear is provided so that the carriage M4001 is capable of smoothly scanning in cooperation with the above-mentioned bearing section.

The carriage M4001 is fixedly secured to a carriage belt M4018 tensed between an idler pulley and a carriage motor pulley generally in parallel to the carriage shaft M4012.with a rotation of carriage motor pulley by driving the carriage motor, the carriage belt M4018 is movable forward or backward to cause the carriage M4001 to scan along the carriage shaft M4012. Although the carriage motor pulley is retained at a constant position by the chassis, the idler pulley is movably held together with the pulley holder M4021 (see FIG. 2) relative to the chassis M3019 and biased by a spring in the direction away from the carriage motor pulley, whereby the carriage belt M4018 is always imparted with a suitable tension so that a non-slackened state is favorably maintained.

At a point where the carriage belt M4018 is attached to the carriage M4001, a carriage belt fastener is provided to securely attach the carriage belt M4018 to the carriage M4001.

In the carriage M4001, a carriage cover M4002 engaged with the carriage M4001, for guiding the print head H1001 to a mounting position of the carriage M4001 and a head set lever M4007 engaged with the tank holder H1500 of the print head H1001, for pushing the print head H1001 to set it at predetermined mounting position.

That is, the head set lever M4007 is provided in the upper portion of the carriage M4001 to be rotatable relative to the head set lever shaft (not shown in FIG. 16), and in a portion of the head set lever M4007 engaged with the print head H1001, a head set plate not shown is provided via a spring so that the print head H1001 is mounted to the carriage M4001 while being pressed by this spring force.

A contact flexible print cable (hereinafter referred to as a contact FPC) E0011 is provided in another engagement portion of the carriage M4001 with the print head H1001, and a contact section E0011*a* on the contact FPC E0011 is electrically brought into contact with a contact section (external signal inputting terminal) H1301 provided on the print head H1001 to carry out the output/input of various information for printing or the supply of electric power to the print head H1001.

In this regard, an elastic member such as rubber not shown is provided between the contact section of the contact FPC E0011 and the carriage M4001. Due to the elastic force of the elastic member and the pressure of the spring of the head set lever, a reliable contact between the contact section and the carriage M4001 can be guaranteed. In addition, the contact FPC E0011 is drawn out to the opposite side portions of the carriage M4001, so that opposite ends thereof are nippingly secured on both sides of the carriage M4001 by a pair of FPC pressers M4003. The contact FPC E0011 is connected to a carriage substrate (not shown in FIG. 16) mounted onto a back surface of the carriage M4001.

An opening M4002A and an opening M4002B for communicating the interior of the carriage M4001 with lower outside are formed in the bottom of the carriage M4001 by dividing the same by a coupling member M4002B for connecting opposite side portions with each other.

Figure 12:
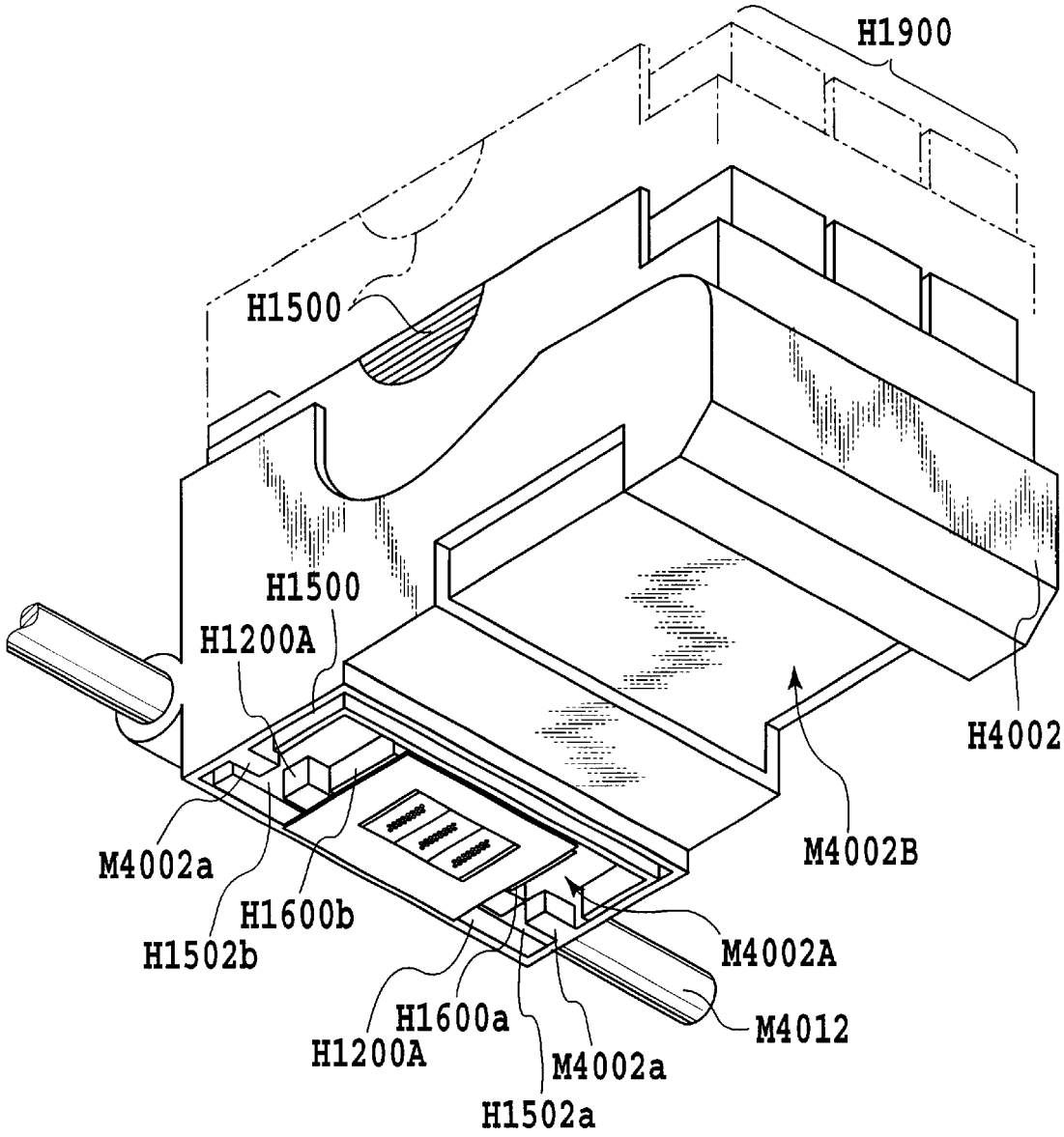
FIG. 12 is a perspective view showing a first embodiment of a liquid ejection type print head according to the present invention together with part of a printing apparatus to which the same is applied.

As shown in FIG. 12, engagement sections M4002*a* are formed opposite to each other on the periphery of the opening M4002A. The engagement section M4002*a* has a pair of engagement surfaces used as reference surfaces to which reference end surfaces H1502*a* and H1502*b* of the tank holder H1500 are removably engageable.

Figure 14:
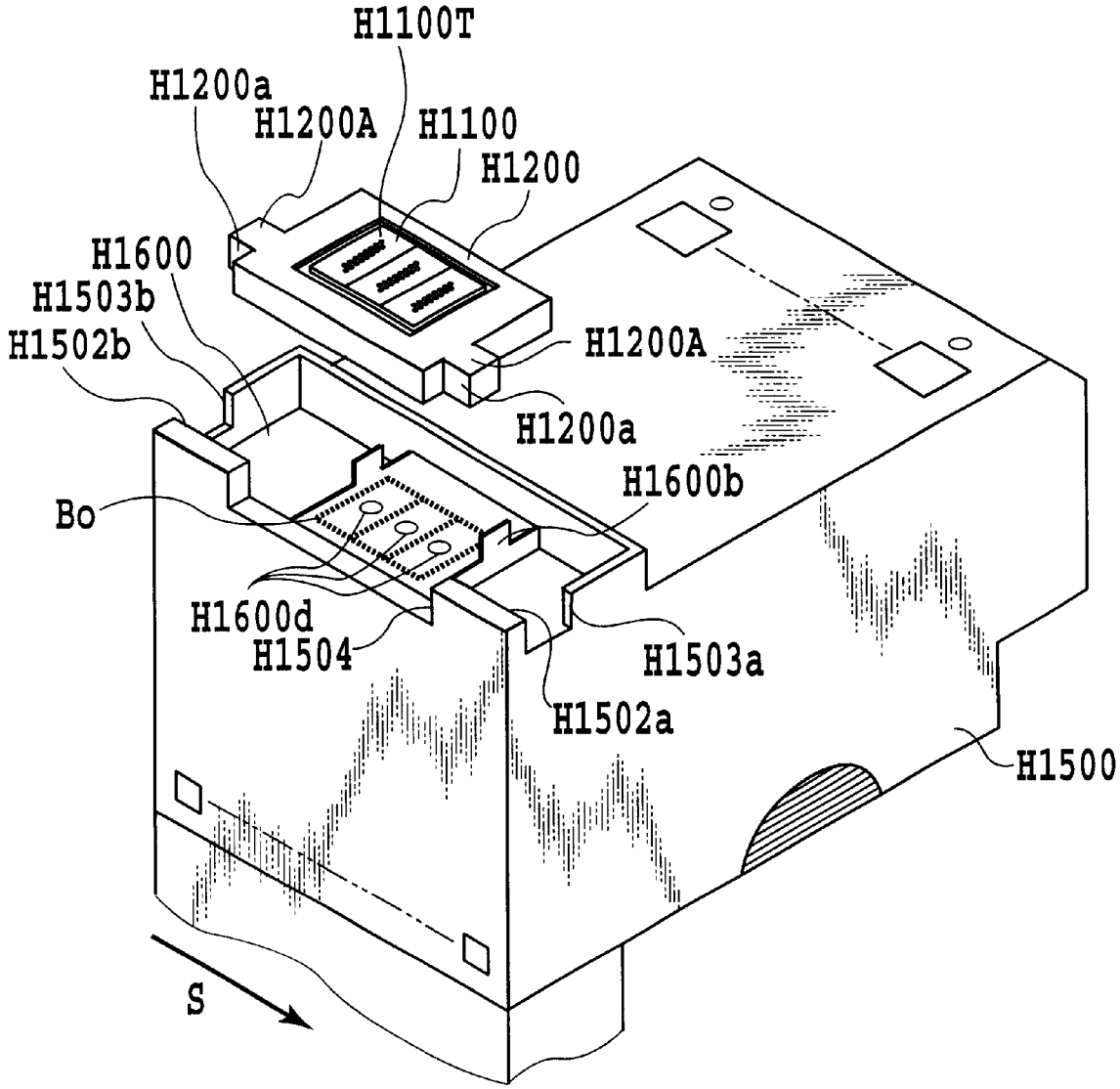
FIG. 14 is a perspective view for providing the explanation of the assembly of the embodiment shown in FIG. 12.

As shown also in FIGS. 11 and 14, the tank holder H1500 constituting part of the print head H1001 to be mounted has the reference end surfaces H1502*a* and 1502*b* in the lower end of a back side surface on which the external signal inputting terminals H1301 are positioned and fixed. The reference end surfaces H1502*a* and 1502*b* are respectively formed in the same plane on a wall defining the periphery of a portion to which the flow passage forming member H1600 is inserted and fixed. Accordingly, since the reference end surfaces H1502*a* and H1502*b* are formed in the same plane, they are easily molded at the same time during the molding process.

Also, the reference end surfaces H1502*a* and H1502*b* communicate with lateral outside via cutoff sections H1503*a* and H1503*b*, respectively, formed on the periphery of a space into which the flow passage forming member H1600 is inserted and fixed. Further, a cutoff section H1504 engaged with the end of the first plate H1200 is formed in a middle region of a wall in which the reference end surfaces H1502*a* and H1502*b* are formed.

As shown in FIGS. 11 and 14, the flow passage forming member H1600 has projections H1600*a* and H1600*b* on a side opposed to the first plate H1200 to be combined thereto, for nippingly holding opposite ends of the first plate H1200.

Predetermined gaps, into which the protrusion H1200A of the first plate H1200 are engageable, are formed between the projections H1600*a*, H1600*b* fixed to the tank holder H1500 and the reference end surfaces H1502*a*, H1502*b* of the tank holder H1500, respectively.

Figure 34A:
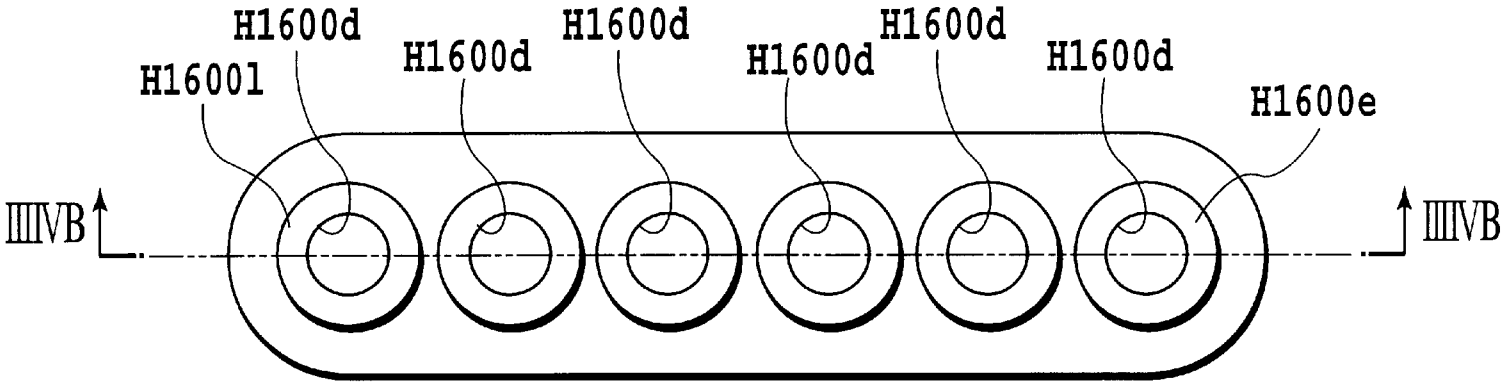
FIG. 34A is a plan view showing a communication path of a flow passage forming member in the embodiment shown in FIG. 11.
Figure 34B:
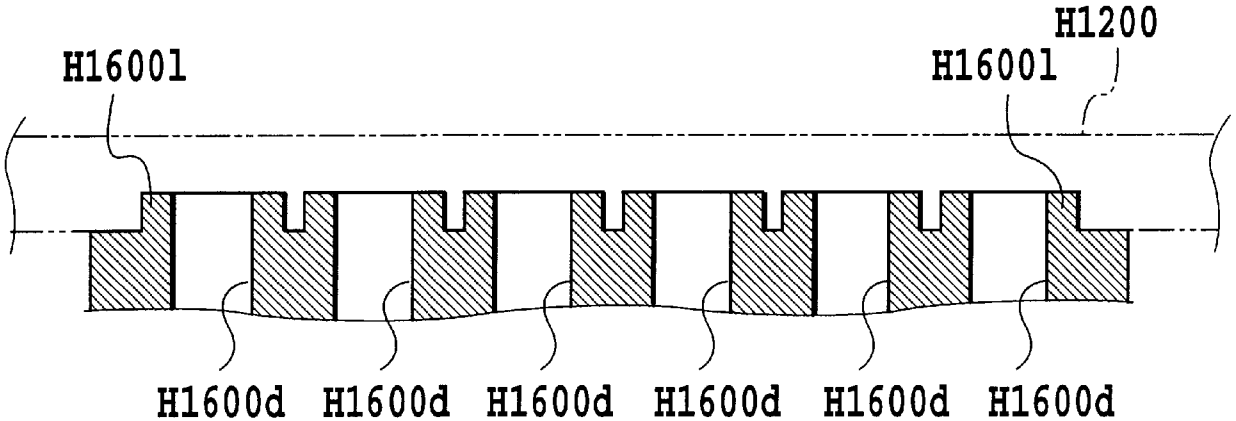
FIG. 34B is a partial sectional view taken along line III IVB—III IVB in FIG. 34A.

As shown in FIGS. 34A, 34B, between the projections H1600*a* and H1600*b* opposite to each other, communication holes 1600*d* are linearly arranged in one row and in parallel to each other at a predetermined interval in correspondence to the respective ink supply ports H1201 of the first plate H1200 and other ends of the above-mentioned ink flow passages H1521. A circular edge H1600*e* is protuberant relative to the remaining portion around the open end of the respective communication hole H1600*d* on a side to be adhered to the first plate H1200. The edges H1600*e* engage with the ink supply ports H1201 of the first plate H1200, respectively, when the first plate H1200 is attached. That is, the communication hole H1600*d* communicates with the interior of the first plate H1200.

In such a structure, upon the assembly of the above-mentioned print head H1001, the print element substrate H1100 in which the ejection openings H1100T are formed is first positioned on the surface of the first plate H1200 in correspondence to the ink supply ports H1201 thereof. The positioning is carried out so that the arrangement direction of the ejection openings H1100T of the print element substrate H1100 makes a predetermined angle relative to the engagement surface H1200*a* of the protrusion H1200A. The print element substrate H1100 is adhered to the first plate H1200, for example, via a heat-hardening adhesive applied between the both. Even if the heat-hardening adhesive is used as in this case, since a linear thermal expansion coefficient of the print element substrate H1100 is nearly equal to that of the first plate H1200, the deterioration of positioning accuracy is avoidable. Consequently, the positioning accuracy of the print element substrate H1100 relative to the first plate H1200 and that of the print element substrate H1100 in the moving direction of the tank holder H1500 are improved.

Figure 13A:
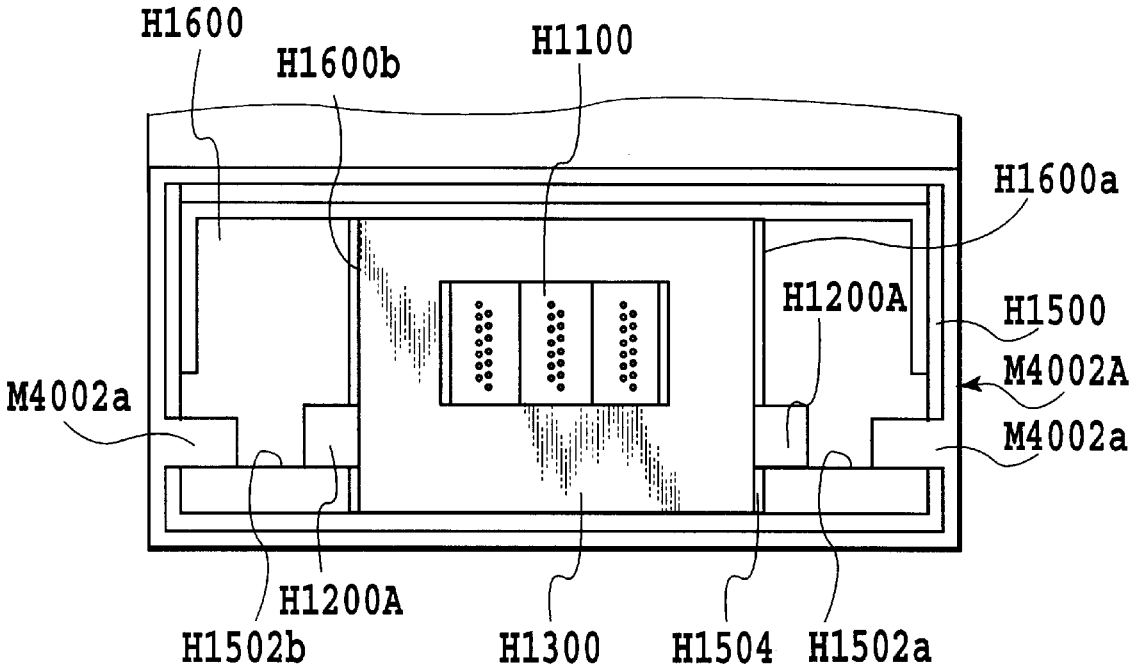
FIG. 13A is a plan view of main part of the liquid ejection type print head mounted to the embodiment shown in FIG. 12.
Figure 13B:
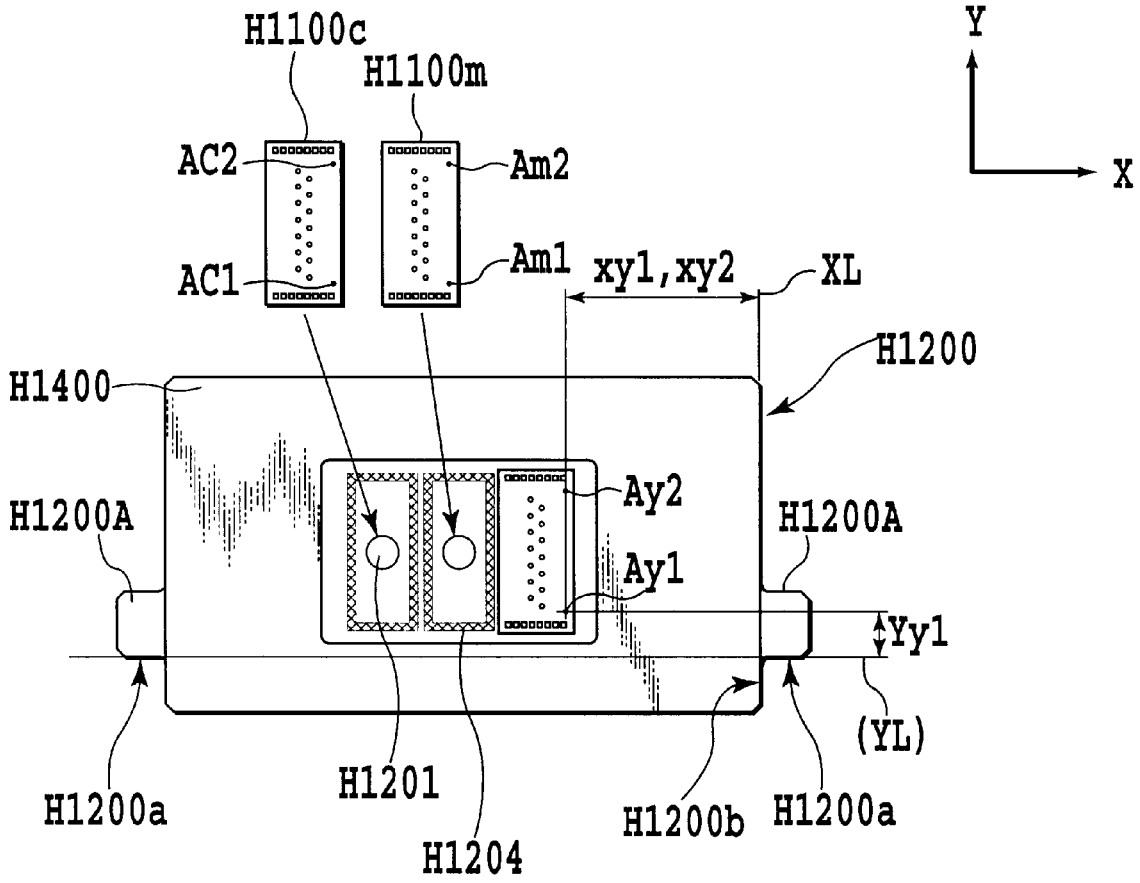
FIG. 13B and FIG. 13C is a view for providing the explanation of the assembly of a print element substrate in the embodiment shown in FIG. 12 respectively.
Figure 13C:
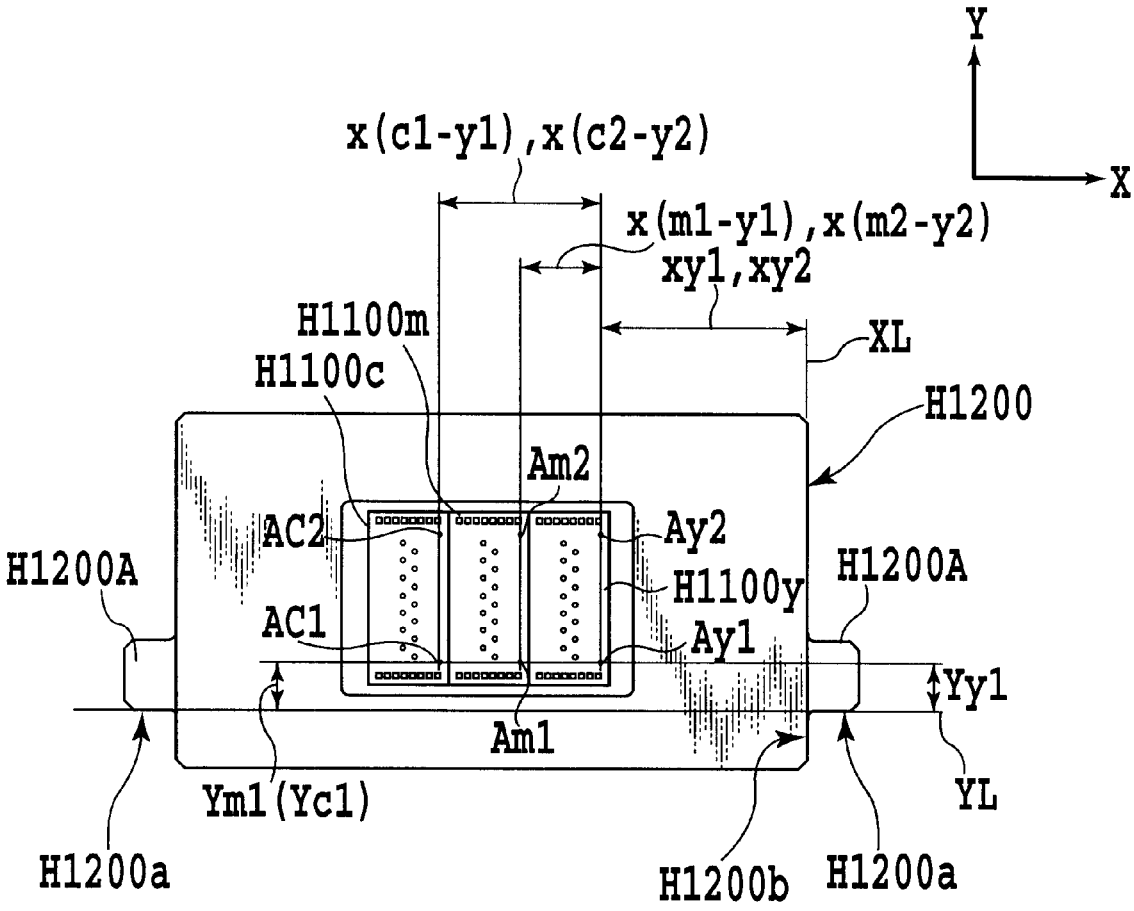

Alignment marks Ay1, Ay2, Am1, Am2, Ac1 and Ac2, and reference surfaces 1200*a* and a reference surface 1200*b* described later are used for the above-mentioned method for positioning the print element substrate H1100 in relation to the first plate H1200 as shown in FIGS. 13B and 13C.

As stated above, the two reference surfaces 1200*a* orientated in the direction of the arrow Y (the direction generally vertical to the scanning direction of the carriage M4002) are provided in protrusion H1200A of the first plate H1200 formed on the opposite sides as seen in the longitudinal direction thereof. The Y-directional reference surface H1200*a* (a surface vertical to a paper in FIG. 13B) is a reference when the first plate H1200 is positioned onto the tank holder H1500 in relation to the intersecting direction toward the arrangement direction of a plurality of print element substrates H1100*y*, H1100*m* and H1100*c*.

Also, in the vicinity of the protrusion H1200A formed on the one end of the first plate H1200 is formed a reference surface H1200*b* orientated in the direction of the arrow X vertical to the reference surface H1200*a* (a surface vertical to a paper in FIG. 13B).

For example, a line connecting the two Y-directional reference surfaces H1200*a* with each other is referred to as a Y-reference line YL, while another line extending vertically to the Y-directional reference line YL and passing through the X-directional reference surface H1200*b* is referred to as an X-reference line XL.

Further, alignment marks Ay1, Ay2; Am1, Am2; and Ac1, Ac2 are provided at predetermined positions on the print element substrates 1100*y*, 1100*m* and H1100*c*, respectively, in the vicinity of the longitudinal opposite ends thereof. The pair of alignment marks Ay1 and Ay2 are defined on a common straight line. In this regard, the pairs of alignment marks Am1, Am2 and Ac1, Ac2 are also defined on common straight lines, respectively.

The alignment mark Ay1 is provided at a predetermined position in correspondences to the alignment marks Am1 and Ac1 of the respective substrates, while the alignment mark Ay2 is provided at a predetermined position in correspondences to the alignment marks Am2 and Ac2 of the respective substrates.

When positioning the print element substrates H1100*y*, H1100*m* and H1100*c*, the print element substrate H1100*y* which lateral edge having the alignment marks is closest to the Y-directional reference surface H1200*a* is first positioned by using the image processing. During this operation, the respective print element substrates H1100*y*, H1100*m* and H1100*c* are supported by grip means not shown and positioned while approaching to a surface to be adhered described later.

The alignment mark Ay1 of the print element substrate H1100*y* is positioned to be spaced at a predetermined distance Yy1 from the Y-directional reference surface H1200*a* as well as to be spaced at a predetermined distance Xy1 from the X-directional reference surface H1200*b*.

Then, the alignment mark Ay2 is positioned to be spaced at the predetermined distance Xy2 from the X-directional reference surface H1200*b*. The values Xy1 and Xy2 are equal to each other when the inclination of an end surface of the print element substrate 1100*y* is 90 degrees in relation to the Y-reference line YL.

Subsequently, the print element substrate H1100*m* is positioned. The positioning is carried out so that the alignment marks Am1 and Am2 of the print element substrate H1100*m* are spaced at predetermined distances X (m1–y1) and X (m2–y2) which are optional values from the alignment marks Ay1 and Ay2, respectively, of the print element substrate H1100*y*. On the other hand, regarding the Y-directional position of the alignment mark Am1, it is positioned so that a distance Ym1 from the Y-reference line YL is equal to the predetermined value Yy1.

Similarly, the print element substrate H1100*c* is positioned so that the alignment marks Ac1 and Ac2 thereof are spaced at predetermined distances X (c1–y1) and X (x2–y2) which are optional values from the alignment marks Ay1 and Ay2, respectively, of the print element substrate H1100*y*. On the other hand, regarding the Y-directional position of the alignment mark Ac1, it is positioned so that a distance Yc1 from the Y-reference line YL is equal to the predetermined value Yy1.

After the print element substrates H1100*y*, H1100*m* and H1100*c* have been positioned in such a manner, as described above, the print element substrates H1100*y*, H1100*m* and H1100*c* are adhered to the first plate H1200 with a heat-hardening adhesive H1204. In this embodiment, an adhesive also curable with ultraviolet ray is used as the heat-hardening adhesive. That is, after the print element substrates H1100*y*, H1100*m* and H1100*c* have been temporarily secured at positions by the irradiation of ultraviolet ray to the adhesive, the adhesive is heated and completely cured, whereby the print element substrates H1100*y*, H1100*m* and H1100*c* are assuredly fixed.

Since a contact area of the reference surface 1200*a* of the first plate H1200 is relatively small, the machining accuracy is easily enhanced when the reference surface H1200*a* is machined.

Figure 15:
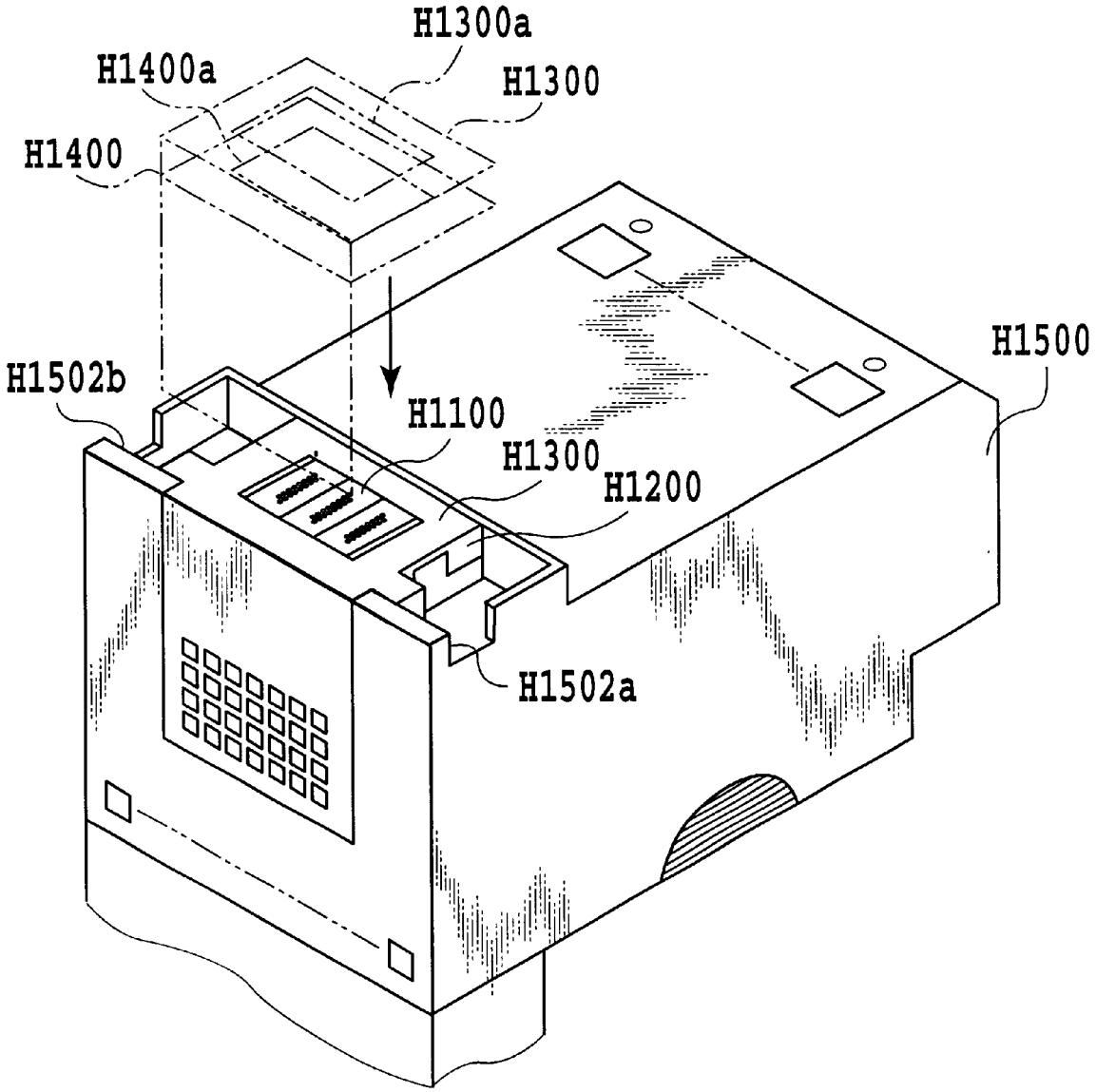
FIG. 15 is a perspective view for providing the explanation of the assembly of the embodiment shown in FIG. 12.

Subsequently, as shown in FIG. 15, the second plate H1400 and the electric wiring board H1300 are laid on the first plate H1200, and the electric wiring board H1300 is electrically connected to the electrodes of the print element substrate H1100.

Next, as shown in FIG. 14, after a silicon type adhesive Bo curable at a normal temperature or a relatively low temperature has been coated around the periphery of the communication hole H1600*d* of the tank holder unit H1003 (flow passage forming member H1600), the first plate H1200 to which is fixed the print element substrate H1100 of the print element unit H1002 is nipped between the projections H1600*a* and H1600*b*, engaged with the cutoff H1504, as shown in FIG. 15, and adhered to a surface of the flow passage forming member H1600 on which are formed the communication holes H1600*d*. At this time, the protrusion H1200A of the first plate H1200 are engaged into a space between the projection H1600*a*, H1600*b* and the reference end surfaces H1502*a*, H1502*b*, and the engagement surfaces H1200*a* are brought into contact with the reference end surfaces H1502*a* and H1502*b* and are adhered by the sixth adhesive H1604 (see FIG. 24). Accordingly, the first plate H1200 of the print element unit H1002 necessitates no heat upon the adhesion, and can be fixed while maintaining the predetermined positioning accuracy of the row of ejection openings H1100T of the print element substrate H1100 relative to the reference end surfaces H1502*a* and H1502*b* of the tank holder H1500.

Next, the tank holder H1500 to which is fixed the print element unit H1002 is inserted and mounted into the carriage M4002 together with the ink tank H1900 in the direction shown by the arrow as shown in FIG. 12 and FIG. 13A. At this time, the reference end surfaces H1502*a* and H1502*b* of the tank holder H1500 are brought into contact with engagement surfaces of the engagement sections M4002*a*, respectively. Thus, the row of ejection openings H1100T of the print element substrate H1100 in the mounted tank holder H1500 is positioned at a high accuracy relative to the carriage M4002 while forming a predetermined angle from the moving direction of the carriage M4002.

Figure 17:
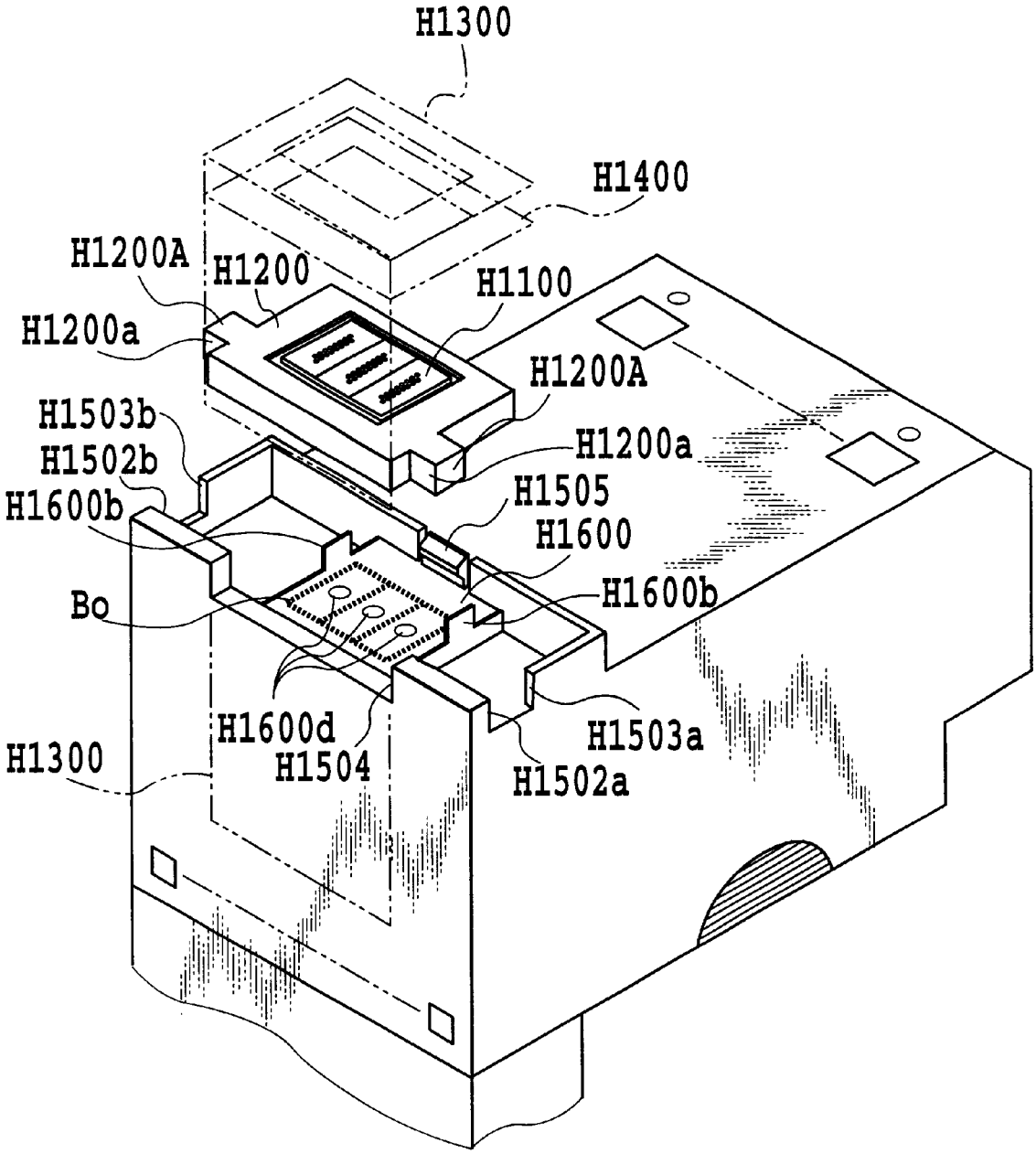
FIG. 17 is a perspective view showing a second embodiment of the liquid ejection type print head according to the present invention.
Figure 18:
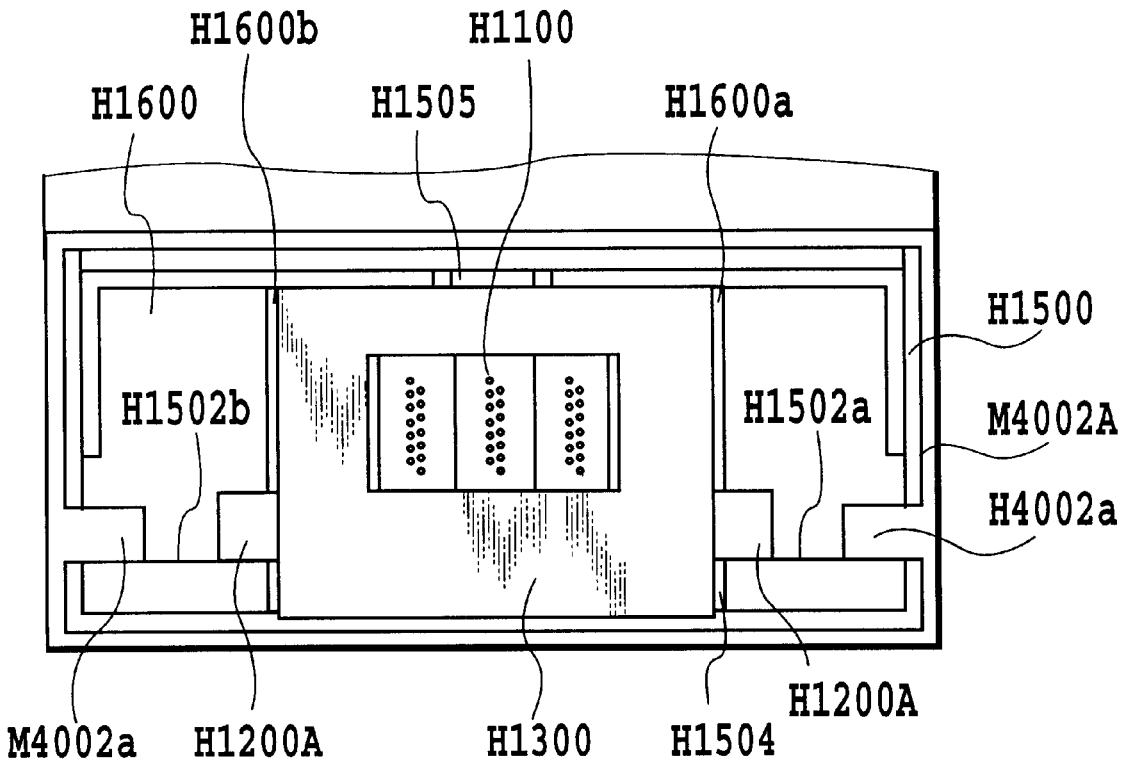
FIG. 18 is a plan view showing the mounted liquid ejection type print head shown in FIG. 17.

FIGS. 17 and 18 show a main part of a second embodiment of a liquid ejection type print head according to the present invention.

With reference to FIG. 17, a presser piece H1505 is formed in addition to the projections H1600*a* and H1600*b* in the embodiment shown in FIG. 14, integral with a peripheral edge of a portion into which the flow passage forming member H1600 is fixedly inserted. The presser piece H1505 operates to press the engagement surfaces H1200*a* of the first plate H1200 toward the reference end surfaces H1502*a* and H1502*b* by an elastic force thereof.

In this regard, in FIGS. 17 and 18, the same components as in the embodiment shown in FIGS. 13A, 14 and 15 are denoted by the same reference numerals and the explanation thereof will be eliminated.

One end of the presser piece H1505 is coupled to the peripheral edge of the portion into which the flow passage forming member H1600 is fixedly inserted at a midpoint position between the projections H1600*a* and H1600*b*, and the other end of the presser piece H1505 defines a free end movable in accordance with an external force applied thereto.

In such a structure, upon the assembly of the above-mentioned print head H1001, the print element substrate H1100 in which the ejection openings H1100T are formed is first arranged on the surface of the first plate H1200 to be positioned to the engagement surfaces H1200*a* in correspondence to the ink supply port H1201 of the first plate H1200 in the same manner as in the above first embodiment. At this time, the print element substrate H1100 is adhered to the first plate H1200, for example, by a heat-hardening adhesive applied between the both. Then, the second plate H1400 and the electric wiring board H1300 is laid on the first plate H1200. The electric wiring board H1300 is electrically connected to the electrodes of the print element substrate H1100. Thus, the print element unit H1002 as shown in FIG. 24 is completed.

Subsequently, after the silicon type adhesive Bo curable at a normal temperature or a relatively low temperature has been applied to the periphery of the communication holes H1600*d* of the tank holder unit H1003 (flow passage forming member H1600) as shown in FIGS. 17 and 24, the first plate H1200 of the print element unit H1002 is nipped between the projections H1600*a* and H1600*b* against the elastic force of the presser piece H1505, engaged with the cutoff section H1504 and adhered to the surface on which the communication holes H1600*d* are formed. At this time, the protrusion H1200A of the first plate H1200 are engaged into a space between the projection H1600*a*, H1600*b* and the reference end surfaces H1502*a*, H1502*b*, and the engagement surfaces H1200*a* are brought into contact with the reference end surfaces H1502*a* and H1502*b*. In addition thereto, due to the elastic force of the presser piece H1505, the engagement surfaces H1200*a* of the first plate H1200 are pressed onto the reference end surfaces H1502*a* and H1502*b*.

Thus, the first plate H1200 necessitates no heat upon the adhesion, and can be fixed while maintaining the predetermined positioning accuracy of the row of ejection openings H1100T of the print element substrate H1100 relative to the reference end surfaces H1502*a* and H1502*b* of the tank holder H1500. In addition, since a load is always applicable to the first plate H1200 in the abutment direction for a time duration while the adhesive Bo curable at a normal temperature is being cured (8 to 12 hours) and even after being cured, it is possible to accurately define the inclination of the row of the ejection openings. It was confirmed by a heat cycle test conducted by the present inventor that the abutment accuracy of the engagement surfaces H1200*a* relative to the end surfaces H1502*a* and H1502*b* is improved.

Then, as shown in FIGS. 24 and 27, the external signal inputting terminal section H1301 of the print element unit H1002 is positioned and fixed to one side surface of the tank holder H1500.

Subsequently, the print head H1001 is inserted together with the ink tanks H1900 into the carriage M4002 and mounted thereon, as shown in FIG. 18. At this time, the reference end surfaces H1502*a* and H1502*b* of the tank holder H1500 are brought into contact with the engagement surfaces of the engagement sections M4002*a*, respectively. Thus, the row of ejection openings H1100T of the print element substrate H1100 in the mounted tank holder H1500 is positioned at a high accuracy relative to the carriage M4002 while forming a predetermined angle from the moving direction of the carriage M4002.

Figure 19:
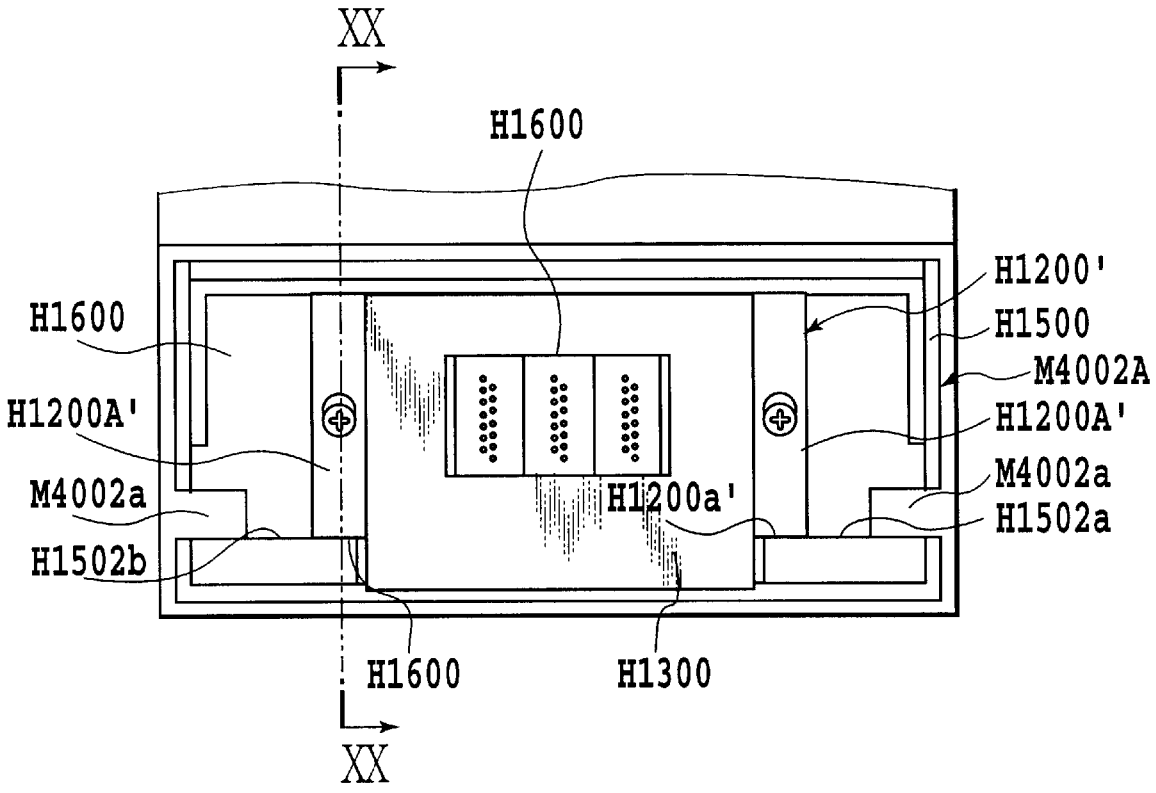
FIG. 19 is a plan view showing main part of a third embodiment of the liquid ejection type print head according to the present invention.

FIG. 19 illustrates a main part of a third embodiment of a liquid ejection type print head according to the present invention together with the carriage M4002. FIG. 19 shows a state wherein the tank holder H1500 with which the print element substrate H1100 and the electric wiring board H1300 or the like are assembled is mounted to the interior of the carriage M4002.

In the embodiment shown in FIG. 17, the engagement surfaces H1200*a* of the first plate H1200 are pressed onto the reference end surfaces H1502*a* and H1502*b* due to the elastic force of the presser piece H1505. On the other hand, in the embodiment shown in FIG. 19, the engagement surfaces H1200*a*' of the first plate H1200' are pressed onto the reference end surfaces H1502*a* and 1502*b* by a radial component of a fastening force of a countersunk screw Bs instead of the elastic force as in the embodiment shown in FIG. 17.

Figure 20:
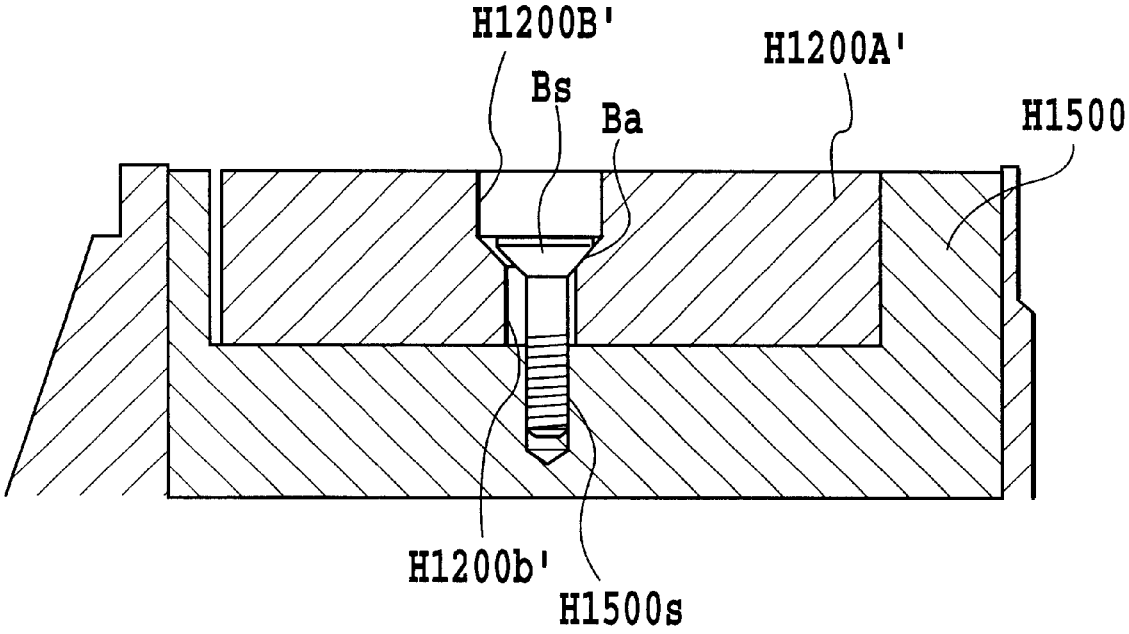
FIG. 20 is a partial sectional view taken along line XX—XX in FIG. 19.
Figure 21:
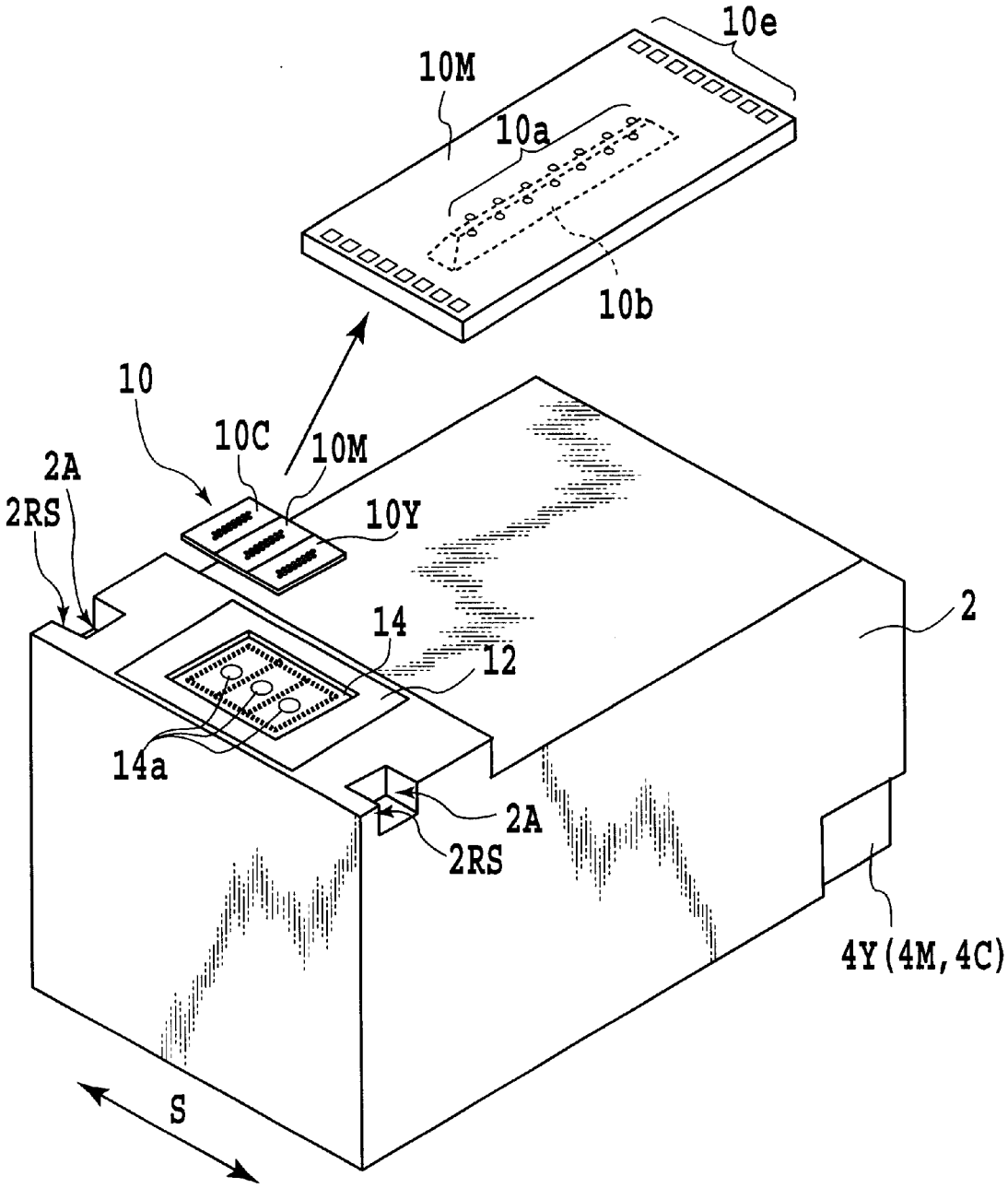
FIG.21 PRIOR ART
FIG. 21 is a perspective view showing a tank holder and a print element substrate according to the prior art.
Figure 22:
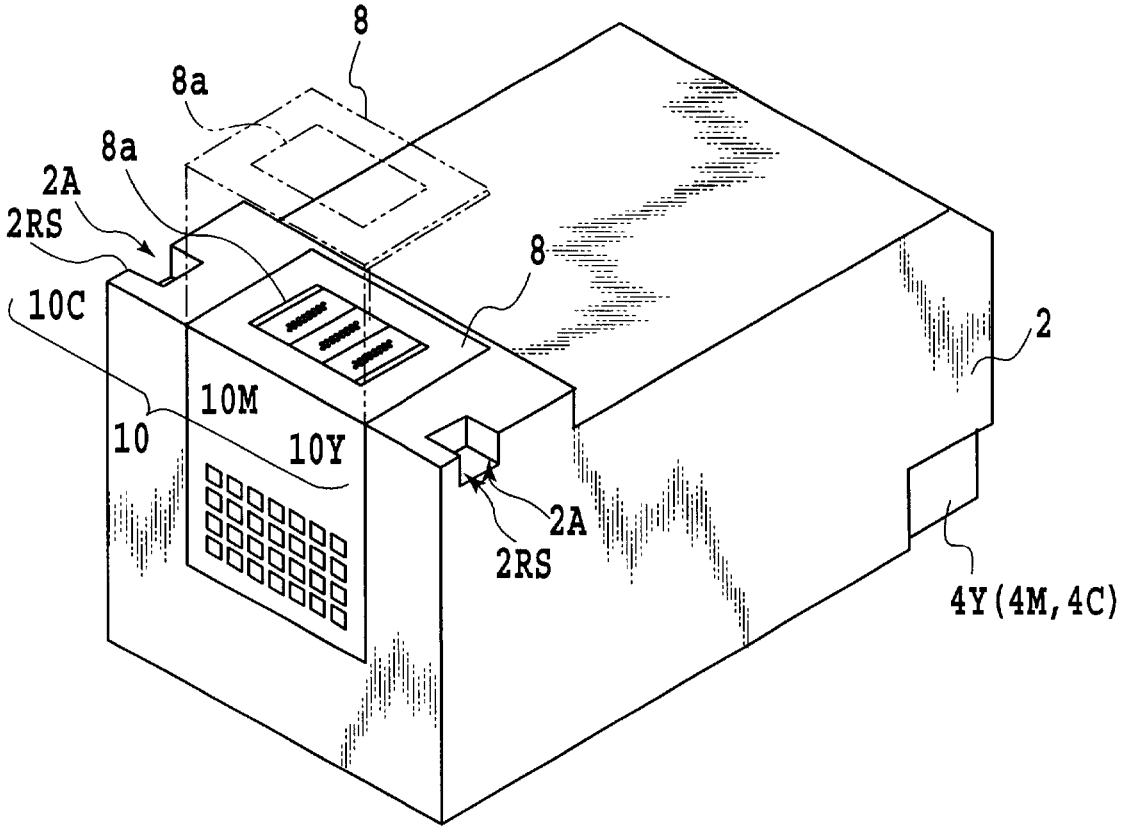
FIG.22 PRIOR ART
FIG. 22 is a perspective view for providing the explanation of the assembly of the tank holder and the print element substrate according to the prior art.
Figure 23:
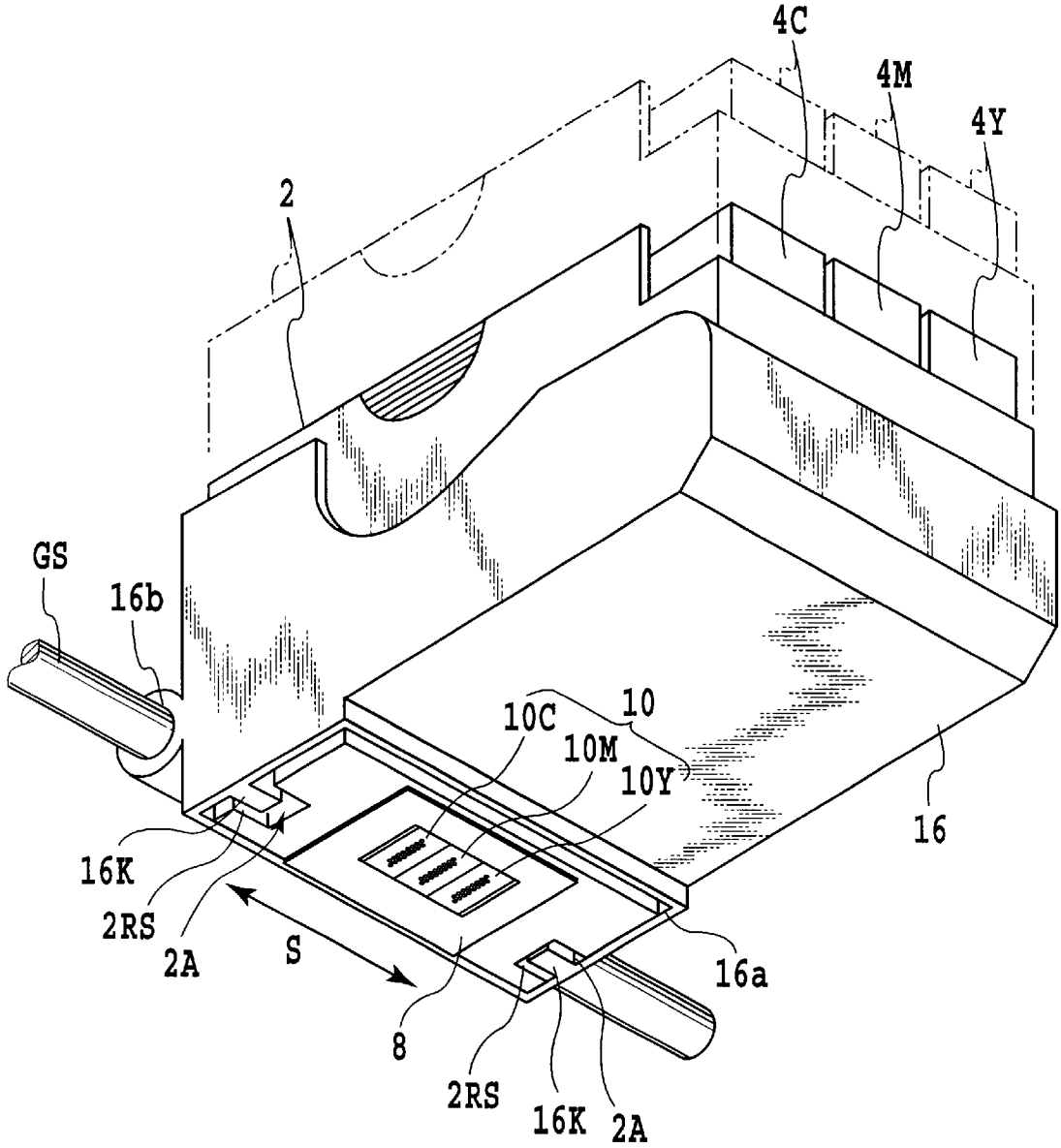
FIG.23 PRIOR ART
FIG. 23 is a perspective view showing the ink cartridge shown in FIG. 21 mounted to the carriage.

The first plate H1200' is made of the same material as that of the first plate H1200 in the above-mentioned embodiment and has the print element substrate H1100 positioned in a generally central region thereof and fixed via the same adhesive as in the above-mentioned embodiment. At opposite ends of the first plate H1200' opposed to the cutoff sections H1503*a* and H1503*b* of the tank holder H1500, the engagement surfaces H1200*a*' are provided as reference surfaces to be in contact with the reference end surfaces H1502*a* and H1502*b*. Further, at each of the opposite ends are provided a circular hole H1200*b*' and a hole H1200B' for receiving the countersunk screw Bs. A seating face Ba of a conical shape is formed on the periphery of the hole H1200*b*' in correspondence to the head of the countersunk screw Bs as shown FIG. 20. An inner diameter of the hole H1200*b*' is larger than a diameter of a shaft of the countersunk screw Bs. The circular hole H1200B' is formed in contiguous to the hole H1200*b*' and the seating face Ba. A diameter of the circular hole H1200B' is larger than that of the hole H1220*b*'.

A female-threaded hole H1500*s* to be engaged with the countersunk screw Bs is provided at a position in the tank holder H1500 corresponding to the hole 1200*b*'.

Thus, as described above, after the adhesive has been coated on the surface of the flow passage forming member H1600 on which the hole H1600*d* is to be formed, the countersunk screw Bs is inserted into the holes H1200*b*', 1200B' of the first plate H1200' and screwed on the female-threaded hole H1500*s*. Since the head of the countersunk screw Bs pushes the seating face Ba thereby, the first plate H1200' is fastened and the engagement surfaces H1200*a*' are brought into press-contact with the reference end surfaces H1502*a* and H1502*b*.

Accordingly, there is no need for waiting for the complete curing of the adhesive (8 to 12 hours) before proceeding to the next process, whereby the production time can be shortened to a great extent.

Also in this structure, the print head H1001 is inserted to mount into the interior of the carriage M4002 together with the ink tank H1900 as shown in FIG. 19 in the same manner as in the above-described embodiment. At this time, the reference end surfaces H1502*a* and H1502*b* of the tank holder H1500 are brought into contact with the engagement surfaces of the engagement section M4002*a*, respectively. Thus, the row of ejection openings H1100T of the print element substrate H1100 in the mounted tank holder H1500 is positioned at a high accuracy relative to the carriage M4002 while forming a predetermined angle from the moving direction of the carriage M4002.

Figure 35:
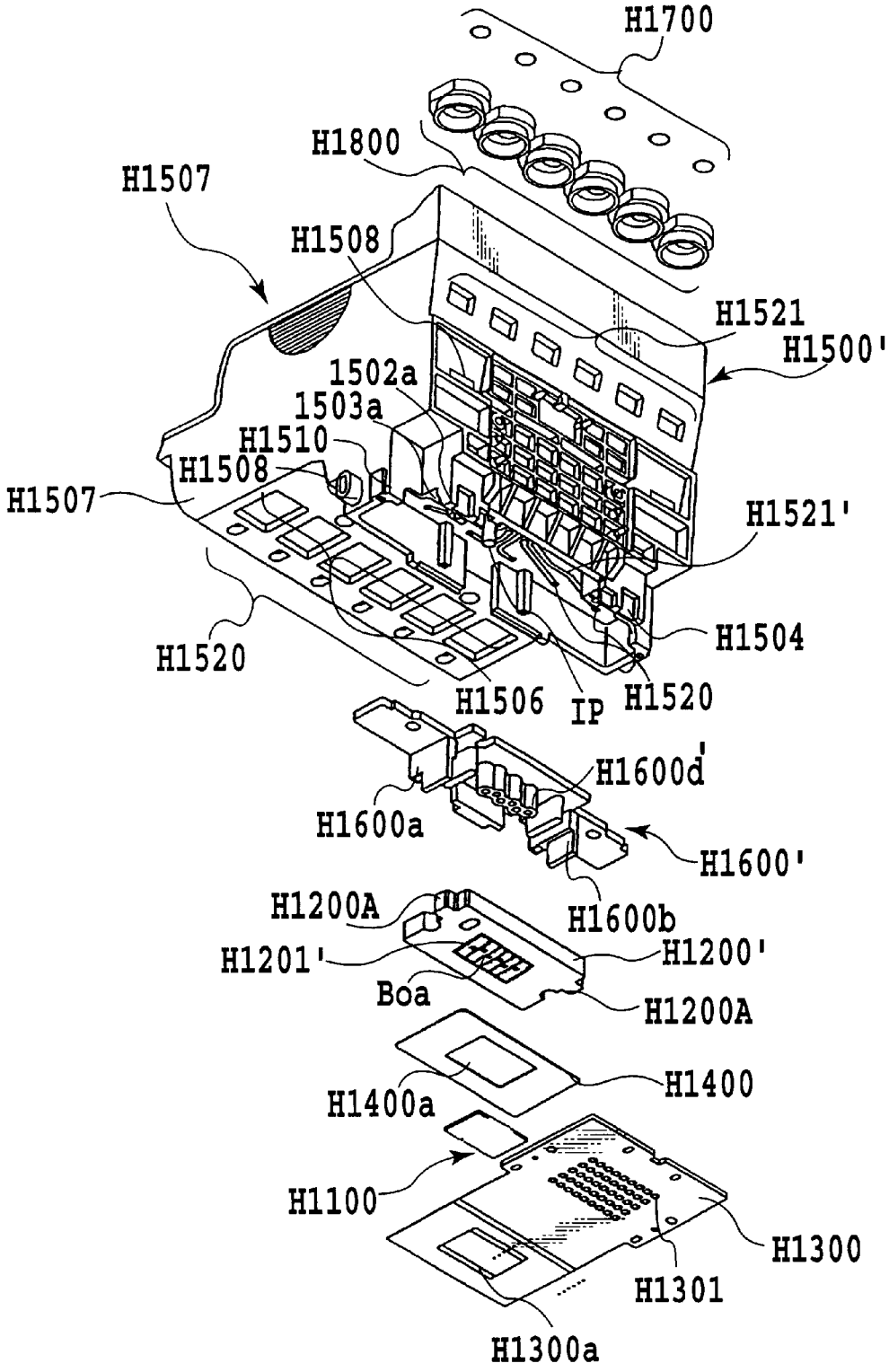
FIG. 35 is an exploded perspective view showing a fourth embodiment of a liquid ejection type print head according to the present invention.
Figure 36:
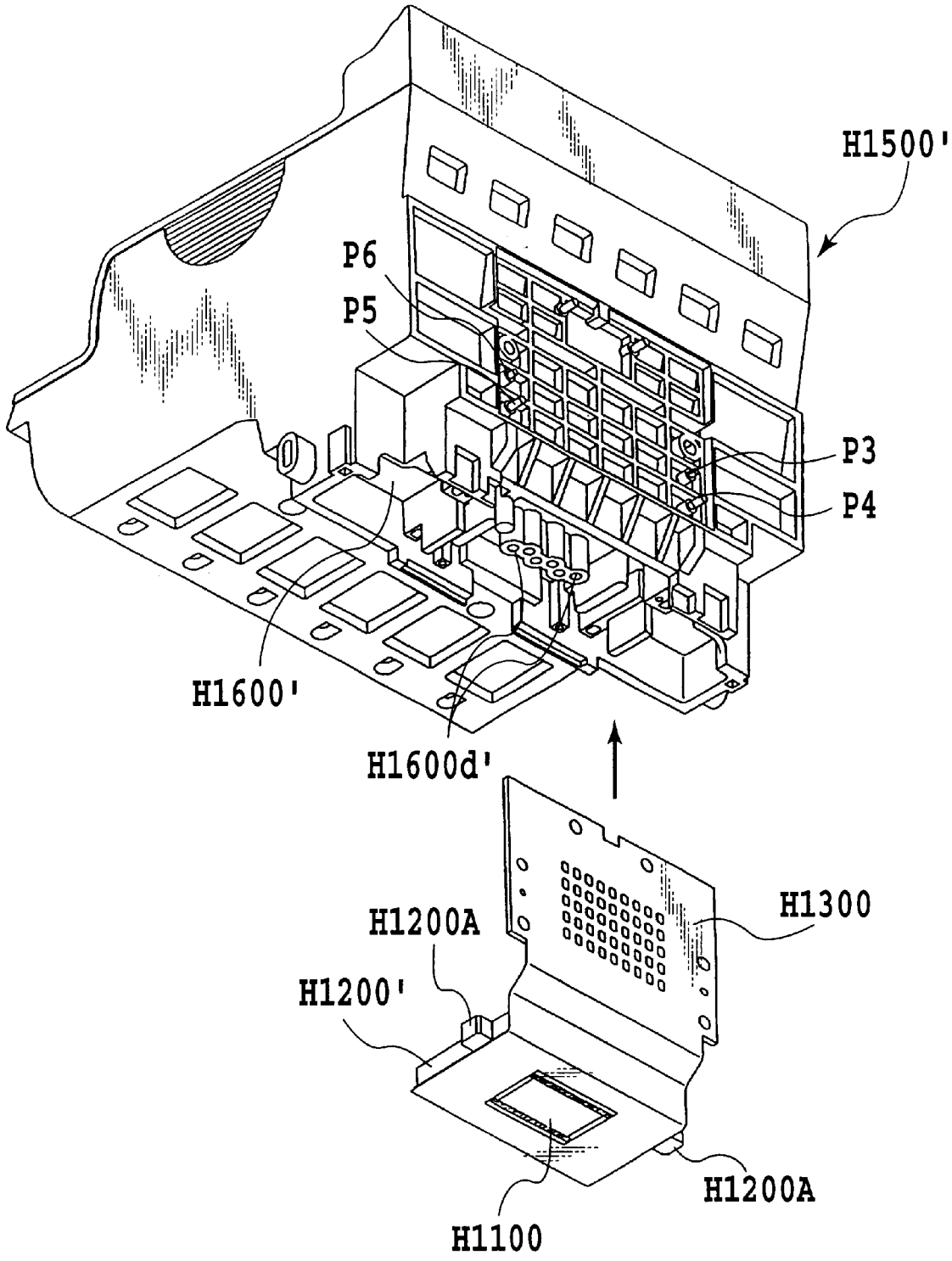
FIG. 36 is an exploded perspective view showing a state wherein the flow passage forming member in the embodiment shown in FIG. 35 is fixedly secured to the tank holder and the first plate is assembled to an electric wiring board.
Figure 37:
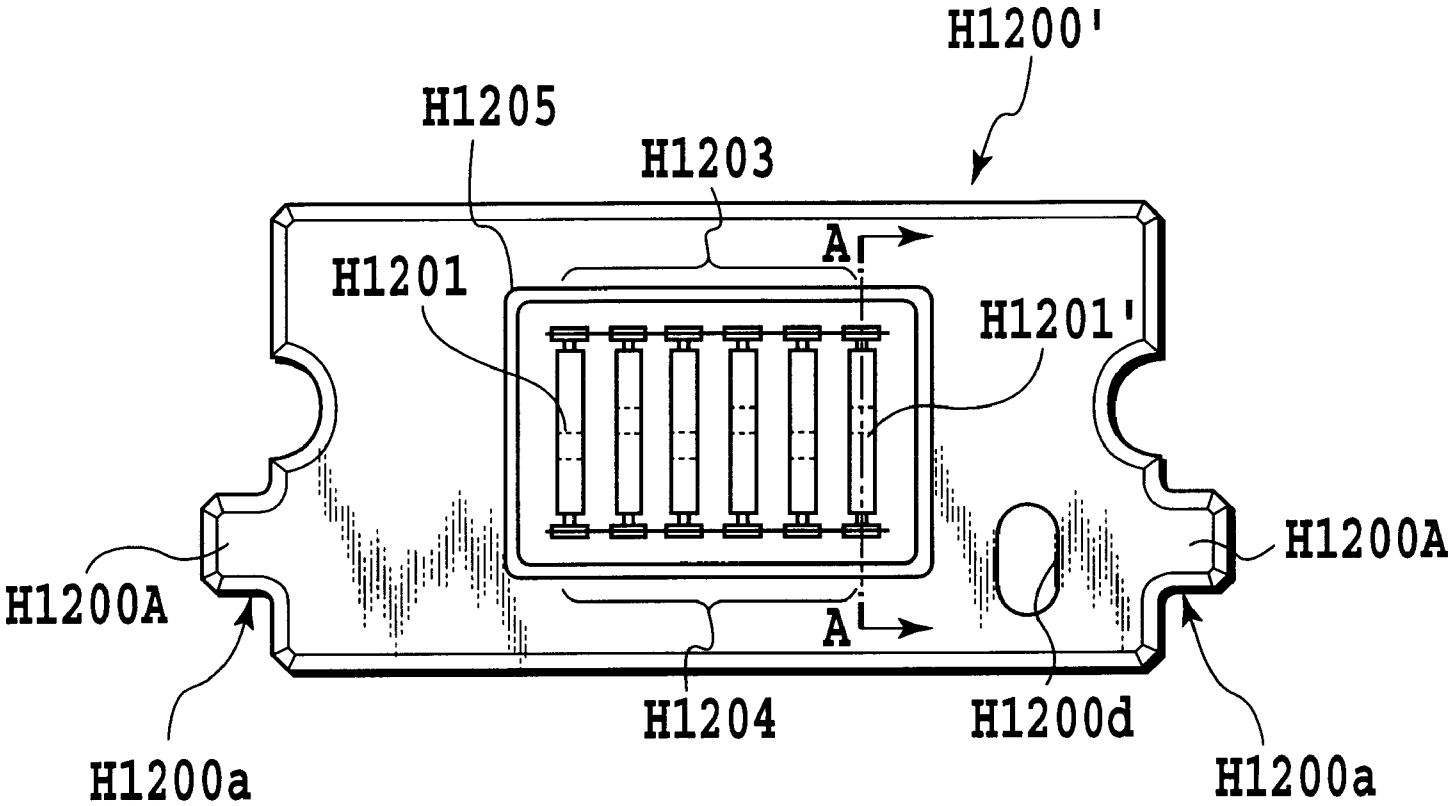
FIG. 37 is a plan view of a first plate in the embodiment shown in FIG. 35.

FIGS. 35, 36 and 37 show a fourth embodiment of a liquid ejection type print head according to the present invention.

In the embodiments shown in FIG. 11, the open ends of the communication passage H1600*d* in the flow passage forming member H1600 are linearly arranged at a predetermined interval. On the other hand, in the embodiment shown in FIGS. 35 to 37, the open ends of the communication passages H1600*d*' in the flow passage forming member H1600' are arranged in a zigzag or staggered manner instead of the linear arrangement as in the preceding embodiments.

In this connection, in FIGS. 35 to 37, the same components as in the embodiment shown in FIG. 11 are denoted by the same reference numerals and the explanation thereof will be eliminated.

In a portion of the tank holder H1500 into which the flow passage forming member H1600' is fixedly inserted, groove-like ink flow passages H1521' are formed in correspondence to the respective ink tanks H1900, wherein one end of the ink flow passage communicates with the above-mentioned ink supply port H1520 and the other end thereof is formed in correspondence to the open end of the flow passage forming member H1600'. Thus, the other ends of the ink flow passages H1521' are converged in a zigzag manner in correspondence to the open ends of the ink flow passages in the flow passage forming member H1600 so that a mutual distance between the adjacent other ends of the ink flow passage H1521' is smaller than that between the adjacent one ends thereof.

An ink flow passage for supplying ink from the respective ink tank H1900 to the respective ink flow passage in the flow passage forming member H1600' is formed by bonding the respective ink flow passage H1521' with the abutment surface of the flow passage forming member 1600'.

Figure 38A:
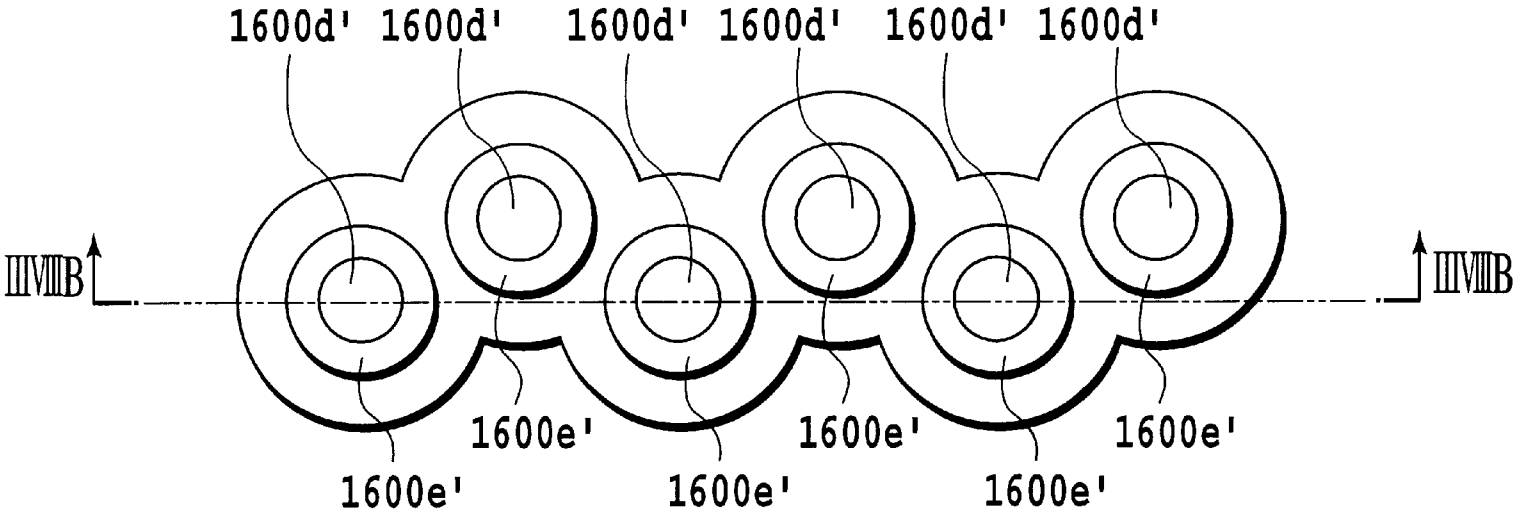
FIG. 38A is a plan view showing a communication path of a flow passage forming member in the embodiment shown in FIG. 35.
Figure 38B:
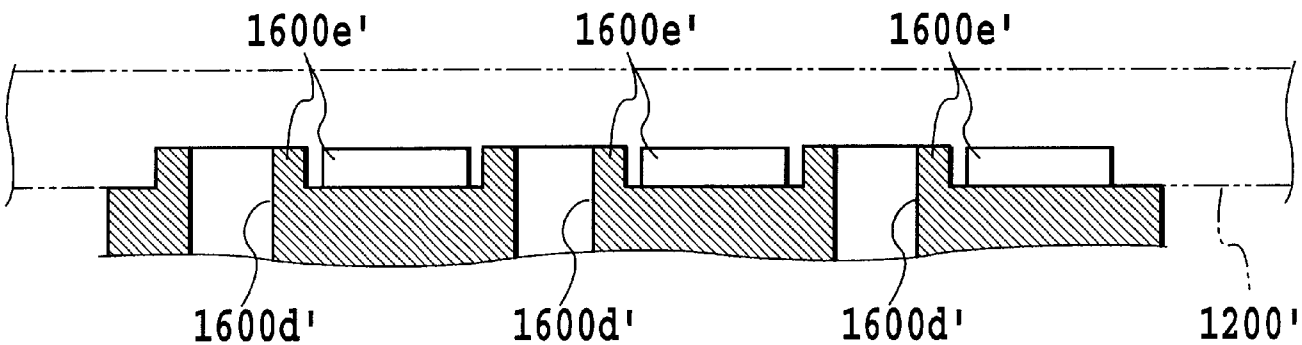
FIG. 38B is a partial sectional view taken along line III VIIIB—III VIIIB in FIG. 38A.

As shown in FIGS. 35, 38A and 38B, communication holes H1600*d*' are formed at a predetermined mutual distance in parallel to each other in a zigzag manner between the opposed projections H1600*a* and H1600*b* in correspondence to the respective ink supply ports H1201' of the first plate H1200' and the other ends of the above-mentioned ink flow passages H1521'. A circular edge H1600*e*' is protuberance relative to other portion around the open end of the respective communication hole 1600*d*' on a side to be adhered to the first plate H1200'. The edges H1600*e*' engage with the ink supply ports H1201' of the first plate H1200', respectively, when the first plate H1200' is attached. That is, the communication hole H1600*d*' communicates with the interior of the first plate H1200'.

As shown in FIG. 35, the first plate H1200' has six ink supply ports H1201' for supplying six colored inks from the flow passage forming member H1600' to the respective print element substrates H1100, arranged in a zigzag manner in correspondence to the above-mentioned each communication holes H1600*d*'. In this regard, the ink supply port H1201' communicates with an enlarged portion H1202 opened as an ink flow passage to the end surface H1200*s* to which the print element substrate H1100 is adhered as shown in FIG. 33B.

Thus, it is possible to provide grooves or steps around the ink supply port and obtain a sufficient adhesion area without widening the arrangement pitch between the ink supply ports or reducing a size of the ink supply port, by two rows of a staggered the communication holes H1600*d*' and the ink supply ports H1201'. As a result, a reliable ink jet print head compact in size and free from ink leakage is provided.

Figure 39:
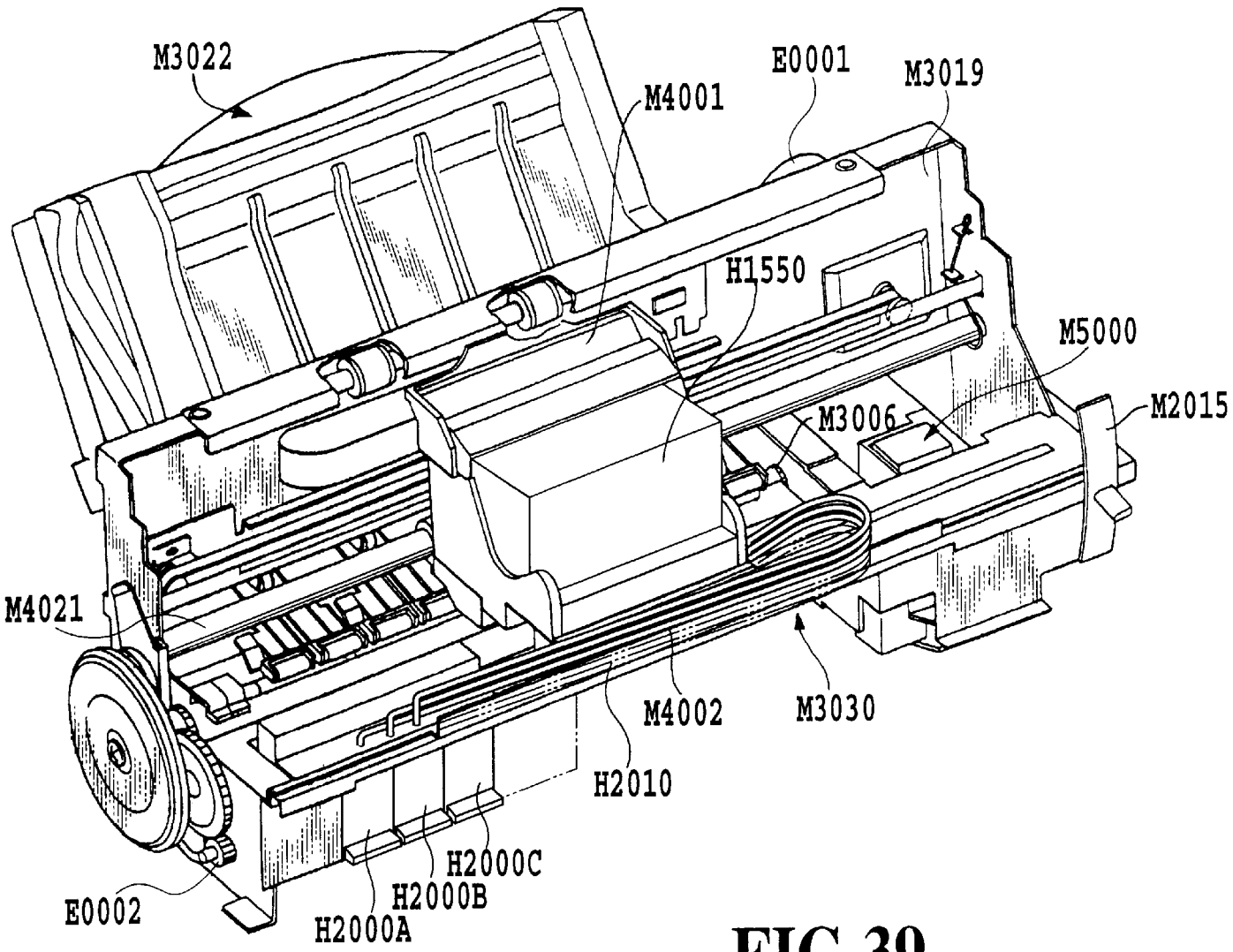
FIG. 39 is a perspective view showing a fifth embodiment of a liquid ejection type print head according to the present invention together with a printing apparatus to which the same is applied.
Figure 40:
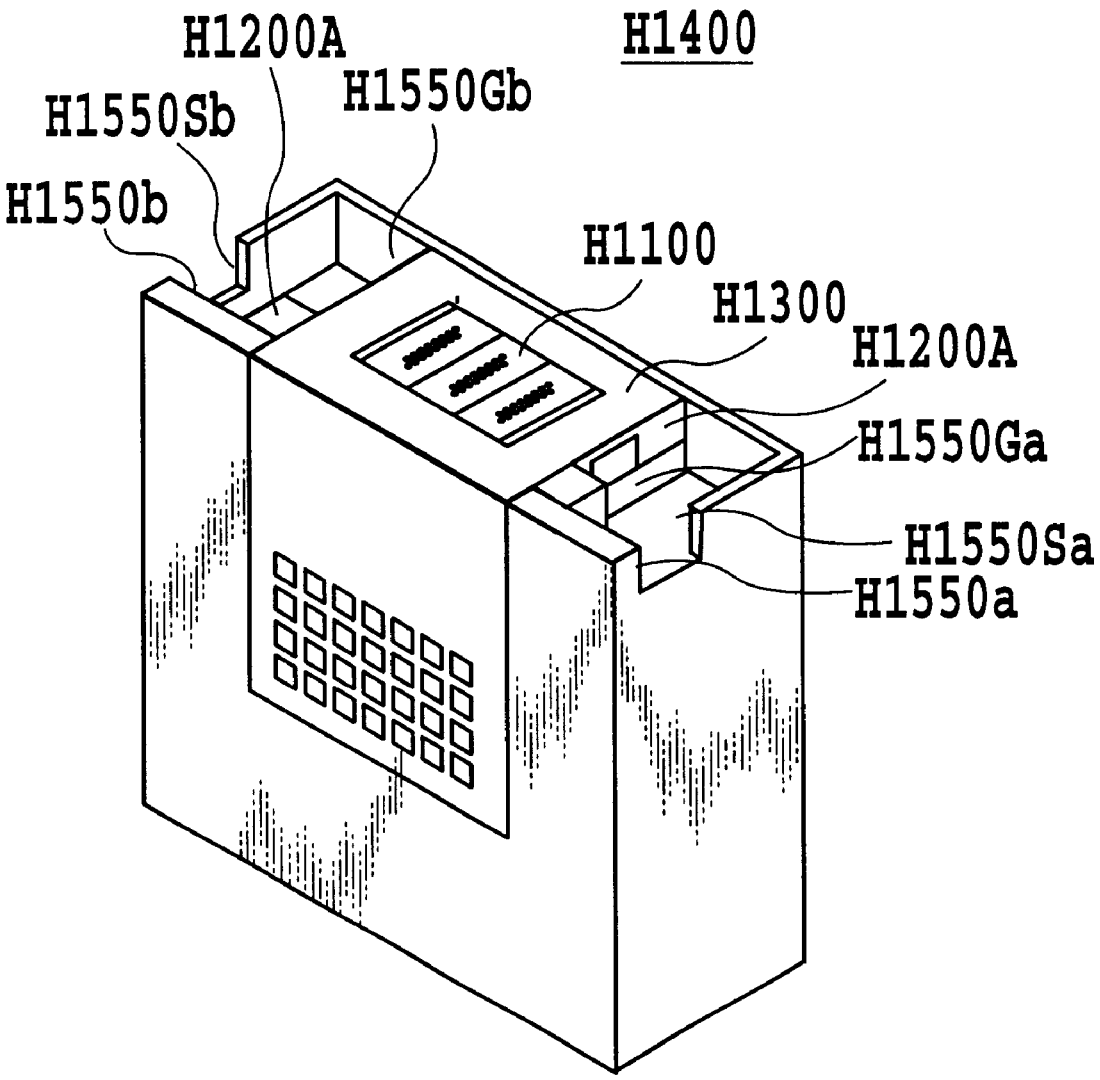
FIG. 40 is a perspective view showing the liquid ejection type print head used to the embodiment shown in FIG. 39.
Figure 41:
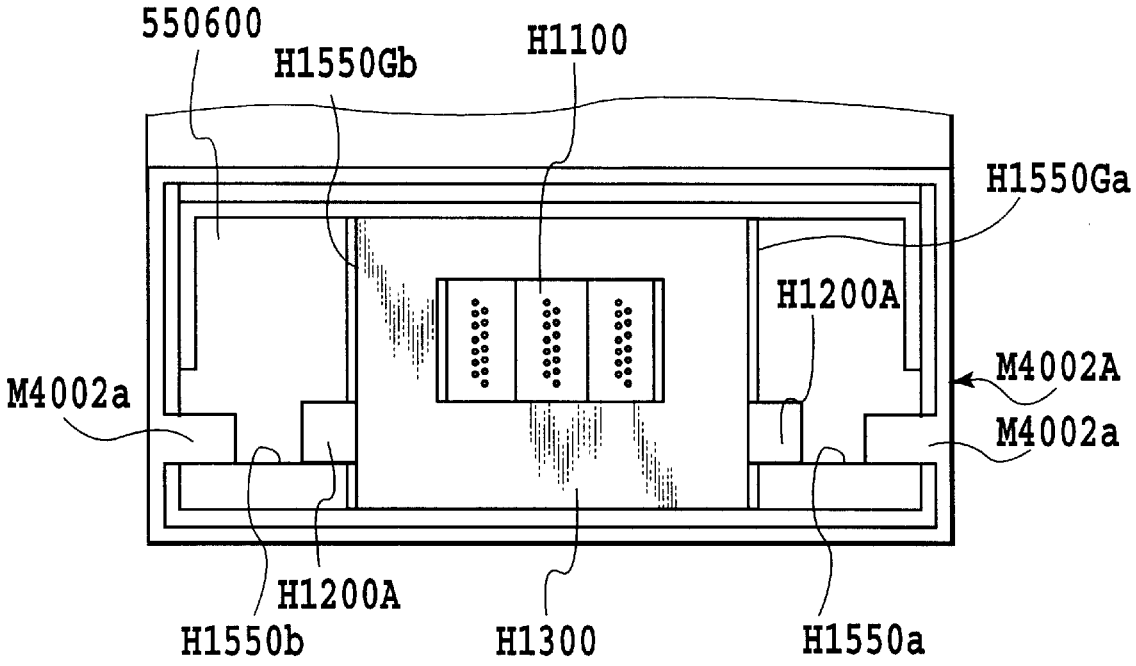
FIG. 41 is a plan view of main part of the liquid ejection type print head mounted to the embodiment shown in FIG. 39.

FIGS. 39, 40 and 41 illustrate a fifth embodiment of a liquid ejection type print head according to the present invention.

In this regard, in FIGS. 39 to 41, the same components as in the embodiments shown in FIGS. 2 and 13A are denoted by the same reference numerals and the explanation thereof will be eliminated.

While the explanation is made, in the above-mentioned embodiments, on the print head H1001 having the tank holder H1500 to which the ink tank H1900 is mounted, the present invention should, needless to say, not be limited to such a structure but may be applicable to a so-called disposable head wherein the print element section and the tank section described above are integral with each other.

In the embodiment shown in FIG. 39, ink tanks H2000A, H2000B, H2000C, H2000D, H2000E and H2000F for supplying different colored inks to a print head H1004, respectively, are provided in a main body M1000 of the apparatus, separately from the carriage M4001. The ink tanks H2000A to H2000F are disposed, for example, beneath a path along which the carriage M4001 moves. The ink tanks H2000D, H2000E and H2000F are not shown in FIG. 39.

Inks stored in the respective ink tanks H2000A to H2000F are supplied to the print head H1004 mounted on the carriage M4001 through a group of ink tubes H2010 connected at one ends to the ink tanks. The respective ink is automatically guided to the print head H1004 due to a negative pressure or a capillary action generated in the print head H1004 in accordance with the printing operation of the print head H1004.

As shown in FIG. 40, the print head H1004 includes a print element unit H1002 and an ink holder H1550 for holding the print element unit H1002 and provided with common ink chambers for storing the supplied inks, respectively.

The common ink chambers of the tank holder H1550 are connected to the other ends of the group of ink tubes H2010, respectively.

The tank holder H1550 has reference end surfaces H1550*a* and H1550*b* at the lower end closer to the back side thereof on which the external signal terminals H1301 are positioned and fixed. The reference end surfaces H1550*a* and H1550*b* communicate with the lateral sides via cutoff sections H1550S*a* and H1550S*b* formed on the peripheral edges thereof.

Also, as shown FIG. 40 and FIG. 41, the tank holder H1550 has projections H1550G*a* and H1550G*b* on the side opposed to a first plate H1200 to be combined to the tank holder, for nipping the opposite ends of the first plate H1200.

In this case, a predetermined gap is formed between the respective projection H1550G*a*, H1550G*b* of the tank holder H1550 and the respective reference end surface H1550*a*, H1550*b*, with which a protrusion H1200A of the first plate H1200 is engageable.

Also, the reference end surfaces H1550*a* and H1550*b* of the tank holder H1550 are brought into contact with the engagement surfaces of the engagement sections M4002*a*, respectively. Accordingly, it is possible to position rows of ejection openings H1100T of the print element substrate H1100 in the mounted tank holder H1550 at a high accuracy relative to the carriage M4002 at a predetermined angle to the moving direction of the carriage M4002.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection type print head comprising a plurality of print element substrates, each having print elements for ejecting liquid, a support member for supporting said print element substrates and a holder secured to said support member and having a section for positioning said holder in relation to a carriage movable together with said print element substrates and said support member; said liquid ejection type print head supplying said liquid to said print element substrates via the holder and said support member, wherein said section for positioning said holder in relation to said carriage is also used as a section for positioning said support member onto said holder.

2. A liquid ejection type print head as claimed in claim 1, wherein said support member has protrusions at opposite ends in a direction in which said print element substrates are arranged, the protrusions defining said section for positioning said holder in a direction transverse to said direction in which said print element substrates are arranged.

3. A liquid ejection type print head as claimed in claim 2, wherein said plurality of print element substrates are positioned by using said positioning section of said support member.

4. A liquid ejection type print head as claimed in claim 3, wherein each print element substrate is provided with a plurality of alignment marks for positioning said print element substrate onto said support member.

5. A liquid ejection type print head as claimed in claim 4, wherein said alignment marks are arranged in a longitudinal direction of said print element substrate.

6. A liquid ejection type print head as claimed in claim 1, wherein said support member is formed of ceramic.

7. A liquid ejection type print head as claimed in claim 1, wherein said support member has a plurality of liquid supply ports in correspondence to said plurality of print element substrates, respectively.

8. A liquid ejection type print head as claimed in claim 7, wherein said plurality of liquid supply ports are arranged in a zigzag manner.

9. A liquid ejection type print head as claimed in claim 8, wherein said support member is provided with a liquid supply passage communicated with said liquid supply port and having an enlarged portion wherein a cross-sectional area of a flow path becomes larger on approach to a print element substrate side.

10. A liquid ejection type print head as claimed in claim 8, wherein said holder has a liquid exit port in correspondence to said liquid supply port and is formed by a molding.

11. A liquid ejection type print head as claimed in claim 1, wherein said holder is provided with a detachable liquid supply member for storing said liquid to be fed to said print element substrates.

12. A liquid ejection type print head as claimed in claim 1, wherein each print element is an electrothermal transducer element for heating said liquid.

13. A liquid ejection type print head as claimed in claim 1, wherein said support member is secured to said holder with an adhesive curable at a low temperature or a normal temperature.

14. A printing apparatus comprising a liquid ejection type print head for carrying out said printing operation by ejecting liquid and a carriage member for transporting said liquid ejection type print head while carrying the same thereon, wherein said liquid ejection type print head is provided with a plurality of print element substrates, each having print elements for ejecting liquid, a support member for supporting said print element substrates and a holder secured to said support member and having a section for positioning said holder onto a carriage movable together with said print element substrates and said support member, and said section for positioning said holder in relation to said carriage is also used as a section for positioning said support member onto said holder.

15. A printing apparatus as claimed in claim 14, wherein each print element is an electrothermal transducer element for heating said liquid.

16. A printing apparatus as claimed in claim 14, wherein said support member is secured to said holder with a hardening adhesive at a low temperature or a normal temperature.

17. A printing apparatus as claimed in claim 14, wherein said holder is provided with a detachable liquid supply member for storing said liquid to be fed to said print element substrates.

18. A printing apparatus as claimed in claim 14, wherein said support member has a plurality of liquid supply ports in correspondence to said plurality of print element substrates, respectively.

19. A printing apparatus as claimed in claim 18, wherein said plurality of liquid supply ports are arranged in a zigzag manner.

20. A method for producing a liquid ejection type print head comprising the steps of:

positioning a first print element substrate to a surface to be adhered therewith on a support member having a protrusion defining a positioning section, said first printing element substrate having print elements for ejecting liquid and a plurality of alignment marks for a positioning operation, while using a predetermined relative position of a respective alignment mark as a reference in relation to said protrusion; and positioning a second print element substrate to a surface to be adhered therewith, said second print element substrate being disposed adjacent to said first print element substrate and having a plurality of alignment marks for a positioning operation, while using a predetermined relative position of a respective alignment mark as a reference in relation to said respective alignment mark of said first print element substrate.

21. A liquid ejection type print head comprising a print element substrate having print elements for ejecting liquid, a support member for supporting said print element substrate and a holder secured to said support member and having a section for positioning said holder in relation to a carriage movable together with said print element substrate and said support member, wherein said section for positioning said holder in relation to said carriage is also used as a section for positioning said support member onto said holder.

* * * * *